US005270140A

United States Patent [19]

Abew et al.

[11] Patent Number: 5,270,140

[45] Date of Patent: Dec. 14, 1993

[54] BISSTYRYL COMPOUND AND THE ELECTROPHOTOGRAPHIC PHOTORECEPTORS RELATING THERETO

[75] Inventors: Naoto Abew; Naohiro Hirose; Hirofumi Hayata; Syozo Mitsui; Shinichi Suzuki; Osamu Sasaki; Yoshio Takizawa; Takeo Oshiba, all of Hachioji, Japan

[73] Assignee: Konica Corporation, Tokyo, Japan

[21] Appl. No.: 848,107

[22] Filed: Mar. 9, 1992

[30] Foreign Application Priority Data

Mar. 15, 1991 [JP] Japan ..... 3-075692

[51] Int. Cl.[5] ..... G03G 5/04

[52] U.S. Cl. ..... 430/59; 430/83

[58] Field of Search ..... 430/58, 59, 95, 83, 430/82

[56] References Cited

U.S. PATENT DOCUMENTS 3,189,447 6/1965 Neugebauer et al. ..... 96/1
3,274,000 9/1966 Noe et al. ..... 96/1.5
3,357,989 12/1967 Byrne et al. ..... 260/314.5
3,820,989 6/1974 Rule et al. ..... 96/1.5
4,724,192 2/1988 Makino et al. ..... 430/59
5,032,479 7/1991 Mishima et al. ..... 430/58

*Primary Examiner*—John Goodrow
*Attorney, Agent, or Firm*—Frishauf, Holtz, Goodman & Woodward

[57] ABSTRACT

An electrophotographic photoreceptors containing a bisstyryl compound represented by the following formula I is disclosed.

Formula I $R^0$ and/or $R^{00}$ represent methyl group, and the rest of Rs represent hydrogen atom or an alkyl group having 1 to 4 carbon atoms; and $Ar^1$ and $Ar^2$ represent each an aromatic group.

7 Claims, 7 Drawing Sheets

BISSTYRYL COMPOUND AND THE ELECTROPHOTOGRAPHIC PHOTORECEPTORS RELATING THERETO

FIELD OF THE INVENTION

This invention relates to a bisstyryl compound and the electrophotographic photoreceptors relating thereto and, particularly, to the bisstyryl compound suitable for a carrier transporting material in an electrophotographic photoreceptor comprising a photoreceptive layer containing a carrier generating material and the carrier transporting material.

BACKGROUND OF THE INVENTION

As for an electrophotographic photoreceptor, those containing each an inorganic photoconductor such as selenium, zinc oxide, cadmium sulfide and silicon as the principal component have heretofore been widely known. However, their characteristics such as the thermal stability and durability thereof have not always been satisfactory and they have also had the problems of manufacture and handling.

On the other hand, the photoreceptors comprising each a photoreceptive layer containing an organic photoconductive compound as the principal component thereof are relatively easier for manufacture, inexpensive in cost, easier for handling and, generally, excellent in thermal stability as compared to a selenium photoreceptor. As for the organic photoconductive compounds, a poly-N-vinylcarbazole has been well-known. There have already been put to practical use the photoreceptors comprising each a photoreceptive layer containing an electric-charge transfer complex produced of the above-mentioned poly-N-vinylcarbazole and a Lewis acid such as 2,4,7-trinitro-9-fluorenone as the principal component thereof.

Further, on the other hand, there have also been known a photoreceptor comprising a laminated or single layered function-separated type photoreceptive layer in which the carrier generating function and carrier transporting function of the photoconductor thereof can be performed by separate materials, respectively. For example, there have already been put to practical use the photoreceptors comprising each a photoreceptive layer comprising a carrier generating layer formed of a thin amorphous selenium layer and a carrier transporting layer containing a poly-N-vinylcarbazole as the principal component thereof.

However, the above-mentioned poly-N-vinylcarbazole lacks a flexibility and the coated layer thereof is solid and fragile and is liable to be cracked or peeled off. Every photoreceptor applied therewith is, therefore, deteriorated in durability. When the above-mentioned defects are improved by adding a plasticizer, the residual potentials are increased in an electrophotographic process and are accumulated as in making repetition use so as to produce fogs increasingly, so that a copied image is spoiled.

A low-molecular organic photoconductive compound has generally no coated-layer forming function. Therefore, when the compound is used with a suitable binder in combination and the kinds and composite proportions of the binders are suitably selected, the compound is preferable from the viewpoint that the physical properties of the coated layer or the photoreceptive characteristics can each be controlled to some extent. However, there are some limitation to the kinds of the organic photoconductive compounds each having a relatively high compatibility with the binders. Actually, there are limited to the kinds of the binders applicable to form the photoreceptive layers of an electrophotographic photoreceptor.

For example, 2,5-bis(p-diethylaminophenyl)-1,3,4-oxadiazole described in U.S. Pat. No. 3,189,447 is low in compatibility with the binders commonly applicable as a material of the photoreceptive layers of an electrophotographic photoreceptor, such as a polyester and a polycarbonate. In other words, when a photoreceptive layer is formed by mixing them up in a proportion required for controlling the electrophotographic characteristics, the crystals of oxadiazole are deposited at a temperature of not lower than 50° C., so as to have a defect that the electrophotographic characteristics such as electric-charge coercive force and photoreceptivity deteriorate.

In the meanwhile, each of the diaryl alkane derivatives described in U.S. Pat. No. 3,820,989 has few problems of the compatibility with a binder. However, it is low in stability against light. When it is applied to a repetition-transfer type electrophotographic photoreceptor to which an electric-charge-an exposure are applied repeatedly, it has a defect that the photoreceptivity of the photoreceptive layer is gradually lowered.

In U.S. Pat. No. 3,274,000 and Japanese Patent Examined Publication No. 47-36428/1972, the different types of phenothiazine derivatives are described, respectively. However, every one of them has the defect that the photoreceptivities thereof are low and the stabilities thereof are also low in repetition use.

The stilbene compounds described in Japanese Patent Publication Open to Public Inspection (hereinafter referred to as JP OPI Publication) Nos. 58-65440/1983, 58-190953/1983 and 63-149652/1988 are each relatively excellent in electric-charge coercive force and photoreceptivity. However, they are still not satisfactory in durability in repetition use.

In the meanwhile, the photoreceptors capable of solving the above-mentioned defects include those applied with a distilbene compound as the carrier transporting material thereof, such as those described in JP OPI Publication Nos. 60-175052/1985, 60-174749/1985, 62-120346/1987, 64-32265/1989, 1-106069/1989, 1-93746/1989 and 1-274154/1989. However, they can still not be satisfactory in durability when they are incorporated into a copier or a printer and are used repeatedly.

Particularly, there have been the following for problems.

1) In a high-speed copier having a high linear velocity, a cycle of electric-charging-exposure-electric neutralization is shortened. Therefore, the residual potential is seriously raised in repetition copying operations;

2) When making use of a copier for repeating copying operations, a small white spotted image defect (that is so-called a white-dot) is produced in solid-black image areas;

3) When making use of a reversal development type printer, there found the defects that an exposure potential (VL) is raised at a low temperature and an electric-charge potential (VH) is lowered in repetition use; and 4) A small black-spotted image defect (that is so-called a black-dot) is liable to be produced in white image areas.

As described above, there has not been found any carrier transporting material having the characteristics which can be practical and satisfactory for providing an electrophotographic photoreceptor.

SUMMARY OF THE INVENTION

It is an object of the invention to provide a compound suitable for a carrier transporting material for a highly photoreceptive and highly durable photoreceptor applicable to a copier or printer and the electrophotographic photoreceptors relating thereto.

The other objects of the invention are to provide the following (1) through (4);

(1) a compound suitable for a carrier generating material for a photoreceptor not raising any residual potential thereof even when repeating a series of electric-charging-exposure-electric neutralization operations, in a high-speed copier having a high linear velocity, and the electrophotographic photoreceptors relating thereto;

(2) a compound suitable for a carrier transporting material for a photoreceptor not producing any small white-spotted image defect (that is so-called a white-dot) in the solid-black image areas even in repetition use, when the photoreceptor is incorporated into a copier, and the electrophotographic photoreceptors relating thereto;

(3) a compound suitable for a carrier generating material for a photoreceptor neither raising an exposure potential (VL) at a low temperature even in repetition use, nor lowering an electric-charge potential (VH) even in repetition use, in the case where the photoreceptor is incorporated into a reversal development type printer, and the electrophotographic photoreceptors relating thereto; and (4) a compound suitable for a carrier transporting material for a photoreceptor not producing any small black-spotted image defect (that is so-called a black-dot) in the white image areas, and the electrophotographic photoreceptors relating thereto.

Wherein, reference numeral

1: a support

2: a carrier generating layer

3: a carrier transporting layer

5: an interlayer

Figure 1:
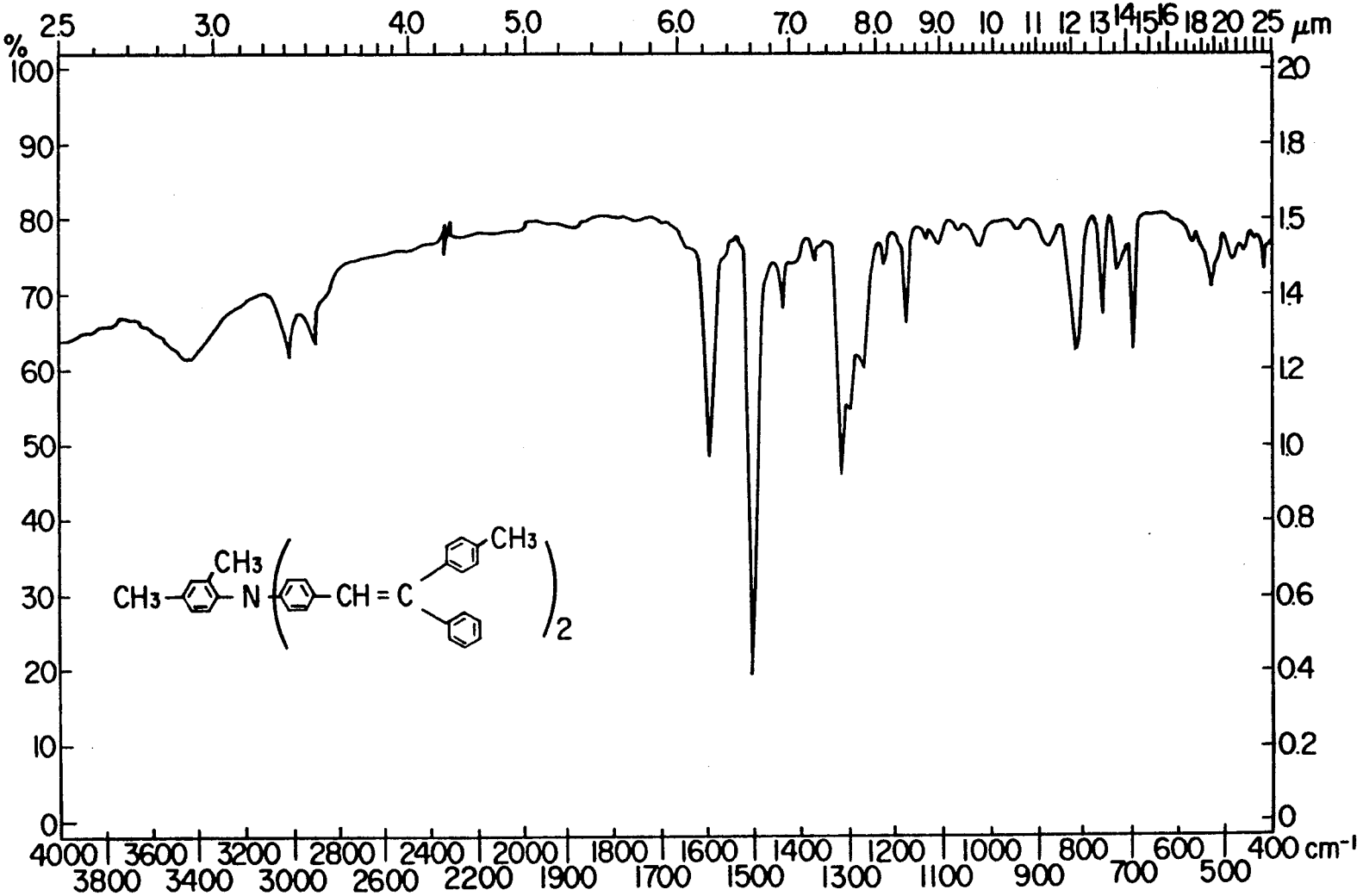
FIG. 1 is the IR spectra of an example of the carrier transporting materials relating to the invention.

6: a layer containing a carrier generating material and a carrier transporting material

DETAILED DESCRIPTION OF THE INVENTION

This invention relates to the bisstyryl compounds represented by the following Formula [I] and to the electrophotographic photoreceptors each containing the above-mentioned bisstyryl compound.

Formula [I]

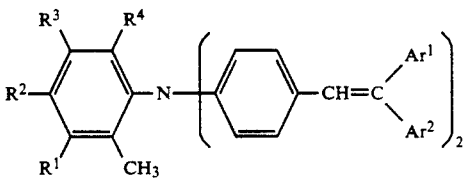

wherein $R^1$, $R^2$, $R^3$ and $R^4$ represent each a hydrogen atom or an alkyl group having 1 to 4 carbon atoms;

$Ar^1$ and $Ar^2$ represent each

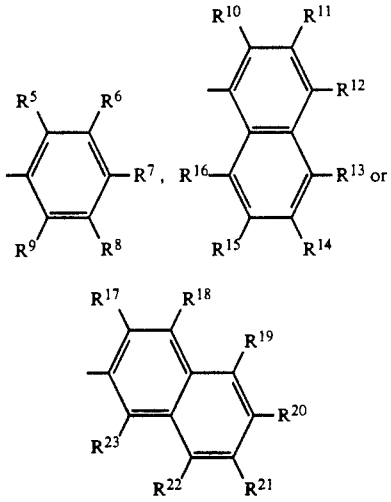

wherein $R^5$, $R^6$, $R^7$, $R^8$, $R^9$, $R^{10}$, $R^{11}$, $R^{12}$, $R^{13}$, $R^{14}$, $R^{15}$, $R^{16}$, $R^{17}$, $R^{18}$, $R^{19}$, $R^{20}$, $R^{21}$, $R^{22}$ and $R^{23}$ represent each a hydrogen atom, an alkyl group having 1 to 4 carbon atoms, a halogenated alkyl group having 1 to 4 carbon atoms, a halogen atom,

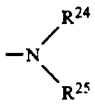

wherein $R^{24}$ and $R^{25}$ represent each an alkyl group, an aralkyl group or a phenyl group, $—OR^{26}$ wherein $R^{26}$ represents an alkyl group, an aralkyl group or a phenyl group, a hydroxyl group, an aralkyl group, a phenyl group, $-R^{27}COOR^{28}$ wherein $R^{27}$ represents an alkylene group and $R^{28}$ represents an alkyl group, $-COOR^{29}$ wherein $R^{29}$ represents an alkyl group, $-R^{30}OCOR^{31}$ wherein $R^{30}$ represents an alkylene group and $R^{31}$ represents an alkyl group, or $-OCOR^{32}$ wherein $R^{32}$ represents an alkyl group; provided, $Ar^1$ and $Ar^2$ shall not represent each

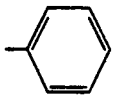

(non-substituted) at the same time, and when $Ar^1$ represents

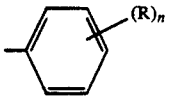

and $Ar^2$ represents

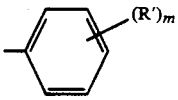

(wherein R and R' represents each an alkyl group having 1 to 4 carbon atoms), n is 1, m is 1 or 0. Regarding $Ar^1$ and $Ar^2$, a preferred combination is that $Ar^1$ represents a phenyl group substituted with an alkyl group having 1 to 4 carbon atoms and $Ar^2$ represents a non-substituted phenyl group. More preferably, $Ar^1$ is a substituted with a methyl group, and most preferably is a para-methyl group.

Formula [II]

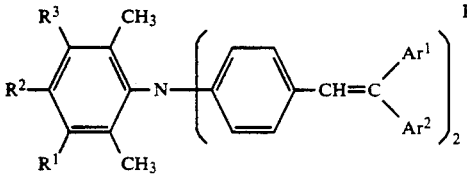

wherein $R^1$, $R^2$ and $R^3$ represent each a hydrogen atom or an alkyl group having 1 to 4 carbon atoms, $Ar^1$ and $Ar^2$ represent each

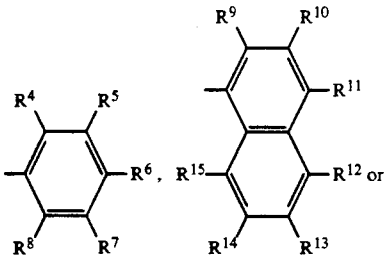

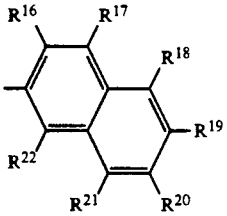

wherein $R^4$, $R^5$, $R^6$, $R^7$, $R^8$, $R^9$, $R^{10}$, $R^{11}$, $R^{12}$, $R^{13}$, $R^{14}$, $R^{15}$, $R^{16}$, $R^{17}$, $R^{18}$, $R^{19}$, $R^{20}$, $R^{21}$ and $R^{22}$ represent each a hydrogen atom, an alkyl group having 1 to 4 carbon atoms, a halogenated alkyl group having 1 to 4 carbon atoms, a halogen atom,

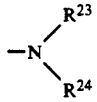

wherein $R^{23}$ and $R^{24}$ represent each an alkyl group, an aralkyl group or a phenyl group, $-OR^{25}$ wherein $R^{25}$ represents an alkyl group, an aralkyl group or a phenyl group, a hydroxyl group, an aralkyl group, a phenyl group, $-R^{26}COOR^{27}$ wherein $R^{26}$ represents an alkylene group and $R^{27}$ represents an alkyl group, $-COOR^{28}$ wherein $R^{28}$ represents an alkyl group, $-R^{29}OCOR^{30}$ wherein $R^{29}$ represents an alkylene group and $R^{30}$ represents an alkyl group, or $-OCOR^{31}$ wherein $^{31}$ represents an alkyl group; provided, when $Ar^1$ represents

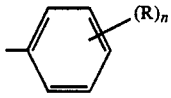

and $Ar^2$ represents

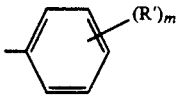

(wherein R and R' represent each an alkyl group having 1 to 4 carbon atoms), n is 0 or 1 and m is 0 or 1. Preferably, n is 0 and m is 0.

Further, this invention is to provide the bisstyryl compounds represented by the following Formula [III] and the electrophotographic photoreceptors containing the bisstyryl compounds.

Formula [III]

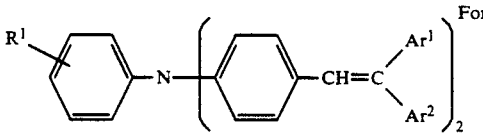

wherein $R^1$ represents an alkyl group having 1 to 4 carbon atoms, $Ar^1$ and $Ar^2$ represent each

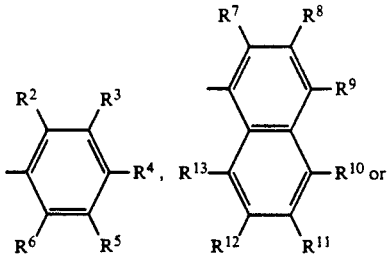

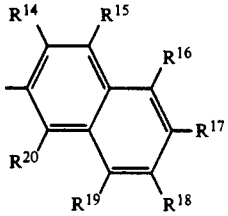

wherein $R^2$, $R^3$, $R^4$, $R^5$, $R^6$, $R^7$, $R^8$, $R^9$, $R^{10}$, $R^{11}$, $R^{12}$, $R^{13}$, $R^{14}$, $R^{15}$, $R^{16}$, $R^{17}$, $R^{18}$, $R^{19}$ and $R^{20}$ represent each a hydrogen atom, an alkyl group having 1 to 4 carbon atoms, a halogenated alkyl group having 1 to 4 carbon atoms, a halogen atom,

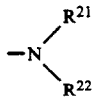

wherein $R^{21}$ and $R^{22}$ represent each an alkyl group, an aralkyl group or a phenyl group, —$OR^{23}$ wherein $R^{23}$ represents an alkyl group, an aralkyl group or a phenyl group, a hydroxyl group, an aralkyl group, a phenyl group, —$R^{24}COOR^{25}$ wherein $R^{24}$ represents an alkylene group and $R^{25}$ represents an alkyl group, —$COOR^{26}$ wherein $R^{26}$ represents an alkyl group, —$R^{27}OCOR^{28}$ wherein $R^{27}$ represents an alkylene group and $R^{28}$ represents an alkyl group, or —$OCOR^{29}$ wherein $R^{29}$ represents an alkyl group; provided, $Ar^1$ and $Ar^2$ shall not represent each

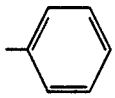

(non-substituted), at the same time, and when $Ar^1$ represents

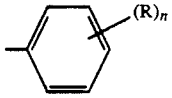

and $Ar^2$ represents

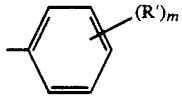

R and/or R' represent each the substituent represented by the above-denoted $R^2$, $R^3$, $R^4$, $R^5$ or $R^6$, and when R and R' represent each an alkyl group having 1 to 4 carbon atoms, n is 1 and m is 0 or 1. Regarding $Ar^1$ and $Ar^2$, a preferred combination is that $Ar^1$ represents a phenyl group substituted with an alkyl group having 1 to 4 carbon atoms and $Ar^2$ represents a non-substituted phenyl group. More preferably, $Ar^1$ is a substituted with a methyl group, and most preferably is a para-methyl group.

The above-mentioned substituents for the compounds of the invention represented by the above-given formulas include, for example, an alkyl group such as those of methyl, ethyl, propyl and butyl; an alkoxy group such as those of methoxy, ethoxy and propoxy; a halogen atom such as those of fluorine, chlorine and iodine; a dialkylamino group such as those of diethylamine; a diaralkylamino group such as those of diethylphenylamine; a diallylamino group such as those of diphenylamine; a diarylamino group; an ester group such as those of oxycarbonylmethyl; a phenoxy group; a phenyl group; a cyano group; an acyl group such as those of carbonylethyl; a hydroxy group; and a trifluoromethyl group.

$Ar^1$ and $Ar^2$ in the formulae I, II and III, preferably are phenyl groups. And when it is substituted, the substituent preferably is a methyl group.

The compounds of the invention represented by the above-given Formulas [I], [II] and [III] are each characterized in the following features (A) through (C) and are each suitable for the carrier transporting materials of an electrophotographic photoreceptor.

(A) The photoreceptivity and durability can be improved, because the compounds are bisstyryl compounds each having a substituent in the molecules thereof. When the electrophotographic photoreceptor is incorporated into a copier or a printer and is then used repeatedly therein, an excellent image can be provided without producing any image defect and any image failure, such as white-dots, black-dots, fog and density lowering, because the electric-charge potential variations can be reduced;

(B) When it is incorporated into a high-speed copier or printer and is then used repeatedly, an excellent image can be provided without producing any image defect or image failure, because the residual potential thereof can also be reduced;

(C) The synthesis thereof can also be easier, because it is a bisstyryl compound.

The typical compounds of the invention Nos. 1 through 87 will be collectively exemplified later.

Next, the synthesis examples of the compounds represented by Formula [I] will now be detailed. The outlines of the synthesis formula will also be given below.

Synthesis Example 1: Synthesis of Exemplified Compound No.6

Formyl substance 3 was synthesized in the known procedures.

Potassium carbonate (manufactured by Kanto Chemical Co.) (in a mol ratio of 2) and copper powder (manufactured by Kanto Chemical Co.) (in a mol ratio of 0.2) were added into 2,4-dimethyl aniline (manufactured by Aldrich Co.) 1 (in a mol ratio of 1) and iodobenzene (manufactured by Tokyo Kasei Co.) (in a mol ratio of 2.5), and the resulting mixture was reacted at an internal temperature within the range of 190° to 210° C. for 50 hours. After the resulting reactant was after-treated and then column-refined, 2,4-dimethyl triphenyl amine 2 was obtained in a yield of 80%, (in Ullmann's reaction).

N,N-dimethyl formamide (manufactured by Kanto Chemical Co.) (in a mol ratio of 4) and phosphorus oxychloride (manufactured by Wako Junyaku Ind. Co.) (in a mol ratio of 3) were added into 2,4-dimethyl triphenyl amine 2 (in a mol ratio of 1), and the resulting mixture was reacted at an internal temperature within the range of 70° to 90° C. for 24 hours. After the resulting reactant was after-treated and then column-refined, N,N-bis(4-formyl-phenyl)-2,4-dimethyl aniline 3 was obtained in a yield of 60%, (in Wilsmyer's reaction).

Diethyl phosphonate substance 7 was synthesized in the known procedures. 4-methyl benzophenone (manufactured by Aldrich Co.) 4 (in a mol ratio of 1) was added into methanol (manufactured by Kanto Chemical Co.) and sodium bolohydride (manufactured by Kanto Chemical Co.) (in a mol ratio of 0.5) was then added thereinto. The resulting mixture was reacted at an internal temperature within the range of 10° to 20° C. for 5 hours. After the resulting reactant was after-treated and then column-refined, hydroxy substance 5 was obtained in a yield of 95%, (in a reduction reaction).

Hydroxy substance 5 (in a mol ratio of 1) was added into toluene (manufactured by Wako Junyaku Ind. Co.) (in a mol ratio of 1.2). The resulting mixture was reacted at an internal temperature within the range of 10° to 20° C. for 2 hours. After the resulting reactant was after-treated, chlor substance 6 was obtained in a yield of 95%, (in a substitution reaction).

Triethyl phosphite (manufactured by Kanto Chemical Co.) (in a mol ratio of 1.2) was added into chlor substance 6 (in a mol ratio of 1). The resulting mixture was reacted at an internal temperature within the range of 140° to 160° C. for 10 hours. After the resulting reactant was after-treated and then distillation-refined, diethyl phosphonate substance 7 was obtained in a yield of 93%, (in a diethyl phosphonate reaction).

A carrier transporting material (hereinafter abbreviated to as CTM) was synthesized by making use of the compounds obtained in the above-described procedures as the raw materials thereof.

N,N-bis(4-formyl-phenyl)-2,4-dimethyl aniline 3 of 10 g (in 0.033 mols) and 1-(4-methyl-phenyl)-1-phenyldiethyl methyl phosphonate 7 of 21 g (in 0.066 mols) were dissolved in toluene (manufactured by Wako Junyaku Ind. Co.) of 50 ml. Sodium methoxide (manufactured by Kanto Chemical Co.) of 3.6 g (in 0.0660 mols) was added into toluene of 50 ml and the resulting mixed solution was added into the former solution while keeping an internal temperature of not higher than 25° C. with cooling them with ice. After that, the resulting mixture was stirred at room temperature for 3 hours. Then, 100 ml of water was added thereinto, and the resulting toluene layer was washed. The remaining water was removed from the toluene layer with the use of sodium sulfate (manufactured by Kanto Chemical Co.) and the solvents were distilled off. After the resulting residuals were column-refined with silica, the objective exemplified compound No. 6 of 16 g (in 0.023 mols) in the form of yellow-white crystals was obtained in a yield of 71%.

The melting point thereof was within the range of 100° to 114° C. and the elementary analyzed value thereof was a follows.

| | C (carbon) | H (hydrogen) | N (nitrogen) |
|---|---|---|---|
| Measured value (%) | 91.10 | 6.71 | 2.10 |
| Calculated value (%): | 91.27 | 6.60 | 2.13 |

IR data of No.6 (for the spectra thereof, refer to FIG. 1) 1500 $cm^{-1}/S$ (Strong: and so forth).

Synthesis Example 2: Synthesis of Exemplified Compound No. 3

Exemplified compound No. 3 of 17.4 g (in 0.026 mols) in the form of yellow-white crystals was obtained in a yield of 80% in the same manner as in Synthesis Example 1, except that 2,4-dimethyl triphenyl amine used in Synthesis Example 1 was replaced by 2,3-dimethyl triphenyl amine.

The melting point thereof was within the range of 102° to 110° C. and the elementary analyzed value thereof was as follows.

| | C (carbon) | H (hydrogen) | N (nitrogen) |
|---|---|---|---|
| Measured value (%): | 91.12 | 6.80 | 2.05 |
| Calculated value (%): | 91.27 | 6.60 | 2.13 |

Figure 2:
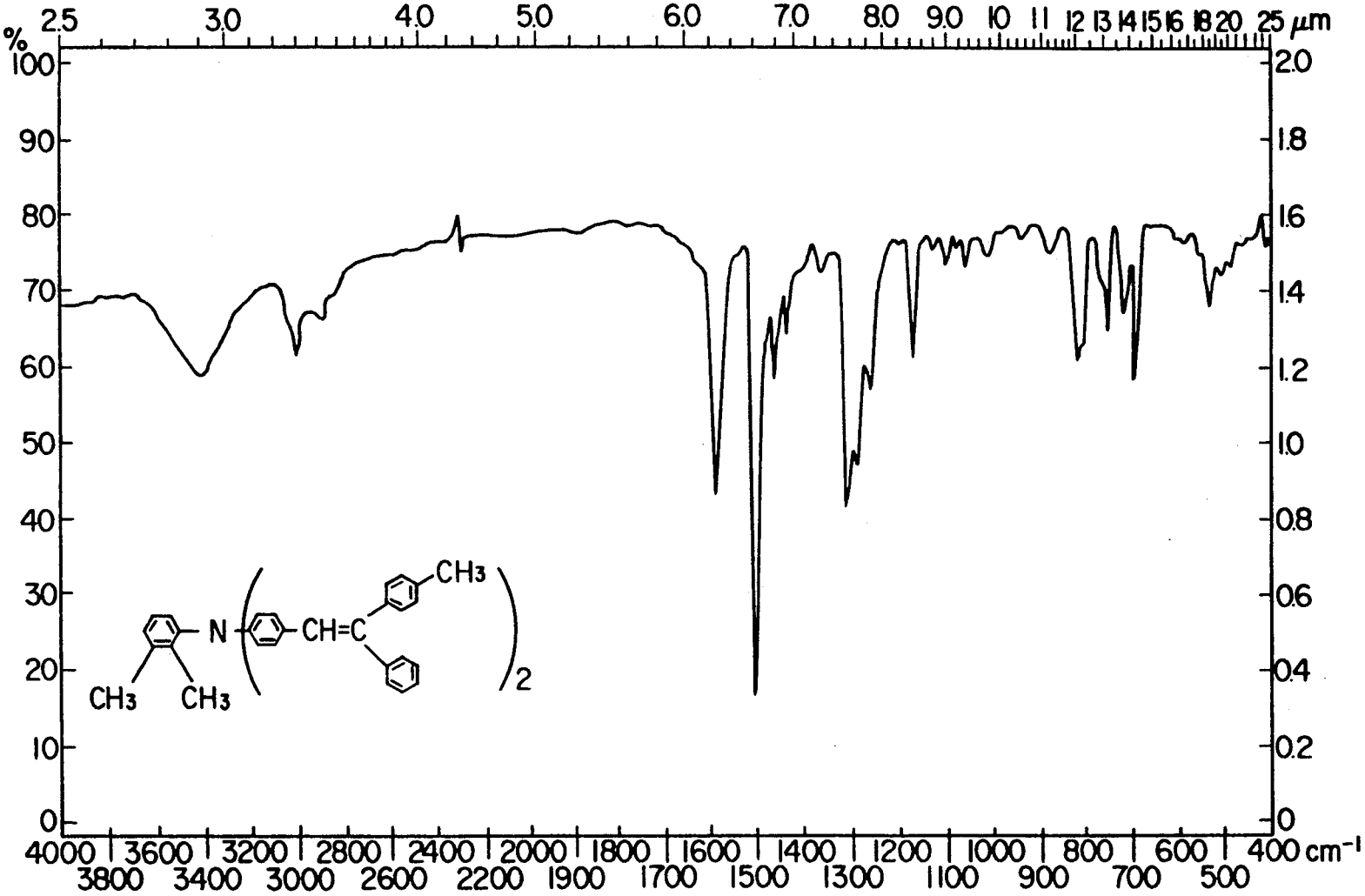
FIG. 2 is the IR spectra of another example of the carrier transporting materials relating to the invention.

IR data of No.3 (for the spectra thereof, refer to FIG. 2) 1500 $cm^{-1}/S$,

Synthesis Example 3: Synthesis of Exemplified Compound No.2

Exemplified compound No.2 of 16.5 g (in 0.025 mols) in the form of yellow-white crystals was obtained in a yield of 82% in the same manner as in Synthesis Example 1, except that 2,4-dimethyl triphenyl amine and 4-methyl benzophenone used in Synthesis Example 1 were replaced by 2,3-dimethyl triphenyl amine and 3-methyl benzophenone, respectively.

The melting point thereof was within the range of 108° to 115° C. and the elementary analyzed value thereof was as follows.

| | C (carbon) | H (hydrogen) | N (nitrogen) |
|---|---|---|---|
| Measured value (%): | 91.09 | 6.70 | 2.07 |
| Calculated value (%): | 91.27 | 6.60 | 2.13 |

Synthesis Example 4: Synthesis of Exemplified Compound No.9

Exemplified compound No.9 of 16.8 g (in 0.026 mols) in the form of yellow-white crystals was obtained in a yield of 80% in the same manner as in Synthesis Example 1, except that 2,4-dimethyl aniline used in Synthesis Example 1 was replaced by 2,5-dimethyl dimethyl aniline.

The melting point thereof was within the range of 102° to 105° C. and the elementary analyzed value thereof was as follows.

| | C (carbon) | H (hydrogen) | N (nitrogen) |
|---|---|---|---|
| Measured value (%): | 91.05 | 6.81 | 1.95 |
| Calculated value (%): | 91.27 | 6.60 | 2.13 |

Synthesis Example 5: Synthesis of Exemplified Compound No.10

Exemplified compound No.10 of 12.4 g (in 0.019 mols) in the form of yellow-white crystals was obtained in a yield of 57% in the same manner as in Synthesis Example 1, except that 4-methyl benzophenone and 2,4-dimethyl aniline each used in Synthesis Example 1 were replaced by 2-methyl benzophenone and 2,6-dimethyl aniline, respectively.

The melting point thereof was within the range of 100° to 103° C. and the elementary analyzed value thereof was as follows.

| | C (carbon) | H (hydrogen) | N (nitrogen) |
|---|---|---|---|
| Measured value (%): | 91.18 | 6.65 | 2.10 |
| Calculated value (%): | 91.27 | 6.60 | 2.13 |

Next, the typical compounds No.(1) through No.(70) represented by Formula [II] will be collectively exemplified later.

The synthesis examples of the compounds represented by Formula [II] will now be detailed.

Synthesis Example 6: Synthesis of Exemplified Compound No.(22)

Exemplified compound No.(22) of 22 g (in 0.026 mols) in the form of yellow-white crystals was obtained in a yield of 79% in the same manner as in Synthesis Example 1, except that 2,4-dimethyl triphenyl amine and 1-(4-methyl-phenyl)-1-phenyldiethyl methylphosphonate each used in Synthesis Example 1 were replaced by 2,3,6-trimethyl-triphenyl amine and dinaphthyl-diethyl methyl phosphonate, respectively.

The melting point thereof was within the range of 157° to 159° C. and the elementary analyzed value thereof was as follows.

| | C (carbon) | H (hydrogen) | N (nitrogen) |
|---|---|---|---|
| Measured value (%): | 92.245 | 5.973 | 1.687 |
| Calculated value (%): | 92.489 | 5.851 | 1.659 |

Synthesis Example 7: Synthesis of Exemplified Compound No.(53)

Exemplified compound No.(53) of 18 g (in 0.025 mols) in the form of yellow-white crystals was obtained in a yield of 76% in the same manner as in Synthesis Example 1, except that 2,4-dimethyl triphenyl amine and 1-(4-methyl-phenyl)-1-phenyldiethyl methyl phosphonate each used in Synthesis Example 1 were replaced by 2,4,6-trimethyl-triphenyl amine and 1-(4-chloro-phenyl)-1-phenyl-diethyl methyl phosphonate, respectively.

The melting point thereof was within the range of 138° to 141° C. and the elementary analyzed value thereof was as follows.

| | C (carbon) | H (hydrogen) | N (nitrogen) |
|---|---|---|---|
| Measured value (%): | 82.614 | 5.537 | 1.902 |
| Calculated value (%): | 82.572 | 5.471 | 1.965 |

Synthesis Example 8: Synthesis of Exemplified Compound No. (11)

Exemplified compound No.11 of 14.8 g (in 0.023 mols) in the form of yellow-white crystals was obtained in a yield of 70% in the same manner as in Synthesis Example 1, except that 2,4-dimethyl triphenyl amine and 1-(4-methyl-phenyl)-1-phenyl-diethyl methyl phosphonate each used in Synthesis Example 1 were replaced by 2,4,6-trimethyl-triphenyl amine and diphenyl-diethyl methyl phosphonate, respectively.

The melting point thereof was within the range of 174° to 177° C. and the elementary analyzed value thereof was as follows.

| | C (carbon) | H (hydrogen) | N (nitrogen) |
|---|---|---|---|
| Measured value (%): | 91.270 | 6.627 | 2.098 |
| Calculated value (%): | 91.405 | 6.409 | 2.175 |

Figure 3:
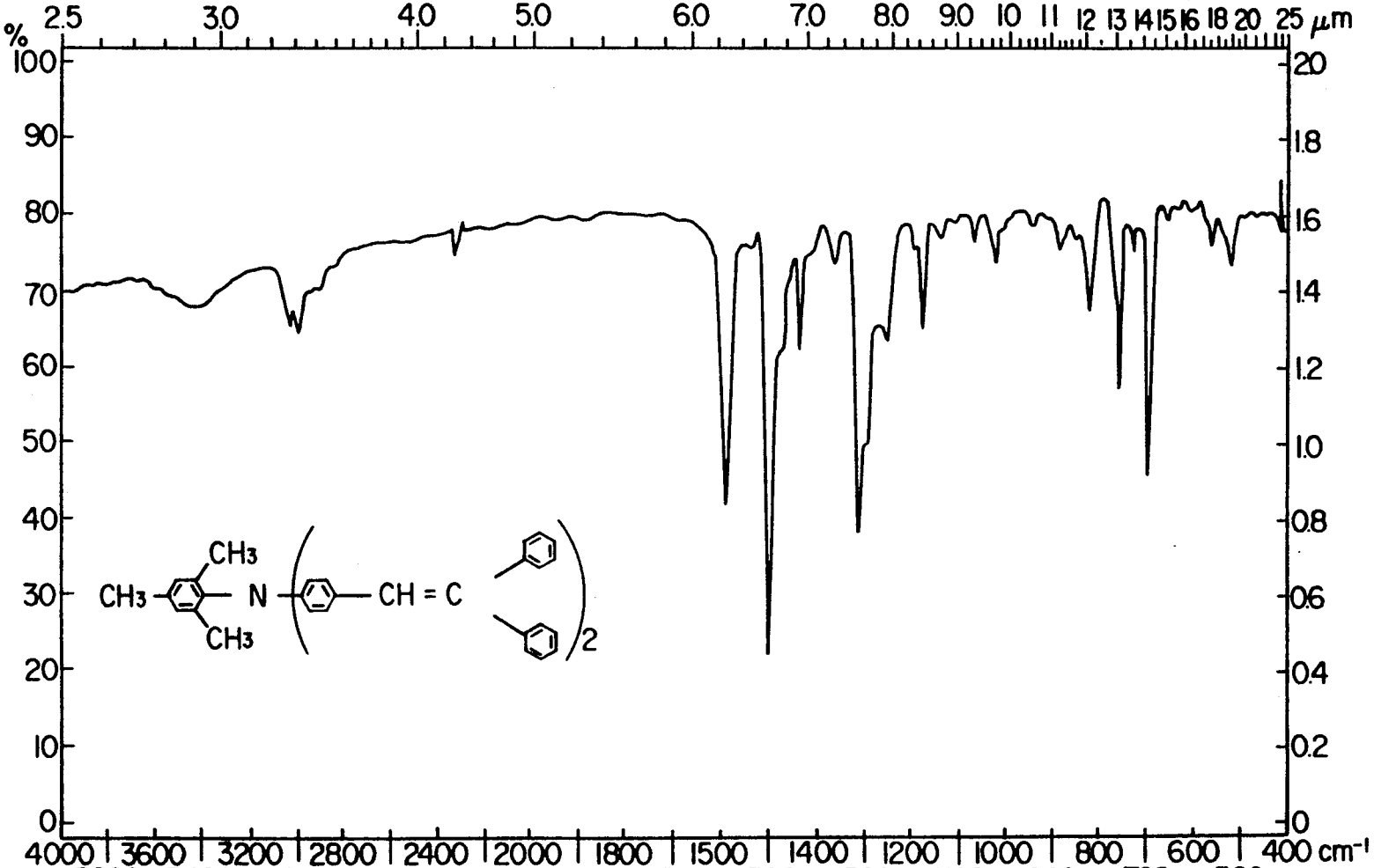
FIG. 3 is the IR spectra of a further example of the carrier transporting materials relating to the invention.

IR data of No.(11) (for the spectra thereof, refer to FIG. 3) 1500 $cm^{-1}$:S.

Synthesis Example 9: Synthesis of Exemplified Compound No.(14)

Exemplified compound No.(14) of 14.1 g (in 0.021 mols) in the form of yellow-white crystals was obtained in a yield of 64% in the same manner as in Synthesis Example 8, except that diphenyl-diethyl methyl phosphonate used in Synthesis Example 8 was replaced by 1-(4-methyl-phenyl)-1-phenyl-diethyl methyl phosphonate.

The melting point thereof was within the range of 121° to 125° C. and the elementary analyzed value thereof was as follows.

| | C (carbon) | H (hydrogen) | N (nitrogen) |
|---|---|---|---|
| Measured value (%): | 91.197 | 6.823 | 2.008 |
| Calculated value (%): | 91.165 | 6.751 | 2.085 |

Figure 4:
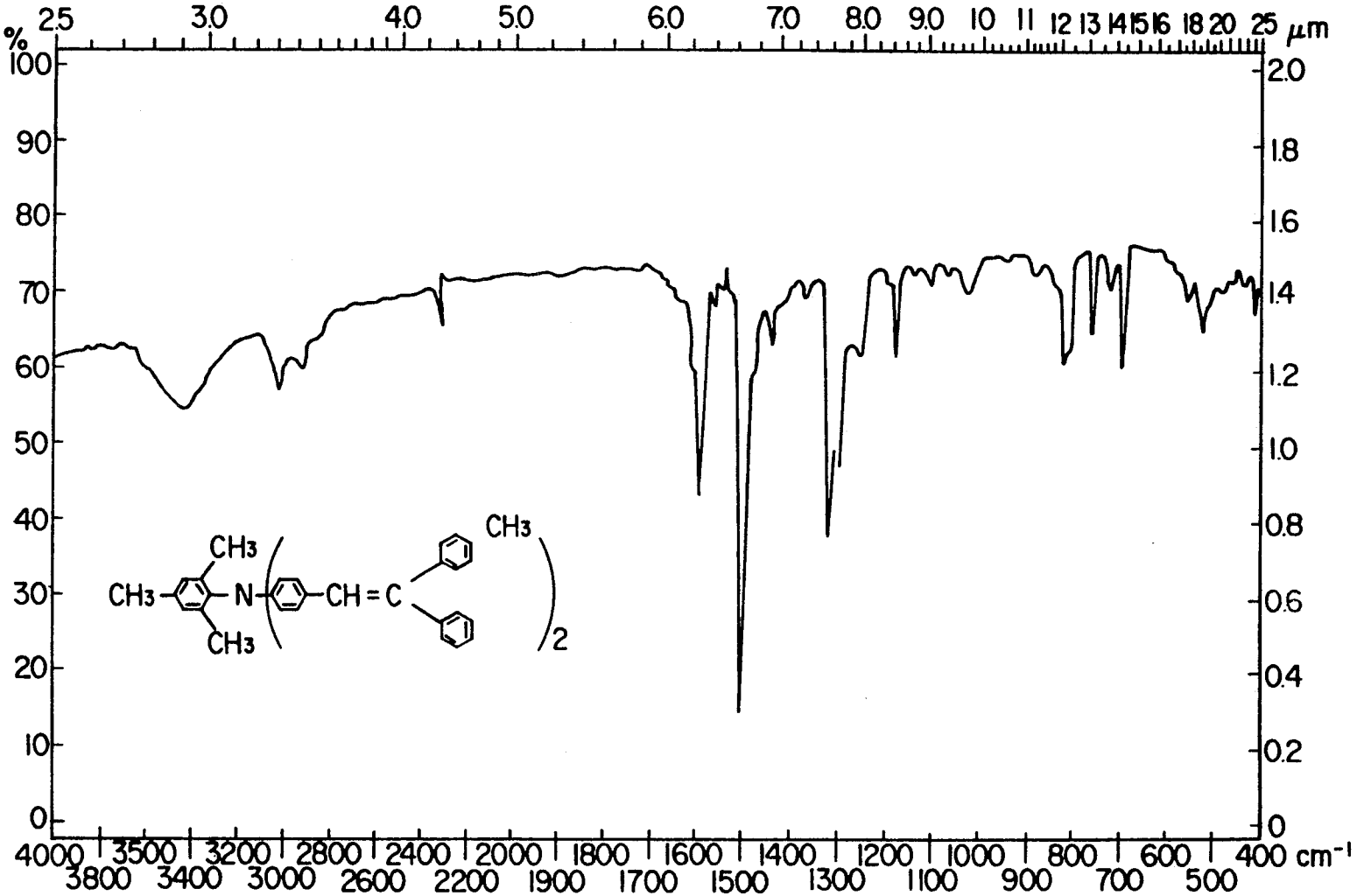
FIG. 4 is the IR spectra of a still further example of the carrier transporting materials relating to the invention.

IR data of No.(11) (for the spectra thereof, refer to FIG. 4) 1500 $cm^{-1}$: S.

Synthesis Example 10: Synthesis of Exemplified Compound No.(1)

Exemplified compound No.(1) of 12.2 g (in 0.019 mols) in the form of yellow-white crystals was obtained in a yield of 58% in the same manner as in Synthesis Example 8, except that N,N-bis-(4-formyl-phenyl)-2,4,6-trimethyl amine (corresponding to 3 of Synthesis Example 1) used in Synthesis Example 8 was replaced by N,N-bis-(4-formyl-phenyl)-2,3,6-trimethyl amine.

The melting point thereof was within the range of 122° to 125° C. and the elementary analyzed value thereof was as follows.

| | C (carbon) | H (hydrogen) | N (nitrogen) |
|---|---|---|---|
| Measured value (%): | 91.267 | 6.535 | 2.198 |
| Calculated value (%): | 91.405 | 6.409 | 2.175 |

Synthesis Example 11: Synthesis of Exemplified Compound No.(20)

Exemplified compound No.(20) of 14.7 g (in 0.021 mols) in the form of yellow-white crystals was obtained in a yield of 64% in the same manner as in Synthesis Example 8, except that diphenyl-diethyl methyl phosphonate used in Synthesis Example 8 was replaced by di(4-methyl-phenyl)-diethyl methylphosphonate.

The melting point thereof was within the range of 169° to 173° C. and the elementary analyzed value thereof was as follows.

| | C (carbon) | H (hydrogen) | N (nitrogen) |
|---|---|---|---|
| Measured value (%): | 90.877 | 7.149 | 1.983 |
| Calculated value (%): | 90.943 | 7.056 | 2.001 |

Next, the typical compounds No. [1] through [155] represented by Formula [III] will be collectively exemplified later.

The synthesis examples of the compounds represented by Formula [III] will now be detailed.

Synthesis Example 12: Synthesis of Exemplified Compound No.[21]

Exemplified compound No.[21] of 13.1 g (in 0.020 mols) in the form of yellow-white crystals was obtained in a yield of 60% in the same manner as in Synthesis Example 1, except that N,N-bis(4-formyl-phenyl)-2,4-dimethyl amine used in Synthesis Example 1 was replaced by N,N-bis(4-formyl-phenyl)-4-ethyl aniline.

The melting point thereof was within the range of 94° to 100° C. and the elementary analyzed value thereof was as follows.

| | C (carbon) | H (hydrogen) | N (nitrogen) |
|---|---|---|---|
| Measured value (%): | 91.2828 | 6.5880 | 2.1281 |
| Calculated value (%): | 91.2831 | 6.5879 | 2.1290 |

Figure 5:
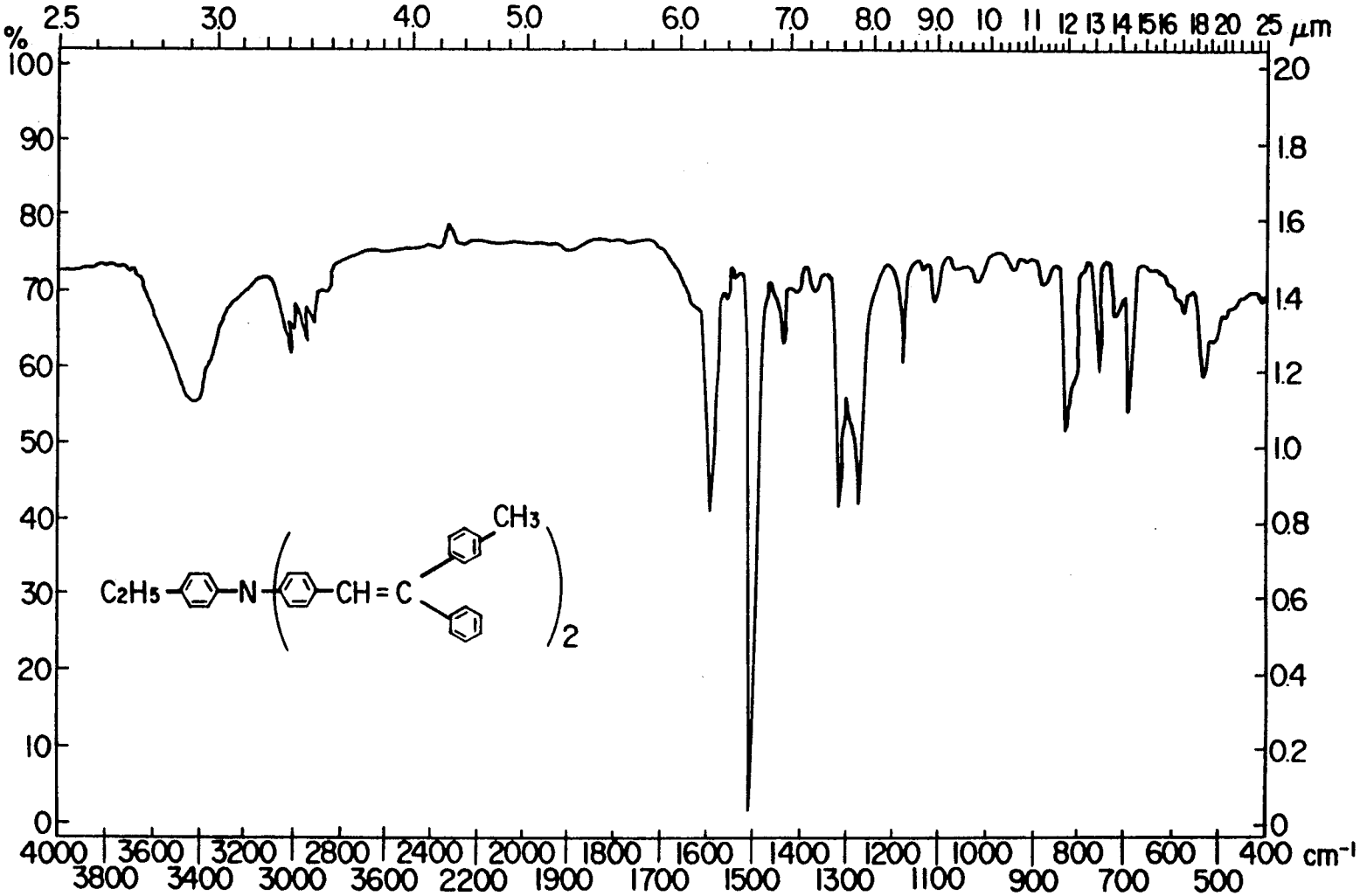
FIG. 5 is the IR spectra of a yet another example of the carrier transporting materials relating to the invention.

IR data of No.[21] (for the spectra thereof, refer to FIG. 5).

Synthesis Example 13: Synthesis of Exemplified Compound No.[3]

Exemplified compound No.[3] of 17.7 g (in 0.027 mols) in the form of yellow-white crystals was obtained in a yield of 70% in the same manner as in Synthesis Example 12, except that p-ethyl aniline used in Synthesis Example 12 was replaced by o-ethyl aniline.

The melting point thereof was within the range of 90° to 93° C. and the elementary analyzed value thereof was as follows.

| | C (carbon) | H (hydrogen) | N (nitrogen) |
|---|---|---|---|
| Measured value (%): | 91.2833 | 6.5876 | 2.1281 |
| Calculated value (%): | 91.2831 | 6.5879 | 2.1290 |

Synthesis Example 14: Synthesis of Exemplified Compound No.[12]

Exemplified compound No.[12] of 16.4 g (in 0.025 mols) in the form of yellow-white crystals was obtained in a yield of 65% in the same manner as in Synthesis Example 12, except that p-ethyl aniline used in Synthesis Example 12 was replaced by m-ethyl aniline.

The melting point thereof was within the range of 93° to 98° C. and the elementary analyzed value thereof was as follows.

| | C (carbon) | H (hydrogen) | N (nitrogen) |
|---|---|---|---|
| Measured value (%): | 91.2829 | 6.5878 | 2.1293 |
| Calculated value (%): | 91.2831 | 6.5879 | 2.1290 |

Synthesis Example 15: Synthesis of Exemplified Compound No.[30]

Exemplified compound No.[30] of 18.8 g (in 0.028 mols) in the form of yellow-white crystals was obtained in a yield of 85% in the same manner as in Synthesis Example 12, except that p-ethyl aniline used in Synthesis Example 12 was replaced by o-n-propyl aniline.

The melting point thereof was within the range of 91° to 94° C. and the elementary analyzed value thereof was as follows.

| | C (carbon) | H (hydrogen) | N (nitrogen) |
|---|---|---|---|
| Measured value (%): | 91.1644 | 6.7508 | 2.0850 |
| Calculated value (%): | 91.1651 | 6.7504 | 2.0846 |

Synthesis Example 16: Synthesis of Exemplified Compound No. [39]

Exemplified compound No.[39] of 14.1 g (in 0.021 mols) in the form of yellow-white crystals was obtained in a yield of 63% in the same manner as in Synthesis Example 12, except that p-ethyl aniline used in Synthesis Example 12 was replaced by m-n-propyl aniline.

The melting point thereof was within the range of 87° to 92° C. and the elementary analyzed value thereof was as follows.

| | C (carbon) | H (hydrogen) | N (nitrogen) |
|---|---|---|---|
| Measured value (%): | 91.1653 | 6.7481 | 2.0832 |
| Calculated value (%): | 91.1651 | 6.7504 | 2.0846 |

Synthesis Example 17: Synthesis of Exemplified Compound No.[48]

Exemplified compound No.[48] of 17.5 g (in 0.026 mols) in the form of yellow-white crystals was obtained in a yield of 79% in the same manner as in Synthesis Example 12, except that p-ethyl aniline used in Synthesis Example 12 was replaced by p-n-propyl aniline.

The melting point thereof was within the range of 89° to 92° C. and the elementary analyzed value thereof was as follows.

| | C (carbon) | H (hydrogen) | N (nitrogen) |
|---|---|---|---|
| Measured value (%): | 91.1629 | 6.7511 | 2.0821 |
| Calculated value (%): | 91.1651 | 6.7504 | 2.0846 |

Synthesis Example 18: Synthesis of Exemplified Compound No.[57]

Exemplified compound No.[57] of 13.4 g (in 0.020 mols) in the form of yellow-white crystals was obtained in a yield of 61% in the same manner as in Synthesis Example 12, except that p-ethyl aniline used in Synthesis Example 12 was replaced by o-isopropyl aniline.

The melting point thereof was within the range of 88° to 90° C. and the elementary analyzed value thereof was as follows.

| | C (carbon) | H (hydrogen) | N (nitrogen) |
|---|---|---|---|
| Measured value (%): | 91.1659 | 6.7481 | 2.0836 |
| Calculated value (%): | 91.1651 | 6.7504 | 2.0846 |

Synthesis Example 19: Synthesis of Exemplified Compound No.[66]

Exemplified compound No.[66] of 14.1 g (in 0.021 mols) in the form of yellow-white crystals was obtained in a yield of 64% in the same manner as in Synthesis Example 12, except that p-ethyl aniline used in Synthesis Example 12 was replaced by m-isopropyl aniline.

The melting point thereof was within the range of 93° to 99° C. and the elementary analyzed value thereof was as follows.

| | C (carbon) | H (hydrogen) | N (nitrogen) |
|---|---|---|---|
| Measured value (%): | 91.1593 | 6.7421 | 2.0799 |
| Calculated value (%): | 91.1651 | 6.7504 | 2.0846 |

Synthesis Example 20: Synthesis of Exemplified Compound No [75]

Exemplified compound No.[75] of 18.1 g (in 0.027 mols) in the form of yellow-white crystals was obtained in a yield of 82% in the same manner as in Synthesis Example 12, except that p-ethyl aniline used in Synthesis Example 12 was replaced by p-isopropyl aniline.

The melting point thereof was within the range of 95° to 102° C. and the elementary analyzed value thereof was as follows.

| | C (carbon) | H (hydrogen) | N (nitrogen) |
|---|---|---|---|
| Measured value (%): | 91.1623 | 6.7488 | 2.0841 |
| Calculated value (%): | 91.1651 | 6.7504 | 2.0846 |

Synthesis Example 21: Synthesis of Exemplified Compound No.[24]

Exemplified compound No.[24] of 15.1 g (in 0.022 mols) in the form of yellow-white crystals was obtained in a yield of 66% in the same manner as in Synthesis Example 12, except that 4-methyl benzophenone used in Synthesis Example 12 was replaced by 4,4'-dimethyl benzophenone.

The melting point thereof was within the range of 112° to 116° C. and the elementary analyzed value thereof was as follows.

| | C (carbon) | H (hydrogen) | N (nitrogen) |
|---|---|---|---|
| Measured value (%): | 91.1010 | 6.9008 | 2.0311 |
| Calculated value (%): | 91.0519 | 6.9062 | 2.0419 |

Synthesis Example 22: Synthesis of Exemplified Compound No.[60]

Exemplified compound No.[60] of 16.8 g (in 0.024 mols) in the form of yellow-white crystals was obtained in a yield of 73% in the same manner as in Synthesis Example 12, except that p-ethyl aniline and 4-methyl benzophenone each used in Synthesis Example 12 were replaced by o-isopropyl aniline and 4,4'-dimethyl benzophenone, respectively.

The melting point thereof was within the range of 109° to 115° C. and the elementary analyzed value thereof was as follows.

| | C (carbon) | H (hydrogen) | N (nitrogen) |
|---|---|---|---|
| Measured value (%): | 90.8 | 7.03 | 2.0100 |
| Calculated value (%): | 90.9432 | 7.0558 | 2.0010 |

Synthesis Example 23: Synthesis of Exemplified Compound No. [136]

Exemplified compound No.[136] of 16.1 g (in 0.024 mols) in the form of yellow-white crystals was obtained in a yield of 74% in the same manner as in Synthesis Example 12, except that 4-methyl benzophenone used in Synthesis Example 12 was replaced by 4-ethyl benzophenone.

The melting point thereof was within the range of 112° to 118° C. and the elementary analyzed value thereof was as follows.

| | C (carbon) | H (hydrogen) | N (nitrogen) |
|---|---|---|---|
| Measured value (%): | 91.10 | 6.90 | 2.00 |
| Calculated value (%): | 91.05 | 6.9062 | 2.042 |

Synthesis Example 24: Synthesis of Exemplified Compound No.[140]

Exemplified compound No.[140] of 14.9 g (in 0.022 mols) in the form of yellow-white crystals was obtained in a yield of 68% in the same manner as in Synthesis Example 12, except that 4-methyl benzophenone used in Synthesis Example 12 was replaced by 4-bromo benzophenone.

The melting point thereof was within the range of 121° to 124° C. and the elementary analyzed value thereof was as follows.

| | C (carbon) | H (hydrogen) | N (nitrogen) |
|---|---|---|---|
| Measured value (%): | 73.12 | 4.74 | 1.71 |
| Calculated value (%): | 73.19 | 4.73 | 1.77 |

When an electrophotographic photoreceptor contains the compound represented by the afore-given Formulas [I] through [III] as the carrier transporting material, they may have the configurations shown in FIGS. 6 through 11.

Figure 6:
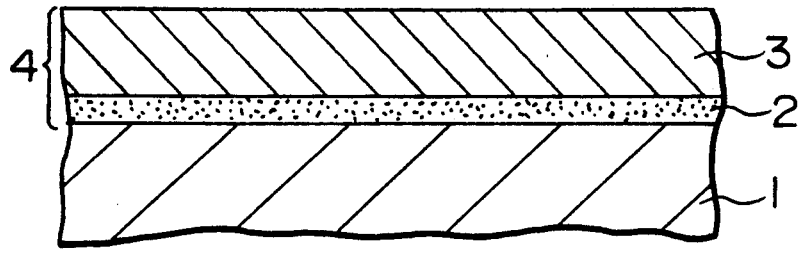
FIG. 6 is the cross-sectional view of an example of the electrophotographic photoreceptors relating to the invention.
Figure 7:
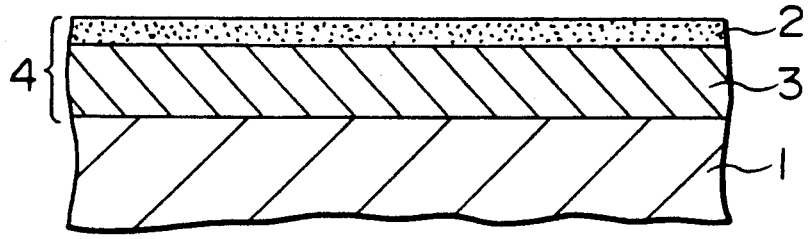
FIG. 7 is the cross-sectional view of another example of the electrophotographic photoreceptors relating to the invention.
Figure 8:
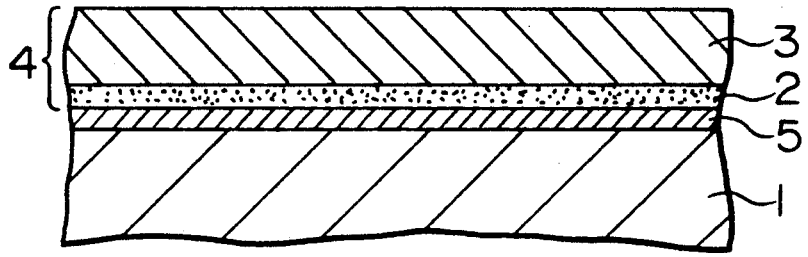
FIG. 8 is the cross-sectional view of a further example of the electrophotographic photoreceptors relating to the invention.

In FIGS. 6 and 7, to be more concrete, electroconductive support 1 is provided thereonto with photoreceptive layer 4 comprising carrier generating layer 2 containing a carrier generating material as the principal component thereof and carrier transporting layer 3 containing a carrier transporting material relating to the invention as the principal component thereof.

Photoreceptive layer 4 may also be interposed between electroconductive support 1 and interlayer 5 provided onto the support 1.

When photoreceptive layer 4 has a double-layered structure as mentioned above, a photoreceptor having excellent electrophotographic characteristics can be prepared.

Figure 10:
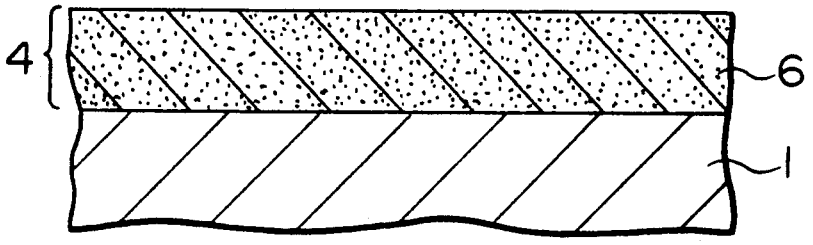
FIG. 10 is the cross-sectional view of a yet another example of the electrophotographic photoreceptors relating to the invention.
Figure 11:
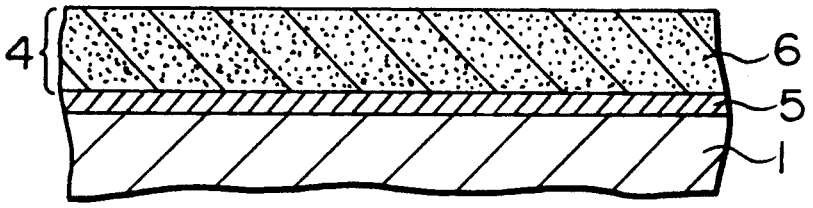
FIG. 11 is the cross-sectional view of another example of the electrophotographic photoreceptors relating to the invention.

In the invention, as shown in FIGS. 10 and 11, it is also allowed that electroconductive support 1 may be provided thereonto, directly or through interlayer 5 with photoreceptive layer 4 comprising layer 6 containing a carrier transporting material as the principal component thereof and dispersed therein with a carrier generating material.

Figure 9:
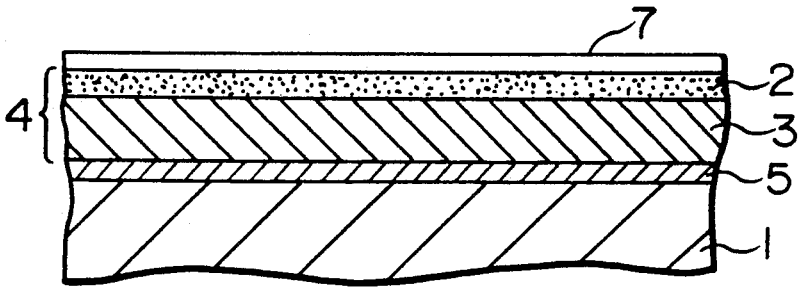
FIG. 9 is the cross-sectional view of a still further example of the electrophotographic photoreceptors relating to the invention.

In the invention, as indicated by the imaginary line shown in FIG. 9, protective layer 7 may also be provided as the outermost layer.

A photoreceptive layer is formed of various combinations of binders, because the compounds of the invention represented by Formulas [I] through [III] lack a coat-forming function in themselves.

Any desired binders can be used as the above-mentioned binders. Among them, it is preferable to use a high-molecular polymers having a hydrophobic property, a high permittivity and an electric-insulating film-forming property.

The above-mentioned high-molecular polymers include, for example, the following polymers. There is, however, no limitation thereto.

(P-1) polycarbonate
(P-2) polyester
(P-3) methacrylic resin
(P-4) acrylic resin
(P-5) polyvinyl chloride
(P-6) polyvinylidene chloride
(P-7) polystyrene
(P-8) polyvinyl acetate
(P-9) a styrene-butadiene copolymer
(P-10) a vinylidene chloride-acrylonitrile copolymer
(P-11) a vinyl chloride-vinyl acetate copolymer
(P-12) a vinyl chloride-vinyl acetate-maleic anhydride copolymer
(P-13) silicone resin
(P-14) silicone-alkyd resin
(P-15) phenol formaldehyde resin
(P-16) styrene-alkyd resin
(P-17) poly-N-vinyl carbazole
(P-18) polyvinyl butyral
(P-19) polyvinyl formal The above-given binder resins may be used independently or in combination in the forms of the mixtures thereof.

There is no special limitation to the CTMs applicable to the invention in combination. Among them, the examples thereof include the following compounds; namely, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a pyrazoline derivative, an amine derivative, an oxazolone derivative, a benzothiazole derivative, a benzoimidazole derivative, a quinazoline derivative, a benzofran derivative, an acridine derivative, a phenazine derivative, an aminostilbene derivative, a poly-N-vinylcarbazole, a poly-1-vinylpyrene and a poly-9-vinylanthracene.

The CTMs applicable to the invention include, preferably, those excellent in transporting function for a hole produced by irradiating light and suitable for a combination thereof with a later-described organic pigment applicable to the invention.

The carrier generating materials applicable to the carrier generating layers of the photoreceptive layers relating to the invention include, for example, the following materials.

(1) Azo type dyes such as a monoazo dye, a bisazo dye and a trisazo dye;
(2) Perylene type dyes such as a perylenic anhydride and perylenic imide;
(3) Indigo type dyes such as an indigo and a thioindigo;
(4) Polycyclic quinones such as an anthraquinone, a pyrene quinone and a flavanthrone;
(5) Quinacrydone type dyes;
(6) Bisbenzoimidazole type dyes;
(7) Indanthrone type dyes;
(8) Squarylium type dyes;
(9) Cyanine type dyes;
(10) Azulenium type dyes;
(11) Triphenyl methane type dyes;
(12) Amorphous silicon;
(13) Phthalocyanine type pigments such as a metal phthalocyanine and a non-metal phthalocyanine;
(14) Selenium, selenium-tellurium and selenium-arsenic;
(15) AdS and AdSe; and
(16) Pyrylium salt dyes and thiapyrylium salt dyes.

The above-given carrier generating materials can be used not only independently but also in combination in the forms of the mixtures thereof.

The electrophotographic photoreceptors relating to the invention are preferable to be applied with organic type pigments such as a fluorenone type bisazo pigment, a fluorenylidene type bisazo pigment and a polycyclic quinone pigment, as the CGMs thereof. In particular, when applying the fluorenone type bisazo pigments represented by the later-given Formula [$F_1$], fluorenylidene type bisazo pigments or polycyclic quinone pigments to the invention, the remarkably improved effects of photoreceptivity and durability can be displayed.

The typical examples [$F_1$-1 through $F_1$-24] of the fluorenone type bisazo pigments applicable to the invention will be given later. It is, however, to be understood that the invention shall not be limited thereto.

The fluorenone type bisazo pigments represented by the later-given Formula [$F_1$] which are applicable to the invention can be synthesized in any well-known processes including, for example, the processes described in Japanese Patent Application No. 62-304862/1987.

The fluorenylidene type bisazo pigments applicable to the invention are represented by the later-given Formula [$F_2$].

The typical examples of the bisazo pigments represented by Formula [$F_2$], which are effectively applicable to the invention, may include, for example, those represented by the chemical structures [$F_2$-1] through [$F_2$-7] which will be given later. It is, however, to be understood that the bisazo pigments applicable to the invention shall not be limited thereto.

The polycyclic quinone pigments applicable to the invention are represented by Formulas [$Q_1$] through [$Q_3$] which will be given later.

The typical examples of the polycyclic quinone pigments represented by later-given Formulas [$Q_1$] through [$Q_3$], which are applicable to the invention, will be given later. However, the invention shall not be limited thereto.

The typical examples of the anthanthrone pigments represented by Formula [$Q_1$] include those represented by the later-given formulas [$Q_1$-1] through [$Q_1$-6].

The typical examples of the dibenzypyrene quinone pigments represented by Formula [$Q_2$] include those represented by the later-given formulas [$Q_2$-1] through [$Q_2$-5].

The typical examples of the pyranthrone pigments represented by Formula [$Q_3$] include those represented by the later-given formulas [$Q_3$-1] through [$Q_3$-4].

The polycyclic quinone pigments represented by Formulas [$Q_1$] through [$Q_3$], which are applicable to the invention, can readily be synthesized in any well-known processes.

The non-metal phthalocyanine type pigments applicable to the invention include all the non-metal phthalocyanines each having photoconductivity and the derivatives thereof. For example, they include those of the $\alpha$ type, $\beta$ type, $\tau$ and $\tau'$ type, $\eta$ and $\eta'$ type, X type and those having the crystal forms described in JP OPI Publication No. 62-103651/1987 and the derivatives thereof. Among them, those of the $\tau$, X and K/R-X types are preferably used.

The X type non-metal phthalocyanines are described in U.S. Pat. No. 3,357,989 and the $\tau$ type non-metal phthalocyanines are described in JP OPI Publication No. 58-182639/1983.

As described in JP OPI Publication No. 62-103651/1987, the K/R-X type phthalocyanines are each characterized in having a principal peaks at a Bragg's angles (of $2\theta \pm 0.2°$) of 7.7°, 9.2°, 16.8°,17.5°, 22.4° and 28.8° with respect to the X-rays of CuK$\alpha$ at 1.541 å, a peak intensity ratio within the range of 0.8 to 1.0 at 16.8° with respect to the peak intensity at 9.2° and a peak intensity ratio of not lower than 0.4 at 28.8° with respect to the peak intensity at 22.4°.

The oxytitanyl phthalocyanines applicable to the invention are each represented by the Formula [TP] which will be given later.

Those applicable to the invention include ones having different crystal forms, which are disclosed in the following patent publications, namely, JP OPI Publication Nos. 61-239248/1986, 62-272272/1987, 62-116158/1987, 64-17066/1989, 2-28265/1990 and 2-215866/1990.

The dispersion media for the organic type pigments applicable to the invention include, for example, the well-known dispersion media such as a methyl ethyl ketone.

In the invention, one or not less than two kinds of well-known electron-acceptant material can be contained in a photoreceptive layer. Such as electron-acceptant material as mentioned above is to be added in a proportion thereof to an organic type pigment applicable to the invention=0.01~200:100 by weight and, preferably, 0.1~100:100 by weight. And, the electron-acceptant material is to be added in a proportion thereof to whole CTM=0.01~100:100 by weight and, preferably, 0.1~50:100 by weight.

For the purpose of improving the electric-charge generating function of a carrier generating material (hereinafter abbreviated to as CGM), an organic amines can be added into a photoreceptive layer. Among these organic amines, secondary amines are preferable to be added thereto. These compounds are given in, for example, JP OPI Publication Nos. 59-218447/1984 and 62-8160/1987.

For the purpose of preventing deterioration by ozone, an antioxidant such as those given in JP OPI Publication No. 63-18354/1988 may be added in the photoreceptive layers. Such an antioxidant as mentioned above is to be added in an amount within the range of 0.1 to 100 parts by weight per 100 parts by weight of CTM, desirably, 1 to 50 parts by weight and, preferably 5 to 25 parts by weight.

Further, if required, for the purpose of protecting a photoreceptive layer, an UV absorbent may be added and a color-sensitivity correction dye may also be added.

An interlayer may be interposed between a photoreceptive layer and a support. The interlayer can function as an adhesion layer or a blocking layer.

In the invention, when a photoreceptive layer has a double-layered structure as shown in FIG. 6, a carrier generating layer (hereinafter abbreviated to as a CGL) can be formed, in the following method, directly over an electroconductive support or a carrier transporting layer (hereinafter abbreviated to as a CTL) or, if required, over an interlayer such as an adhesion layer or a blocking layer interposed therebetween.

(1) A vacuum-evaporation method;

(2) A method in which a solution prepared by dissolving a CGM in a suitable solvent is coated; and (3) A method in which a dispersion solution prepared by making a CGM super-finely grained in a dispersion medium by making use of a ball-mill or a sand-grinder or, if required a dispersion solution prepared by mixedly dispersing a CGM with a binder in a dispersion medium.

To be more concrete, it is allowed to use any desired gas-phase segmentary methods such as a vacuum-evaporation method, a spattering method and a CVD method or any desired coating methods such as a dip-coating method, a spray-coating method, a blade-coating method and a roller-coating method.

The CGLs formed in the above-mentioned manner are each to have a thickness within the range of, desirably, 0.01 μm to 5 μm and, preferably, 0.05 μm to 3 μm.

The above-mentioned CTLs can also be formed in the same manner as in CGLs. The thickness of such a CTL may be so varied as to meet the requirements, however, it is usually within the range of, preferably, 5 μm to 60 μm.

The CTL is composed of a binder in a proportion within the range of, preferably, 1 to 5 parts by weight per one part by weight of the CTM of the invention. When forming photoreceptive layer 4 in which a finely grained CGM is dispersed, it is preferred to use a binder in a proportion of not more than 5 parts by weight to one part by weight of CGM.

When composing a CGL dispersed in a binder, it is preferred to use the binder in a proportion of not more than 5 parts by weight to one part by weight of CGM.

The electrophotographic photoreceptors relating to the invention have each the above-described composition. Therefore, as is apparent from the examples given later, they are excellent in electric-charging characteristics, photoreceptive characteristics and image-forming characteristics and, particularly, few in fatigue and deterioration even when they are repeatedly used, so that the durability can be excellent.

In addition to the above, the electrophotographic photoreceptors relating to the invention can widely be applied to an electrophotographic copier and, besides, to many applicable fields such as the photoreceptors for a printer in which a laser, cathode-ray tube or light emitting device (LED) is used as the light source thereof. Further, the invention can also be applied to the other devices than the photoreceptors and to an electroluminescence (EL).

EXAMPLES

The examples of the invention will now be more detailed. It is, however, to be understood that the embodiments of the invention shall not be limited thereto.

EXAMPLE 1

A polyamide was prepared by copolymerizing ε-amino-caproic acid, adipic acid and N-(β-aminoethyl)-piperazine in a monomer composition proportion of 1:1:1. The resulting polyamide of 30 g was added into 200 ml of methanol EL standard (manufactured by Kanto Chemical Co.) of 800 ml, which was heated at 50° C. Then, the resulting mixture was dip-coated over an aluminium-made drum having a diameter of 80 mm, so that a 0.6 μm-thick interlayer was formed.

Next, 20 g of a fluorenone type bisazo pigment (that was Exemplified Compound $F_1$-23) as a CGM and 20 g of polyvinyl butyral resin, Eslec BX-1 (manufactured by Sekisui Chemical Co.) as a binder were dissolved in 1000 ml of methyl ethyl ketone (manufactured by Kanto Chemical Co.). The resulting solution was milled by a sand-mill for 24 hours, so that a CGL coating solution was obtained. The CGL coating solution was dip-coated over the above-prepared interlayer, so that a 0.2 μm-thick CGL was formed.

After that, 140 g of Exemplified Compound No.1 and 165 g of polycarbonate resin, 'Eupiron Z-200' (manufactured by Mitsubishi Gas-Chemical Co., Ltd.) were dissolved in 1000 ml of 1,2-dichloroethane, Special Class, (manufactured by Kanto Chemical Co.), so that a CTL coating solution was obtained.

The resulting CTL coating solution was dip-coated over the above-mentioned CGL and the resulting coated CGL was dried at 100° C. for 1 hour, so that a 23 μm-thick CTL was formed. In the manner mentioned above, the interlayer, the CGL and the CTL were laminated in this order, so that photoreceptive layer 1 was formed.

EXAMPLES 2 through 10

Photoreceptors 2 through 10 were each prepared in the same manner as in Example 1, except that the CGM and CTM used each in Example 1 were replaced by the exemplified compounds as shown in the following Table-1, respectively.

COMPARATIVE EXAMPLES 1 and 2

As shown in the following Table-1, the comparative photoreceptors were each prepared in the same manner as in Example 1, except that the CTM used in Example 1 was replaced by comparative compounds (1) and (2) which will be given later, respectively.

EXAMPLE 11

The interlayer was prepared in the same manner as in Example 1.

Polycyclic quinone type pigment (that was Exemplified Compound $Q_1$-3) of 20 g as the CGM and polycarbonate resin C-1300 (manufactured by Teijin Chemical Ind. Co.) of 10 g were each dissolved in 1,2-dichloroethane Special Class (manufactured by Kanto Chemical Co.) and the resulting solution was milled by a ball-mill for 30 hours, so that a CGL coating solution was obtained. The resulting CGL coating solution was dip-coated over the aforementioned interlayer, so that a 0.6 μm-thick CGL was formed.

Next, photoreceptor 11 was prepared by laminating a CTL in the same manner as in Example 1.

EXAMPLES 12 through 20

Photoreceptors 12 through 20 were each prepared in the same manner as in Example 11, except that the CTM used in Example 11 was replaced by the exemplified compounds each as shown in the following Table-2, respectively.

COMPARATIVE EXAMPLES 3 and 4

As shown in the following Table-2, comparative photoreceptors 3 and 4 were each prepared in the same manner as in Example 11, except that the CTM used in Example 11 was replaced by comparative compounds (1) and (2), respectively.

EXAMPLE 21

After dissolving 12 g of polyvinyl butyral resin (Eslec BX-1 manufactured by Sekisui Chemical Co.) in 1000 ml of methyl ethyl ketone, the resulting solution was mixed with 5.7 g of Exemplified Compound $Q_1$-3 and 0.5 g of Exemplified Compound $F_1$-23 each as the CGMs and the resulting mixture was dispersed for 12 hours by making use of a sand-grinder.

The resulting dispersed solution was dip-coated over the interlayer mentioned in Example 1, so that a CGL was formed and, further, the CTL was formed by making use of Exemplified Compound No.2 as the CTM, so that photoreceptor 21 was prepared.

EXAMPLES 22 through 30

Photoreceptors 22 through 30 were each prepared in the same manner as in Example 21, except that the CGM and CTM each used in Example 21 were replaced by the exemplified compounds as shown in the following Table-3, respectively.

COMPARATIVE EXAMPLES 5 and 6

As shown in the following Table-3, comparative photoreceptors 5 and 6 were each prepared in the same manner as in Example 21, except that the CTM used in Example 21 was replaced by comparative compounds (1) and (2), respectively.

EXAMPLE 31

The polyamide of 50 g used in Example 1 was added and dissolved into 800 ml of methanol EL standard (manufactured by Kanto Chemical Co.) which was heated up to 50° C. The resulting solution was cooled down to room temperature and was then added with 200 ml of 1-butanol special class (Kanto Chemical Co.). After that, the resulting solution was dip-coated over an aluminium drum having a diameter of 80 mm, so that a 0.5 μm-thick interlayer was formed.

Next, 40 g of τ type non-metal phthalocyanine (τ-Pc) as a CGM was added into 2000 ml of methyl ethyl ketone EL standard (manufactured by Kanto Chemical Co.) in which 200 g of silicone resin 'KR-5240' (having a solid component of 20%) (manufactured by Kanto Chemical Co.). The resulting solution was dispersed for 4 hours by making use of a sand-grinder, so that a CGL coating solution was obtained. The resulting coating solution was dip-coated over the foregoing interlayer, so that a 0.4 μm -thick CGL was formed.

Thereafter, 135 g of Exemplified Compound (3) and 165 g of polycarbonate 'Eupiron Z-200' (manufactured by Mitsubishi Gas-Chemical Co.) were each dissolved in 1000 ml of 1,2-dichlorethane special class (manufactured by Kanto Chemical Co.), so that a CTL coating solution was obtained. The resulting coating solution was dip-coated over the above-mentioned CGL and the resulting coated VGL was dried at 100° C. for 1 hour, so that a 22 μm-thick CTL was obtained. After then, the interlayer, CGL and CTL were each laminated in this order, so that a photoreceptor was prepared.

EXAMPLES 32 through 40

Electrophotoreceptors 32 through 40 were each prepared in the same manner as in Example 31, except that the CGM used in Example 31 was replaced by the exemplified compounds as shown in the following Table-4, respectively.

COMPARATIVE EXAMPLES 7 and 8

The comparative electrophotoreceptors were each prepared in the same manner as in Example 31, except that the CTM used in Example 31 was replaced by Comparative Compound (1) and (2) as shown in the following Table-4, respectively.

EXAMPLE 41

A photoreceptor comprising an interlayer—a CGL—an CTL each laminated in this order was prepared in the same manner as in Example 1, except that an X type non-metal phthalocyanine (X-Pc) was used as the CGM.

EXAMPLES 42 through 50

Photoreceptors 42 through 50 were each prepared in the same manner as in Example 41, except that the CTM used in Example 41 was replaced by the exemplified compounds as shown in the following Table-5, respectively.

COMPARATIVE EXAMPLES 9 and 10

The comparative examples were each prepared in the same manner as in Example 41, except that the CTM used in Example 41 was replaced by Comparative Compounds (1) and (2) as shown in the following Table-5, respectively.

EXAMPLE 51

The photoreceptor comprising an interlayer—a CGL—a CTL laminated in this order was prepared in the same manner as in Example 1, except that the CGM used in Example 1 was replaced by the Y type oxytitanium phthalocyanine (Y-TiOPc) [for which, refer to The Bulletin of The Society of Electrophotography, 250(2), 29(2). 1990].

EXAMPLES 52 through 60

Photoreceptors 52 through 60 were each prepared in the same manner as in Example 51, except that the CTM used in Example 51 was replaced by the exemplified compounds as shown in the following Table-6, respectively.

COMPARATIVE EXAMPLES 11 and 12

The comparative photoreceptors were each prepared in the same manner as in Example 51, except that the CTM used in Example 51 was replaced by Comparative Compounds (1) and (2) as shown in the following Table-6, respectively.

EXAMPLE 61

The photoreceptor was prepared in the same manner as in the above-given example, except that the CGM used in the above-given example was replaced by a fluorenylidene type azo CGM.

EXAMPLES 62 through 70

Photoreceptors 62 through 70 were each prepared in the same manner as in Example 61, except that the CGM and CTM each used in Example 61 were each replaced by the exemplified compounds as shown in the following Table-7, respectively.

COMPARATIVE EXAMPLES 13 and 14

The comparative examples were each prepared in the same manner as in Example 61, except that the CTM used in Example 61 was replaced by Comparative Compounds (1) and (2) as shown in the following Table-7, respectively.

TABLE-1

| Example No. | Photoreceptor No. | CGM | CTM |
|---|---|---|---|
| Inventive Example 1 | Inventive photoreceptor 1 | Compound $F_1$-23 | Exemplified compound 1 |
| Inventive Example 2 | Inventive photoreceptor 2 | Compound $F_1$-23 | Exemplified compound 3 |
| Inventive Example 3 | Inventive photoreceptor 3 | Compound $F_1$-23 | Exemplified compound 6 |
| Inventive Example 4 | Inventive photoreceptor 4 | Compound $F_1$-23 | Exemplified compound 8 |
| Inventive Example 5 | Inventive photoreceptor 5 | Compound $F_1$-1 | Exemplified compound 9 |
| Inventive Example 6 | Inventive photoreceptor 6 | Compound $F_1$-1 | Exemplified compound 17 |
| Inventive Example 7 | Inventive photoreceptor 7 | Compound $F_1$-1 | Exemplified compound 20 |
| Inventive Example 8 | Inventive photoreceptor 8 | Compound $F_1$-1 | Exemplified compound 76 |
| Inventive Example 9 | Inventive photoreceptor 9 | Compound $F_1$-7 | Exemplified compound 50 |
| Inventive Example 10 | Inventive photoreceptor 10 | Compound $F_1$-16 | Exemplified compound 53 |
| Comparative Example 1 | Comparative photoreceptor 1 | Compound $F_1$-23 | Comparative compound (1) |
| Comparative Example 2 | Comparative photoreceptor 2 | Compound $F_1$-23 | Comparative compound (2) |

TABLE-2

| Example No. | Photoreceptor No. | CGM | CTM |
|---|---|---|---|
| Inventive Example 11 | Inventive photoreceptor 11 | Compound $Q_1$-3 | Exemplified compound 1 |
| Inventive Example 12 | Inventive photoreceptor 12 | Compound $Q_1$-3 | Exemplified compound 3 |
| Inventive Example 13 | Inventive photoreceptor 13 | Compound $Q_1$-3 | Exemplified compound 6 |
| Inventive Example 14 | Inventive photoreceptor 14 | Compound $Q_1$-3 | Exemplified compound 24 |
| Inventive Example 15 | Inventive photoreceptor 15 | Compound $Q_1$-3 | Exemplified compound 26 |
| Inventive Example 16 | Inventive photoreceptor 16 | Compound $Q_1$-3 | Exemplified compound 33 |
| Inventive Example 17 | Inventive photoreceptor 17 | Compound $Q_1$-3 | Exemplified compound 77 |
| Inventive Example 18 | Inventive photoreceptor 18 | Compound $Q_1$-3 | Exemplified compound 44 |
| Inventive Example 19 | Inventive photoreceptor 19 | Compound $Q_1$-3 | Exemplified compound 51 |
| Inventive Example 20 | Inventive photoreceptor 20 | Compound $Q_1$-3 | Exemplified compound 54 |
| Comparative Example 3 | Comparative photoreceptor 3 | Compound $Q_1$-3 | Comparative compound (1) |
| Comparative Example 4 | Comparative photoreceptor 4 | Compound $Q_1$-3 | Comparative compound (2) |

TABLE-3

| Example No. | Photoreceptor No. | CGM | CTM |
|---|---|---|---|
| Inventive Example 21 | Inventive photoreceptor 21 | Compound $Q_1$-3, $F_1$-23 | Exemplified compound 2 |
| Inventive Example 22 | Inventive photoreceptor 22 | Compound $Q_1$-3, $F_1$-23 | Exemplified compound 6 |
| Inventive Example 23 | Inventive photoreceptor 23 | Compound $Q_1$-3, $F_1$-23 | Exemplified compound 9 |
| Inventive Example 24 | Inventive photoreceptor 24 | Compound $Q_1$-3, $F_1$-23 | Exemplified compound 11 |
| Inventive Example 25 | Inventive photoreceptor 25 | Compound $Q_1$-3, $F_1$-23 | Exemplified compound 15 |
| Inventive Example 26 | Inventive photoreceptor 26 | Compound $Q_1$-3, $F_1$-23 | Exemplified compound 21 |
| Inventive Example 27 | Inventive photoreceptor 27 | Compound $Q_1$-3, $F_1$-23 | Exemplified compound 82 |
| Inventive Example 28 | Inventive photoreceptor 28 | Compound $Q_1$-3, $F_1$-23 | Exemplified compound 31 |
| Inventive Example 29 | Inventive photoreceptor 29 | Compound $Q_1$-3, $F_1$-7 | Exemplified compound 42 |
| Inventive Example 30 | Inventive photoreceptor 30 | Compound $Q_1$-3, $F_1$-16 | Exemplified compound 52 |
| Comparative Example 5 | Comparative photoreceptor 5 | Compound $Q_1$-3, $F_1$-23 | Comparative compound (1) |
| Comparative Example 6 | Comparative photoreceptor 6 | Compound $Q_1$-3, $F_1$-23 | Comparative compound (2) |

TABLE-4

| Example No. | Photoreceptor No. | CGM | CTM |
|---|---|---|---|
| Inventive Example 31 | Inventive photoreceptor 31 | τ type non-metallic phthalocyanine | Exemplified compound 3 |
| Inventive Example 32 | Inventive photoreceptor 32 | τ type non-metallic phthalocyanine | Exemplified compound 6 |
| Inventive Example 33 | Inventive photoreceptor 33 | τ type non-metallic phthalocyanine | Exemplified compound 7 |
| Inventive Example 34 | Inventive photoreceptor 34 | τ type non-metallic phthalocyanine | Exemplified compound 9 |
| Inventive Example 35 | Inventive photoreceptor 35 | τ type non-metallic phthalocyanine | Exemplified compound 15 |
| Inventive Example 36 | Inventive photoreceptor 36 | τ type non-metallic phthalocyanine | Exemplified compound 24 |
| Inventive Example 37 | Inventive photoreceptor 37 | τ type non-metallic phthalocyanine | Exemplified compound 31 |
| Inventive Example 38 | Inventive photoreceptor 38 | τ type non-metallic phthalocyanine | Exemplified compound 42 |
| Inventive Example 39 | Inventive photoreceptor 39 | τ type non-metallic phthalocyanine | Exemplified compound 81 |
| Inventive Example 40 | Inventive photoreceptor 40 | τ type non-metallic phthalocyanine | Exemplified compound 67 |
| Comparative Example 7 | Comparative photoreceptor 7 | τ type non-metallic phthalocyanine | Comparative compound (1) |
| Comparative Example 8 | Comparative photoreceptor 8 | τ type non-metallic phthalocyanine | Comparative compound (2) |

TABLE-5

| Example No. | Photoreceptor No | CGM | CTM |
|---|---|---|---|
| Inventive Example 41 | Inventive photoreceptor 41 | X type non-metallic phthalocyanine | Exemplified compound 1 |
| Inventive Example 42 | Inventive photoreceptor 42 | X type non-metallic phthalocyanine | Exemplified compound 2 |
| Inventive Example 43 | Inventive photoreceptor 43 | X type non-metallic phthalocyanine | Exemplified compound 6 |
| Inventive Example 44 | Inventive photoreceptor 44 | X type non-metallic phthalocyanine | Exemplified compound 8 |
| Inventive Example 45 | Inventive photoreceptor 45 | X type non-metallic phthalocyanine | Exemplified compound 9 |
| Inventive Example 46 | Inventive photoreceptor 46 | X type non-metallic phthalocyanine | Exemplified compound 10 |
| Inventive Example 47 | Inventive photoreceptor 47 | X type non-metallic phthalocyanine | Exemplified compound 21 |
| Inventive Example 48 | Inventive photoreceptor 48 | X type non-metallic phthalocyanine | Exemplified compound 31 |
| Inventive Example 49 | Inventive photoreceptor 49 | X type non-metallic phthalocyanine | Exemplified compound 45 |
| Inventive Example 50 | Inventive photoreceptor 50 | X type non-metallic phthalocyanine | Exemplified compound 51 |
| Comparative Example 9 | Comparative photoreceptor 9 | X type non-metallic phthalocyanine | Comparative compound (1) |

TABLE-5-continued

| Example No. | Photoreceptor No | CGM | CTM |
|---|---|---|---|
| Comparative Example 10 | Comparative photoreceptor 10 | X type non-metallic phthalocyanine | Comparative compound (2) |

TABLE-6

| Example No. | Photoreceptor No | CGM | CTM |
|---|---|---|---|
| Inventive Example 51 | Inventive photoreceptor 51 | Y type oxytitanium phthalocyanine | Exemplified compound 1 |
| Inventive Example 52 | Inventive photoreceptor 52 | Y type oxytitanium phthalocyanine | Exemplified compound 6 |
| Inventive Example 53 | Inventive photoreceptor 53 | Y type oxytitanium phthalocyanine | Exemplified compound 9 |
| Inventive Example 54 | Inventive photoreceptor 54 | Y type oxytitanium phthalocyanine | Exemplified compound 18 |
| Inventive Example 55 | Inventive photoreceptor 55 | Y type oxytitanium phthalocyanine | Exemplified compound 21 |
| Inventive Example 56 | Inventive photoreceptor 56 | Y type oxytitanium phthalocyanine | Exemplified compound 34 |
| Inventive Example 57 | Inventive photoreceptor 57 | Y type oxytitanium phthalocyanine | Exemplified compound 42 |
| Inventive Example 58 | Inventive photoreceptor 58 | Y type oxytitanium phthalocyanine | Exemplified compound 78 |
| Inventive Example 59 | Inventive photoreceptor 59 | Y type oxytitanium phthalocyanine | Exemplified compound 67 |
| Inventive Example 60 | Inventive photoreceptor 60 | Y type oxytitanium phthalocyanine | Exemplified compound 70 |
| Comparative Example 11 | Comparative photoreceptor 11 | Y type oxytitanium phthalocyanine | Comparative compound (1) |
| Comparative Example 12 | Comparative photoreceptor 12 | Y type oxytitanium phthalocyanine | Comparative compound (2) |

TABLE-7

| Example No. | Photoreceptor No | CGM | CTM |
|---|---|---|---|
| Inventive Example 61 | Inventive photoreceptor 61 | Compound $F_2$-6 | Exemplified compound 3 |
| Inventive Example 62 | Inventive photoreceptor 62 | Compound $F_2$-6 | Exemplified compound 6 |
| Inventive Example 63 | Inventive photoreceptor 63 | Compound $F_2$-6 | Exemplified compound 15 |
| Inventive Example 64 | Inventive photoreceptor 64 | Compound $F_2$-6 | Exemplified compound 23 |
| Inventive Example 65 | Inventive photoreceptor 65 | Compound $F_2$-6 | Exemplified compound 31 |
| Inventive Example 66 | Inventive photoreceptor 66 | Compound $F_2$-6 | Exemplified compound 33 |
| Inventive Example 67 | Inventive photoreceptor 67 | Compound $F_2$-6 | Exemplified compound 37 |
| Inventive Example 68 | Inventive photoreceptor 68 | Compound $F_2$-6 | Exemplified compound 42 |
| Inventive Example 69 | Inventive photoreceptor 69 | Compound $F_2$-3 | Exemplified compound 50 |
| Inventive Example 70 | Inventive photoreceptor 70 | Compound $F_2$-5 | Exemplified compound 59 |
| Comparative Example 13 | Comparative photoreceptor 13 | Compound $F_2$-6 | Comparative compound (1) |
| Comparative | Comparative | Compound $F_2$-6 | Comparative |

TABLE-7-continued

| Example No. | Photoreceptor No | CGM | CTM |
|---|---|---|---|
| Example 14 | photoreceptor 14 | | compound (2) |

EVALUATION EXAMPLE 1

The residual potentials Vr were each measured when a series of electric-charging·Exposing operations were repeated 20,000 times by making use of a copier, modified U-Bix Model 5076 manufactured by Konica Corp. (in which the charging electrode was changed to be negative and the exposure amount was changed into 4.65 lux) and by changing the linear velocities into 3 velocities, namely 240, 330 and 440 mm/sec. The results of the measurements are shown in the following Tables-8 through 10. The residual potentials of the photoreceptors applied with the CTM of the invention did not become intense when the linear velocities were made faster than those of the photoreceptors applied with the comparative compounds, so that an excellent high velocities were shown. In the meanwhile, the initial white-paper potentials (Vw) were each shown in Tables-8 through 10.

EVALUATION EXAMPLE 2

The 100,000 times continuous copying tests were tries by making use of A-4 size regenerated paper and the copier, modified U-Bix Model 5076 manufactured by Konica Corp., which was the same as in Evaluation Example 1. The results thereof are shown in the following Tables-11 through 13. The photoreceptors applied with the compounds of the invention provided excellent images upto the 100,000th copy and, on the other hand, the comparative photoreceptors produced several white-dots in the solid-black image areas after the 20,000 to 30,000th copying tests. The white-dots were evaluated by visually counting the numbers of the white-dots produced on a solid-black image in A-4 size. The results thereof are shown in Tables-11 through 13.

EVALUATION EXAMPLE 3

The resulting electric potential in an unexposed area VH and electric potential in an exposed area VL were each measured at an ordinary temperature (of 25° C.) and a low temperature (of 10° C.) by making use of a digital copier, U-Bix Model 8028 manufactured by Konica Corp. The results thereof are shown in the following Tables-14 through 17.

EVALUATION EXAMPLE 4

The resulting black-dots produced in the white-background of a copied image were evaluated after making use of the digital copier, U-Bix Model 8028 manufactured by Konica Corp., which was the same as that used in the above-described Evaluation Example 3, loading the subject photoreceptor into a developer and then image-copying several times. The results thereof are shown in the following Tables-18 through 21.

The resulting black-dots were evaluated by measuring the dot-sizes and numbers of the black-dots through an image analyzer, 'Omnicon Model 300' (manufactured by Shimazu Mfg. Works). The results were judged by counting the numbers of the resulting black-dots having a size Ø of not smaller than 0.05 mm in one $cm^2$. The judgement criteria of evaluating the black-dots are shown in the following table.

TABLE

| Black spots of not smaller than Ø0.05 mm in size | black dot judgement |
|---|---|
| Nil/$cm^2$ | ◎ |
| 1~3 spots/$cm^2$ | ○ |
| 4~10 spots/$cm^2$ | Δ |
| Not less than 11 spots/$cm^2$ | X |

In the table, when a black-dot judgement was resulted to be ◎ and ○, the subject photoreceptor can be put to practical use; when it is resulted to be Δ, the subject photoreceptor may sometimes be impractical; and when it was proved to be ×, the subject photoreceptor cannot be practical.

TABLE-8

| Photoreceptor No. | Initial white paper potential, Vw (v) | Vr (v) after 20000th repetition at the following linear velocity: Repetition at 240 mm/sec. | Repetition at 330 mm/sec. | Repetition at 440 mm/sec. |
|---|---|---|---|---|
| Inventive photoreceptor 1 | 51 | 10 | 14 | 21 |
| Inventive photoreceptor 2 | 52 | 9 | 12 | 19 |
| Inventive photoreceptor 3 | 50 | 12 | 16 | 22 |
| Inventive photoreceptor 4 | 49 | 13 | 16 | 20 |
| Inventive photoreceptor 5 | 52 | 11 | 15 | 21 |
| Inventive photoreceptor 6 | 53 | 14 | 15 | 23 |
| Inventive photoreceptor 7 | 51 | 15 | 17 | 22 |
| Inventive photoreceptor 8 | 55 | 12 | 16 | 25 |
| Inventive photoreceptor 9 | 50 | 13 | 16 | 26 |
| Inventive photoreceptor 10 | 52 | 14 | 18 | 27 |
| Comparative photoreceptor 1 | 61 | 15 | 38 | 75 |
| Comparative photoreceptor 2 | 73 | 17 | 45 | 89 |

TABLE-9

| Photoreceptor No. | Initial white paper potential, Vw (v) | Vr (v) after 20000th repetition at the following linear velocity: Repetition at 240 mm/sec. | Repetition at 330 mm/sec. | Repetition at 440 mm/sec. |
|---|---|---|---|---|
| Inventive photoreceptor 11 | 96 | 10 | 12 | 20 |
| Inventive photoreceptor 12 | 101 | 8 | 11 | 19 |
| Inventive photoreceptor 13 | 97 | 11 | 13 | 19 |
| Inventive photoreceptor 14 | 92 | 15 | 17 | 23 |
| Inventive photoreceptor 15 | 96 | 12 | 16 | 25 |
| Inventive photoreceptor 16 | 98 | 16 | 19 | 24 |
| Inventive photoreceptor 17 | 100 | 13 | 16 | 21 |
| Inventive photoreceptor 18 | 102 | 14 | 16 | 26 |

TABLE-9-continued

| Photoreceptor No. | Initial white paper potential, Vw (v) | Vr (v) after 20000th repetition at the following linear velocity | | |
|---|---|---|---|---|
| | | Repetition at 240 mm/sec. | Repetition at 330 mm/sec. | Repetition at 440 mm/sec. |
| Inventive photoreceptor 19 | 104 | 10 | 13 | 22 |
| Inventive photoreceptor 20 | 105 | 15 | 18 | 25 |
| Comparative photoreceptor 3 | 112 | 14 | 37 | 75 |
| Comparative photoreceptor 4 | 121 | 15 | 39 | 79 |

TABLE-10

| Photoreceptor No. | Initial white paper potential, Vw (v) | Vr (v) after 20000th repetition at the following linear velocity | | |
|---|---|---|---|---|
| | | Repetition at 240 mm/sec. | Repetition at 330 mm/sec. | Repetition at 440 mm/sec. |
| Inventive photoreceptor 21 | 75 | 10 | 15 | 20 |
| Inventive photoreceptor 22 | 66 | 11 | 15 | 23 |
| Inventive photoreceptor 23 | 76 | 14 | 18 | 24 |
| Inventive photoreceptor 24 | 65 | 12 | 18 | 26 |
| Inventive photoreceptor 25 | 61 | 13 | 19 | 24 |
| Inventive photoreceptor 26 | 63 | 15 | 20 | 23 |
| Inventive photoreceptor 27 | 77 | 16 | 21 | 26 |
| Inventive photoreceptor 28 | 73 | 15 | 20 | 27 |
| Inventive photoreceptor 29 | 71 | 17 | 23 | 28 |
| Inventive photoreceptor 30 | 75 | 18 | 22 | 30 |
| Comparative photoreceptor 5 | 80 | 17 | 45 | 85 |
| Comparative photoreceptor 6 | 95 | 18 | 37 | 84 |

TABLE-11

| Photoreceptor No. | Numbers of white spots produced after 10000th repetition | Numbers of white spots produced after 50000th repetition | Numbers of white spots produced after 100000th repetition |
|---|---|---|---|
| Inventive photoreceptor 1 | 0 | 0 | 0 |
| Inventive photoreceptor 2 | 0 | 0 | 0 |
| Inventive photoreceptor 3 | 0 | 0 | 0 |
| Inventive photoreceptor 4 | 0 | 0 | 0 |
| Inventive photoreceptor 5 | 0 | 0 | 2 |
| Inventive photoreceptor 6 | 0 | 1 | 0 |
| Inventive photoreceptor 7 | 0 | 0 | 0 |

TABLE-11-continued

| Photoreceptor No. | Numbers of white spots produced after 10000th repetition | Numbers of white spots produced after 50000th repetition | Numbers of white spots produced after 100000th repetition |
|---|---|---|---|
| Inventive photoreceptor 8 | 0 | 0 | 1 |
| Inventive photoreceptor 9 | 0 | 0 | 0 |
| Inventive photoreceptor 10 | 0 | 0 | 1 |
| Comparative photoreceptor 1 | 6 | 23 | 31 |
| Comparative photoreceptor 2 | 4 | 19 | 37 |

TABLE-12

| Photoreceptor No. | Numbers of white spots produced after 10000th repetition | Numbers of white spots produced after 50000th repetition | Numbers of white spots produced after 100000th repetition |
|---|---|---|---|
| Inventive photoreceptor 11 | 0 | 0 | 0 |
| Inventive photoreceptor 12 | 0 | 0 | 0 |
| Inventive photoreceptor 13 | 0 | 0 | 1 |
| Inventive photoreceptor 14 | 0 | 0 | 2 |
| Inventive photoreceptor 15 | 0 | 1 | 0 |
| Inventive photoreceptor 16 | 0 | 0 | 0 |
| Inventive photoreceptor 17 | 0 | 0 | 1 |
| Inventive photoreceptor 18 | 0 | 1 | 3 |
| Inventive photoreceptor 19 | 0 | 0 | 1 |
| Inventive photoreceptor 20 | 0 | 0 | 5 |
| Comparative photoreceptor 3 | 5 | 27 | 43 |
| Comparative photoreceptor 4 | 4 | 25 | 47 |

TABLE-13

| Photoreceptor No. | Numbers of white spots produced after 10000th repetition | Numbers of white spots produced after 50000th repetition | Numbers of white spots produced after 100000th repetition |
|---|---|---|---|
| Inventive photoreceptor 21 | 0 | 0 | 0 |
| Inventive photoreceptor 22 | 0 | 0 | 0 |
| Inventive photoreceptor 23 | 0 | 0 | 0 |
| Inventive photoreceptor 24 | 0 | 0 | 0 |
| Inventive photoreceptor 25 | 0 | 0 | 1 |
| Inventive photoreceptor 26 | 0 | 0 | 0 |
| Inventive photoreceptor 27 | 0 | 0 | 2 |
| Inventive photoreceptor 28 | 0 | 0 | 0 |
| Inventive photoreceptor 29 | 0 | 0 | 1 |
| Inventive photoreceptor 30 | 0 | 1 | 1 |
| Comparative photoreceptor 5 | 3 | 12 | 32 |
| Comparative | 4 | 18 | 38 |

TABLE-13-continued

| Photoreceptor No. | Numbers of white spots produced after 10000th repetition | Numbers of white spots produced after 50000th repetition | Numbers of white spots produced after 100000th repetition |
|---|---|---|---|
| photoreceptor 6 | | | |

TABLE-14

| Photoreceptor No. | Ordinary temperature (25° C.) | | Low temperature (10° C.) | |
|---|---|---|---|---|
| | VH (v) | VL (v) | VH (v) | VL (v) |
| Inventive photoreceptor 31 | 707 | 103 | 709 | 104 |
| Inventive photoreceptor 32 | 702 | 105 | 705 | 106 |
| Inventive photoreceptor 33 | 705 | 101 | 707 | 100 |
| Inventive photoreceptor 34 | 710 | 96 | 712 | 100 |
| Inventive photoreceptor 35 | 708 | 102 | 710 | 105 |
| Inventive photoreceptor 36 | 701 | 104 | 703 | 108 |
| Inventive photoreceptor 37 | 700 | 106 | 702 | 109 |
| Inventive photoreceptor 38 | 698 | 110 | 700 | 107 |
| Inventive photoreceptor 39 | 702 | 108 | 705 | 109 |
| Inventive photoreceptor 40 | 703 | 106 | 705 | 110 |
| Comparative photoreceptor 7 | 697 | 107 | 700 | 152 |
| Comparative photoreceptor 8 | 697 | 123 | 685 | 179 |

TABLE-15

| Photoreceptor No. | Ordinary temperature (25° C.) | | Low temperature (10° C.) | |
|---|---|---|---|---|
| | VH (v) | VL (v) | VH (v) | VL (v) |
| Inventive photoreceptor 41 | 704 | 101 | 705 | 103 |
| Inventive photoreceptor 42 | 706 | 106 | 707 | 108 |
| Inventive photoreceptor 43 | 708 | 104 | 709 | 109 |
| Inventive photoreceptor 44 | 702 | 100 | 704 | 100 |
| Inventive photoreceptor 45 | 705 | 102 | 707 | 105 |
| Inventive photoreceptor 46 | 710 | 105 | 712 | 108 |
| Inventive photoreceptor 47 | 711 | 112 | 713 | 114 |
| Inventive photoreceptor 48 | 703 | 109 | 705 | 115 |
| Inventive photoreceptor 49 | 704 | 110 | 707 | 113 |
| Inventive photoreceptor 50 | 706 | 111 | 708 | 114 |
| Comparative photoreceptor 9 | 708 | 120 | 678 | 159 |
| Comparative photoreceptor 10 | 717 | 122 | 682 | 175 |

TABLE-16

| Photoreceptor No. | Ordinary temperature (25° C.) | | Low temperature (10° C.) | |
|---|---|---|---|---|
| | VH (v) | VL (v) | VH (v) | VL (v) |
| Inventive photoreceptor 51 | 705 | 50 | 707 | 51 |
| Inventive photoreceptor 52 | 706 | 52 | 706 | 54 |

TABLE-16-continued

| Photoreceptor No. | Ordinary temperature (25° C.) | | Low temperature (10° C.) | |
|---|---|---|---|---|
| | VH (v) | VL (v) | VH (v) | VL (v) |
| Inventive photoreceptor 53 | 704 | 48 | 708 | 50 |
| Inventive photoreceptor 54 | 703 | 53 | 705 | 53 |
| Inventive photoreceptor 55 | 701 | 51 | 702 | 53 |
| Inventive photoreceptor 56 | 704 | 51 | 703 | 51 |
| Inventive photoreceptor 57 | 705 | 49 | 702 | 50 |
| Inventive photoreceptor 58 | 698 | 50 | 704 | 51 |
| Inventive photoreceptor 59 | 702 | 54 | 705 | 55 |
| Inventive photoreceptor 60 | 701 | 52 | 703 | 55 |
| Comparative photoreceptor 11 | 711 | 62 | 685 | 90 |
| Comparative photoreceptor 12 | 715 | 59 | 685 | 81 |

TABLE-17

| Photoreceptor No. | Ordinary temperature (25° C.) | | Low temperature (10° C.) | |
|---|---|---|---|---|
| | VH (v) | VL (v) | VH (v) | VL (v) |
| Inventive photoreceptor 61 | 701 | 102 | 701 | 105 |
| Inventive photoreceptor 62 | 702 | 105 | 704 | 106 |
| Inventive photoreceptor 63 | 705 | 106 | 706 | 107 |
| Inventive photoreceptor 64 | 703 | 104 | 705 | 105 |
| Inventive photoreceptor 65 | 704 | 105 | 706 | 106 |
| Inventive photoreceptor 66 | 707 | 108 | 708 | 109 |
| Inventive photoreceptor 67 | 705 | 109 | 706 | 110 |
| Inventive photoreceptor 68 | 702 | 107 | 704 | 108 |
| Inventive photoreceptor 69 | 710 | 101 | 710 | 102 |
| Inventive photoreceptor 70 | 708 | 105 | 710 | 106 |
| Comparative photoreceptor 13 | 716 | 112 | 687 | 155 |
| Comparative photoreceptor 14 | 708 | 126 | 683 | 148 |

TABLE-18

| Photoreceptor used | Black spot judgement made after 20000th copies | Black spot judgement made after 50000th copies | Black spot judgement made after 100000th copies |
|---|---|---|---|
| Inventive photoreceptor 31 | ◎ | ◎ | ◎ |
| Inventive photoreceptor 32 | ◎ | ◎ | ◎ |
| Inventive photoreceptor 33 | ◎ | ◎ | ◎ |
| Inventive photoreceptor 34 | ◎ | ◎ | ○ |
| Inventive photoreceptor 35 | ◎ | ○ | ○ |
| Inventive photoreceptor 36 | ◎ | ◎ | ○ |
| Inventive photoreceptor 37 | ◎ | ○ | ○ |
| Inventive photoreceptor 38 | ◎ | ◎ | ○ |
| Inventive | ◎ | ◎ | ◎ |

TABLE-18-continued

| Photoreceptor used | Black spot judgement made after 20000th copies | Black spot judgement made after 50000th copies | Black spot judgement made after 100000th copies |
|---|---|---|---|
| photoreceptor 39 | | | |
| Inventive photoreceptor 40 | ◎ | ◎ | ○ |
| Comparative photoreceptor 7 | ○ | Δ | X |
| Comparative photoreceptor 8 | ○ | Δ | X |

TABLE-19

| Photoreceptor used | Black spot judgement made after 20000th copies | Black spot judgement made after 50000th copies | Black spot judgement made after 100000th copies |
|---|---|---|---|
| Inventive photoreceptor 41 | ◎ | ◎ | ◎ |
| Inventive photoreceptor 42 | ◎ | ◎ | ○ |
| Inventive photoreceptor 43 | ◎ | ○ | ○ |
| Inventive photoreceptor 44 | ◎ | ◎ | ◎ |
| Inventive photoreceptor 45 | ◎ | ◎ | ○ |
| Inventive photoreceptor 46 | ◎ | ◎ | ○ |
| Inventive photoreceptor 47 | ◎ | ○ | ○ |
| Inventive photoreceptor 48 | ◎ | ◎ | ○ |
| Inventive photoreceptor 49 | ◎ | ◎ | ○ |
| Inventive photoreceptor 50 | ◎ | ◎ | ◎ |
| Comparative photoreceptor 9 | ○ | Δ | X |
| Comparative photoreceptor 10 | ○ | Δ | Δ |

TABLE-20

| Photoreceptor used | Black spot judgement made after 20000th copies | Black spot judgement made after 50000th copies | Black spot judgement made after 100000th copies |
|---|---|---|---|
| Inventive photoreceptor 51 | ◎ | ◎ | ○ |
| Inventive photoreceptor 52 | ◎ | ◎ | ○ |
| Inventive photoreceptor 53 | ◎ | ◎ | ◎ |
| Inventive photoreceptor 54 | ◎ | ◎ | ○ |
| Inventive photoreceptor 55 | ◎ | ◎ | ◎ |
| Inventive photoreceptor 56 | ◎ | ◎ | ○ |
| Inventive photoreceptor 57 | ◎ | ◎ | ○ |
| Inventive photoreceptor 58 | ◎ | ◎ | ◎ |
| Inventive photoreceptor 59 | ◎ | ◎ | ○ |
| Inventive photoreceptor 60 | ◎ | ◎ | ◎ |
| Comparative photoreceptor 11 | ○ | Δ | X |
| Comparative photoreceptor 12 | ○ | Δ | X |

TABLE-21

| Photoreceptor used | Black spot judgement made after 20000th copies | Black spot judgement made after 50000th copies | Black spot judgement made after 100000th copies |
|---|---|---|---|
| Inventive photoreceptor 61 | ◎ | ◎ | ○ |
| Inventive photoreceptor 62 | ◎ | ○ | ○ |
| Inventive photoreceptor 63 | ◎ | ◎ | ○ |
| Inventive photoreceptor 64 | ◎ | ◎ | ○ |
| Inventive photoreceptor 65 | ◎ | ◎ | ◎ |
| Inventive photoreceptor 66 | ◎ | ○ | ○ |
| Inventive photoreceptor 67 | ○ | ○ | ○ |
| Inventive photoreceptor 68 | ◎ | ◎ | ○ |
| Inventive photoreceptor 69 | ◎ | ○ | ○ |
| Inventive photoreceptor 70 | ◎ | ○ | ○ |
| Comparative photoreceptor 13 | ○ | Δ | X |
| Comparative photoreceptor 14 | ○ | Δ | X |

EXAMPLES 71 THROUGH 105 AND COMPARATIVE EXAMPLES 15 THROUGH 28

Photoreceptors 71 through 105 and comparative photoreceptors 15 through 28 were each prepared in the same manner as in Example 1, except that the CTM used in Example 1 was replaced by the compounds each shown in the following Tables-22 through 28, respectively. The characteristic evaluations thereof were then carried out in the same manners described above, and the results thereof are shown in the following Tables-29 through 42, respectively. It was proved from the results thereof that, as same as in the aforementioned Example 1, the photoreceptivities, residual potentials, image qualities and electric potential stabilities could each be excellent when making use of the CTM of the invention.

TABLE-22

| Example No. | Photoreceptor No. | CGM | CTM |
|---|---|---|---|
| Inventive Example 71 | Inventive photoreceptor 71 | Compound $F_1$-23 | Exemplified compound (11) |
| Inventive Example 72 | Inventive photoreceptor 72 | Compound $F_1$-23 | Exemplified compound (20) |
| Inventive Example 73 | Inventive photoreceptor 73 | Compound $F_1$-1 | Exemplified compound (14) |
| Inventive Example 74 | Inventive photoreceptor 74 | Compound $F_1$-1 | Exemplified compound (4) |
| Inventive Example 75 | Inventive photoreceptor 75 | Compound $F_1$-6 | Exemplified compound (11) |
| Comparative Example 15 | Comparative photoreceptor 15 | Compound $F_1$-23 | Comparative compound (1) |
| Comparative Example 16 | Comparative photoreceptor 16 | Compound $F_1$-23 | Comparative compound (2) |

TABLE-23

| Example No. | Photoreceptor No. | CGM | CTM |
|---|---|---|---|
| Inventive Example 76 | Inventive photoreceptor 76 | Compound $Q_1$-3 | Exemplified compound (1) |
| Inventive Example 77 | Inventive photoreceptor 77 | Compound $Q_1$-3 | Exemplified compound (4) |
| Inventive Example 78 | Inventive photoreceptor 78 | Compound $Q_1$-3 | Exemplified compound (11) |
| Inventive Example 79 | Inventive photoreceptor 79 | Compound $Q_1$-3 | Exemplified compound (13) |
| Inventive Example 80 | Inventive photoreceptor 80 | Compound $Q_1$-3 | Exemplified compound (25) |
| Comparative Example 17 | Comparative photoreceptor 17 | Compound $Q_1$-3 | Comparative compound (1) |
| Comparative Example 18 | Comparative photoreceptor 18 | Compound $Q_1$-3 | Comparative compound (2) |

TABLE-24

| Example No. | Photoreceptor No. | CGM | CTM |
|---|---|---|---|
| Inventive Example 81 | Inventive photoreceptor 81 | Compound $Q_1$-3, $F_1$-23 | Exemplified compound (28) |
| Inventive Example 82 | Inventive photoreceptor 82 | Compound $Q_1$-3, $F_1$-23 | Exemplified compound (11) |
| Inventive Example 83 | Inventive photoreceptor 83 | Compound $Q_1$-3, $F_1$-23 | Exemplified compound (20) |
| Inventive Example 84 | Inventive photoreceptor 84 | Compound $Q_1$-3, $F_1$-23 | Exemplified compound (50) |
| Inventive Example 85 | Inventive photoreceptor 85 | Compound $Q_1$-3, $F_1$-23 | Exemplified compound (37) |
| Inventive Comparative Example 19 | Inventive Comparative photoreceptor 19 | Compound $Q_1$-3, Compound $Q_1$-3, $F_1$-23 | Exemplified Comparative compound (1) |
| Comparative Example 20 | Comparative photoreceptor 20 | Compound $Q_1$-3, $F_1$-23 | Comparative compound (2) |

TABLE-25

| Example No. | Photoreceptor No. | CGM | CTM |
|---|---|---|---|
| Inventive Example 86 | Inventive photoreceptor 86 | τ type non-metallic phthalocyanine | Exemplified compound (14) |
| Inventive Example 87 | Inventive photoreceptor 87 | τ type non-metallic phthalocyanine | Exemplified compound (11) |
| Inventive Example 88 | Inventive photoreceptor 88 | τ type non-metallic phthalocyanine | Exemplified compound (17) |
| Inventive Example 89 | Inventive photoreceptor 89 | τ type non-metallic phthalocyanine | Exemplified compound (22) |
| Inventive Example 90 | Inventive photoreceptor 90 | τ type non-metallic phthalocyanine | Exemplified compound (20) |
| Comparative Example 21 | Comparative photoreceptor 21 | τ type non-metallic phthalocyanine | Comparative compound (1) |
| Comparative Example 22 | Comparative photoreceptor 22 | τ type non-metallic phthalocyanine | Comparative compound (2) |

TABLE-26

| Example No. | Photoreceptor No. | CGM | CTM |
|---|---|---|---|
| Inventive Example 91 | Inventive photoreceptor 91 | X type non-metallic phthalocyanine | Exemplified compound (42) |
| Inventive Example 92 | Inventive photoreceptor 92 | X type non-metallic phthalocyanine | Exemplified compound (8) |
| Inventive Example 93 | Inventive photoreceptor 93 | X type non-metallic phthalocyanine | Exemplified compound (11) |
| Inventive Example 94 | Inventive photoreceptor 94 | X type non-metallic phthalocyanine | Exemplified compound (31) |
| Inventive Example 95 | Inventive photoreceptor 95 | X type non-metallic phthalocyanine | Exemplified compound (20) |
| Comparative Example 23 | Comparative photoreceptor 23 | X type non-metallic phthalocyanine | Comparative compound (1) |
| Comparative Example 24 | Comparative photoreceptor 24 | X type non-metallic phthalocyanine | Comparative compound (2) |

TABLE-27

| Example No. | Photoreceptor No. | CGM | CTM |
|---|---|---|---|
| Inventive Example 96 | Inventive photoreceptor 96 | Y type oxytitanium phthalocyanine | Exemplified compound (2) |
| Inventive Example 97 | Inventive photoreceptor 97 | Y type oxytitanium phthalocyanine | Exemplified compound (40) |
| Inventive Example 98 | Inventive photoreceptor 98 | Y type oxytitanium phthalocyanine | Exemplified compound (5) |
| Inventive Example 99 | Inventive photoreceptor 99 | Y type oxytitanium phthalocyanine | Exemplified compound (11) |
| Inventive Example 100 | Inventive photoreceptor 100 | Y type oxytitanium phthalocyanine | Exemplified compound (14) |
| Comparative Example 25 | Comparative photoreceptor 25 | Y type oxytitanium phthalocyanine | Comparative compound (1) |
| Comparative Example 26 | Comparative photoreceptor 26 | Y type oxytitanium phthalocyanine | Comparative compound (2) |

TABLE-28

| Example No. | Photoreceptor No. | CGM | CTM |
|---|---|---|---|
| Inventive Example 101 | Inventive photoreceptor 101 | Compound $F_2$-6 | Exemplified compound (6) |
| Inventive Example 102 | Inventive photoreceptor 102 | Compound $F_2$-6 | Exemplified compound (26) |
| Inventive Example 103 | Inventive photoreceptor 103 | Compound $F_2$-6 | Exemplified compound (11) |
| Inventive Example 104 | Inventive photoreceptor 104 | Compound $F_2$-6 | Exemplified compound (14) |
| Inventive Example 105 | Inventive photoreceptor 105 | Compound $F_2$-5 | Exemplified compound (60) |
| Comparative Example 27 | Comparative photoreceptor 27 | Compound $F_2$-6 | Comparative compound (1) |
| Comparative Example 28 | Comparative photoreceptor 28 | Compound $F_2$-6 | Comparative compound (2) |

TABLE-29

| Photoreceptor No. | Initial white paper potential, Vw (v) | Vr (v) after 20000th repetition at the following linear velocity: Repetition at 240 mm/sec. | Repetition at 330 mm/sec. | Repetition at 440 mm/sec. |
|---|---|---|---|---|
| Inventive photoreceptor 71 | 51 | 12 | 16 | 20 |
| Inventive photoreceptor 72 | 48 | 10 | 14 | 18 |
| Inventive photoreceptor 73 | 50 | 13 | 15 | 19 |
| Inventive photoreceptor 74 | 74 | 10 | 12 | 17 |
| Inventive photoreceptor 75 | 52 | 13 | 16 | 21 |
| Comparative photoreceptor 15 | 61 | 15 | 38 | 75 |
| Comparative photoreceptor 16 | 73 | 17 | 45 | 89 |

TABLE-30

| Photoreceptor No. | Initial white paper potential, Vw (v) | Vr (v) after 20000th repetition at the following linear velocity: Repetition at 240 mm/sec. | Repetition at 330 mm/sec. | Repetition at 440 mm/sec. |
|---|---|---|---|---|
| Inventive photoreceptor 76 | 97 | 11 | 13 | 22 |
| Inventive photoreceptor 77 | 99 | 10 | 14 | 23 |
| Inventive photoreceptor 78 | 94 | 9 | 11 | 21 |
| Inventive photoreceptor 79 | 100 | 12 | 15 | 25 |
| Inventive photoreceptor 80 | 102 | 10 | 13 | 24 |
| Comparative photoreceptor 17 | 112 | 14 | 37 | 75 |
| Comparative photoreceptor 18 | 121 | 15 | 39 | 79 |

TABLE-31

| Photoreceptor No. | Initial white paper potential, Vw (v) | Vr (v) after 20000th repetition at the following linear velocity: Repetition at 240 mm/sec. | Repetition at 330 mm/sec. | Repetition at 440 mm/sec. |
|---|---|---|---|---|
| Inventive photoreceptor 81 | 63 | 10 | 14 | 22 |
| Inventive photoreceptor 82 | 70 | 13 | 15 | 25 |
| Inventive photoreceptor 83 | 65 | 9 | 13 | 19 |
| Inventive photoreceptor 84 | 69 | 15 | 18 | 26 |
| Inventive photoreceptor 85 | 71 | 14 | 19 | 27 |

TABLE-31-continued

| Photoreceptor No. | Initial white paper potential, Vw (v) | Vr (v) after 20000th repetition at the following linear velocity: Repetition at 240 mm/sec. | Repetition at 330 mm/sec. | Repetition at 440 mm/sec. |
|---|---|---|---|---|
| Comparative photoreceptor 19 | 80 | 17 | 45 | 85 |
| Comparative photoreceptor 20 | 95 | 18 | 37 | 84 |

TABLE-32

| Photoreceptor No. | Numbers of white spots produced after 10000th repetition | Numbers of white spots produced after 50000th repetition | Numbers of white spots produced after 100000th repetition |
|---|---|---|---|
| Inventive photoreceptor 71 | 0 | 0 | 1 |
| Inventive photoreceptor 72 | 0 | 0 | 0 |
| Inventive photoreceptor 73 | 0 | 0 | 0 |
| Inventive photoreceptor 74 | 0 | 1 | 1 |
| Inventive photoreceptor 75 | 0 | 0 | 1 |
| Comparative photoreceptor 15 | 6 | 23 | 31 |
| Comparative photoreceptor 16 | 4 | 19 | 37 |

TABLE-33

| Photoreceptor No. | Numbers of white spots produced after 10000th repetition | Numbers of white spots produced after 50000th repetition | Numbers of white spots produced after 100000th repetition |
|---|---|---|---|
| Inventive photoreceptor 76 | 0 | 1 | 1 |
| Inventive photoreceptor 77 | 0 | 1 | 1 |
| Inventive photoreceptor 78 | 0 | 0 | 0 |
| Inventive photoreceptor 79 | 0 | 0 | 1 |
| Inventive photoreceptor 80 | 0 | 0 | 2 |
| Comparative photoreceptor 17 | 5 | 27 | 43 |
| Comparative photoreceptor 18 | 4 | 25 | 47 |

TABLE-34

| Photoreceptor No. | Numbers of white spots produced after 10000th repetition | Numbers of white spots produced after 50000th repetition | Numbers of white spots produced after 100000th repetition |
|---|---|---|---|
| Inventive photoreceptor 81 | 0 | 0 | 0 |
| Inventive photoreceptor 82 | 0 | 0 | 1 |
| Inventive photoreceptor 83 | 0 | 0 | 0 |
| Inventive photoreceptor 84 | 0 | 0 | 0 |
| Inventive photoreceptor 85 | 0 | 1 | 0 |
| Comparative photoreceptor 19 | 3 | 12 | 32 |
| Comparative | 2 | 18 | 38 |

TABLE-34-continued

| Photoreceptor No. | Numbers of white spots produced after 10000th repetition | Numbers of white spots produced after 50000th repetition | Numbers of white spots produced after 100000th repetition |
|---|---|---|---|
| photoreceptor 20 | | | |

TABLE-35

| Photoreceptor No. | Ordinary temperature (25° C.) | | Low temperature (10° C.) | |
|---|---|---|---|---|
| | VH (v) | VL (v) | VH (v) | VL (v) |
| Inventive photoreceptor 86 | 712 | 97 | 716 | 101 |
| Inventive photoreceptor 87 | 705 | 96 | 711 | 108 |
| Inventive photoreceptor 88 | 698 | 103 | 702 | 105 |
| Inventive photoreceptor 89 | 703 | 101 | 700 | 103 |
| Inventive photoreceptor 90 | 708 | 104 | 712 | 107 |
| Comparative photoreceptor 21 | 697 | 107 | 700 | 152 |
| Comparative photoreceptor 22 | 697 | 123 | 685 | 179 |

TABLE-36

| Photoreceptor No. | Ordinary temperature (25° C.) | | Low temperature (10° C.) | |
|---|---|---|---|---|
| | VH (v) | VL (v) | VH (v) | VL (v) |
| Inventive photoreceptor 91 | 698 | 100 | 700 | 99 |
| Inventive photoreceptor 92 | 703 | 102 | 704 | 101 |
| Inventive photoreceptor 93 | 702 | 104 | 701 | 105 |
| Inventive photoreceptor 94 | 708 | 106 | 711 | 107 |
| Inventive photoreceptor 95 | 699 | 98 | 702 | 103 |
| Comparative photoreceptor 23 | 708 | 120 | 678 | 159 |
| Comparative photoreceptor 24 | 717 | 122 | 682 | 175 |

TABLE-37

| Photoreceptor No. | Ordinary temperature (25° C.) | | Low temperature (10° C.) | |
|---|---|---|---|---|
| | VH (v) | VL (v) | VH (v) | VL (v) |
| Inventive photoreceptor 96 | 702 | 51 | 706 | 53 |
| Inventive photoreceptor 97 | 708 | 52 | 709 | 55 |
| Inventive photoreceptor 98 | 705 | 51 | 707 | 53 |
| Inventive photoreceptor 99 | 711 | 55 | 713 | 56 |
| Inventive photoreceptor 100 | 698 | 49 | 701 | 50 |
| Comparative photoreceptor 25 | 711 | 62 | 685 | 90 |
| Comparative photoreceptor 26 | 715 | 59 | 685 | 81 |

TABLE-38

| Photoreceptor No. | Ordinary temperature (25° C.) | | Low temperature (10° C.) | |
|---|---|---|---|---|
| | VH (v) | VL (v) | VH (v) | VL (v) |
| Inventive photoreceptor 101 | 702 | 99 | 701 | 103 |
| Inventive photoreceptor 102 | 708 | 109 | 710 | 103 |

TABLE-38-continued

| Photoreceptor No. | Ordinary temperature (25° C.) | | Low temperature (10° C.) | |
|---|---|---|---|---|
| | VH (v) | VL (v) | VH (v) | VL (v) |
| Inventive photoreceptor 103 | 704 | 108 | 702 | 102 |
| Inventive photoreceptor 104 | 706 | 106 | 705 | 104 |
| Inventive photoreceptor 105 | 712 | 100 | 713 | 101 |
| Comparative photoreceptor 27 | 716 | 112 | 687 | 155 |
| Comparative photoreceptor 28 | 708 | 126 | 683 | 148 |

TABLE-39

| Photoreceptor used | Black spot judgement made after 20000th copies | Black spot judgement made after 50000th copies | Black spot judgement made after 100000th copies |
|---|---|---|---|
| Inventive photoreceptor 86 | ◎ | ◎ | ○ |
| Inventive photoreceptor 87 | ◎ | ◎ | ◎ |
| Inventive photoreceptor 88 | ◎ | ○ | ○ |
| Inventive photoreceptor 89 | ◎ | ◎ | ◎ |
| Inventive photoreceptor 90 | ◎ | ○ | ○ |
| Comparative photoreceptor 21 | ○ | Δ | X |
| Comparative photoreceptor 22 | ○ | Δ | X |

TABLE-40

| Photoreceptor used | Black spot judgement made after 20000th copies | Black spot judgement made after 50000th copies | Black spot judgement made after 100000th copies |
|---|---|---|---|
| Inventive photoreceptor 91 | ◎ | ◎ | ○ |
| Inventive photoreceptor 92 | ◎ | ◎ | ○ |
| Inventive photoreceptor 93 | ◎ | ○ | ○ |
| Inventive photoreceptor 94 | ◎ | ○ | ○ |
| Inventive photoreceptor 95 | ◎ | ◎ | ◎ |
| Comparative photoreceptor 23 | ○ | Δ | X |
| Comparative photoreceptor 24 | ○ | Δ | Δ |

TABLE-41

| Photoreceptor used | Black spot judgement made after 20000th copies | Black spot judgement made after 50000th copies | Black spot judgement made after 100000th copies |
|---|---|---|---|
| Inventive photoreceptor 96 | ◎ | ○ | ○ |
| Inventive photoreceptor 97 | ◎ | ○ | ○ |
| Inventive photoreceptor 98 | ◎ | ◎ | ◎ |
| Inventive photoreceptor 99 | ◎ | ◎ | ○ |
| Inventive photoreceptor 100 | ◎ | ○ | ○ |
| Comparative | ○ | Δ | X |

TABLE-41-continued

| Photoreceptor used | Black spot judgement made after 20000th copies | Black spot judgement made after 50000th copies | Black spot judgement made after 100000th copies |
|---|---|---|---|
| photoreceptor 25 | | | |
| Comparative photoreceptor 26 | ○ | Δ | X |

TABLE-42

| Photoreceptor used | Black spot judgement made after 20000th copies | Black spot judgement made after 50000th copies | Black spot judgement made after 100000th copies |
|---|---|---|---|
| Inventive photoreceptor 101 | ◎ | ◎ | ◎ |
| Inventive photoreceptor 102 | ◎ | ◎ | ○ |
| Inventive photoreceptor 103 | ◎ | ◎ | ◎ |
| Inventive photoreceptor 104 | ◎ | ○ | ○ |
| Inventive photoreceptor 105 | ◎ | ◎ | ○ |
| Comparative photoreceptor 27 | ○ | Δ | X |
| Comparative photoreceptor 28 | ○ | Δ | X |

EXAMPLES 106–175 and COMPARATIVE EXAMPLES 29–42

Photoreceptors 106 through 175 and comparative photoreceptors 29 through 42 were each prepared in the same manner as in Example 1, except that the CGM and CTM used in Example 1 were each replaced by the compounds each shown in the following Tables-43 through 49, respectively. The characteristic evaluations thereof were then carried out in the same manners described above, and the results thereof are shown in the following Tables-50 through 63, respectively. It was proved from the results thereof that, as same as in the aforementioned Example 1, the photoreceptivities, residual potentials, image qualities and electric potential stabilities could each be excellent when making use of the CTM of the invention.

TABLE-43

| Example No. | Photoreceptor No. | CGM | CTM |
|---|---|---|---|
| Inventive Example 106 | Inventive photoreceptor 106 | Compounds $F_1$-23 | Exemplified compounds [3] |
| Inventive Example 107 | Inventive photoreceptor 107 | Compounds $F_1$-23 | Exemplified compounds [12] |
| Inventive Example 108 | Inventive photoreceptor 108 | Compounds $F_1$-23 | Exemplified compounds [21] |
| Inventive Example 109 | Inventive photoreceptor 109 | Compounds $F_1$-23 | Exemplified compounds [29] |
| Inventive Example 110 | Inventive photoreceptor 110 | Compounds $F_1$-23 | Exemplified compounds [37] |
| Inventive Example 111 | Inventive photoreceptor 111 | Compounds $F_1$-1 | Exemplified compounds [53] |
| Inventive Example 112 | Inventive photoreceptor 112 | Compounds $F_1$-1 | Exemplified compounds [56] |
| Inventive Example 113 | Inventive photoreceptor 113 | Compounds $F_1$-1 | Exemplified compounds [66] |
| Inventive Example 114 | Inventive photoreceptor 114 | Compounds $F_1$-7 | Exemplified compounds [78] |
| Inventive Example 115 | Inventive photoreceptor 115 | Compounds $F_1$-6 | Exemplified compounds [150] |
| Comparative Example 29 | Comparative photoreceptor 29 | Compound $F_1$-23 | Comparative compound (3) |
| Comparative Example 30 | Comparative photoreceptor 30 | Compound $F_1$-23 | Comparative compound (2) |

*Comparative Example (3) is shown later.

TABLE-44

| Example No. | Photoreceptor No. | CGM | CTM |
|---|---|---|---|
| Inventive Example 116 | Inventive photoreceptor 116 | Compound $Q_1$-3 | Exemplified compounds [1] |
| Inventive Example 117 | Inventive photoreceptor 117 | Compound $Q_1$-3 | Exemplified compounds [21] |
| Inventive Example 118 | Inventive photoreceptor 118 | Compound $Q_1$-3 | Exemplified compounds [33] |
| Inventive Example 119 | Inventive photoreceptor 119 | Compound $Q_1$-3 | Exemplified compounds [45] |
| Inventive Example 120 | Inventive photoreceptor 120 | Compound $Q_1$-3 | Exemplified compounds [48] |
| Inventive Example 121 | Inventive photoreceptor 121 | Compound $Q_1$-3 | Exemplified compounds [57] |
| Inventive Example 122 | Inventive photoreceptor 122 | Compound $Q_1$-3 | Exemplified compounds [65] |
| Inventive Example 123 | Inventive photoreceptor 123 | Compound $Q_1$-3 | Exemplified compounds [87] |
| Inventive Example 124 | Inventive photoreceptor 124 | Compound $Q_1$-3 | Exemplified compounds [93] |
| Inventive Example 125 | Inventive photoreceptor 125 | Compound $Q_1$-3 | Exemplified compounds [150] |
| Comparative Example 31 | Comparative photoreceptor 31 | Compound $Q_1$-3 | Comparative compound (3) |
| Comparative Example 32 | Comparative photoreceptor 32 | Compound $Q_1$-3 | Comparative compound (2) |

TABLE-45

| Example No. | Photoreceptor No. | CGM | CTM |
|---|---|---|---|
| Inventive Example 126 | Inventive photoreceptor 126 | Compounds $Q_1$-3, $F_1$-23 | Exemplified compound [21] |
| Inventive Example 127 | Inventive photoreceptor 127 | Compounds $Q_1$-3, $F_1$-23 | Exemplified compound [39] |
| Inventive Example 128 | Inventive photoreceptor 128 | Compounds $Q_1$-3, $F_1$-23 | Exemplified compound [48] |
| Inventive Example 129 | Inventive photoreceptor 129 | Compounds $Q_1$-3, $F_1$-23 | Exemplified compound [66] |

TABLE-45-continued

| Example No. | Photoreceptor No. | CGM | CTM |
|---|---|---|---|
| Inventive Example 130 | Inventive photoreceptor 130 | Compounds $Q_1$-3, $F_1$-23 | Exemplified compound [73] |
| Inventive Example 131 | Inventive photoreceptor 131 | Compounds $Q_1$-3, $F_1$-23 | Exemplified compound [92] |
| Inventive Example 132 | Inventive photoreceptor 132 | Compounds $Q_1$-3, $F_1$-23 | Exemplified compound [100] |
| Inventive Example 133 | Inventive photoreceptor 133 | Compounds $Q_1$-3, $F_1$-23 | Exemplified compound [114] |
| Inventive Example 134 | Inventive photoreceptor 134 | Compounds $Q_1$-3, $F_1$-23 | Exemplified compound [120] |
| Inventive Example 135 | Inventive photoreceptor 135 | Compounds $Q_1$-3, $F_1$-23 | Exemplified compound [155] |
| Comparative Example 33 | Comparative photoreceptor 33 | Compound $Q_1$-3, $F_1$-23 | Comparative compound (3) |
| Comparative Example 34 | Comparative photoreceptor 34 | Compound $Q_1$-3, $F_1$-23 | Comparative compound (2) |

TABLE-46

| Example No. | Photoreceptor No. | CGM | CTM |
|---|---|---|---|
| Inventive Example 136 | Inventive photoreceptor 136 | $\tau$ type non-metallic phthalocyanine | Exemplified compound [2] |
| Inventive Example 137 | Inventive photoreceptor 137 | $\tau$ type non-metallic phthalocyanine | Exemplified compound [21] |
| Inventive Example 138 | Inventive photoreceptor 138 | $\tau$ type non-metallic phthalocyanine | Exemplified compound [37] |
| Inventive Example 139 | Inventive photoreceptor 139 | $\tau$ type non-metallic phthalocyanine | Exemplified compound [43] |
| Inventive Example 140 | Inventive photoreceptor 140 | $\tau$ type non-metallic phthalocyanine | Exemplified compound [47] |
| Inventive Example 141 | Inventive photoreceptor 141 | $\tau$ type non-metallic phthalocyanine | Exemplified compound [57] |
| Inventive Example 142 | Inventive photoreceptor 142 | $\tau$ type non-metallic phthalocyanine | Exemplified compound [70] |
| Inventive Example 143 | Inventive photoreceptor 143 | $\tau$ type non-metallic phthalocyanine | Exemplified compound [75] |
| Inventive Example 144 | Inventive photoreceptor 144 | $\tau$ type non-metallic phthalocyanine | Exemplified compound [102] |
| Inventive Example 145 | Inventive photoreceptor 145 | $\tau$ type non-metallic phthalocyanine | Exemplified compound [150] |
| Comparative Example 35 | Comparative photoreceptor 35 | $\tau$ type non-metallic phthalocyanine | Comparative compound (3) |
| Comparative Example 36 | Comparative photoreceptor 36 | $\tau$ type non-metallic phthalocyanine | Comparative compound (2) |

TABLE-47

| Example No. | Photoreceptor No. | CGM | CTM |
|---|---|---|---|
| Inventive Example 146 | Inventive photoreceptor 146 | X type non-metallic phthalocyanine | Exemplified compound [6] |

TABLE-47-continued

| Example No. | Photoreceptor No. | CGM | CTM |
|---|---|---|---|
| Inventive Example 147 | Inventive photoreceptor 147 | X type non-metallic phthalocyanine | Exemplified compound [12] |
| Inventive Example 148 | Inventive photoreceptor 148 | X type non-metallic phthalocyanine | Exemplified compound [21] |
| Inventive Example 149 | Inventive photoreceptor 149 | X type non-metallic phthalocyanine | Exemplified compound [38] |
| Inventive Example 150 | Inventive photoreceptor 150 | X type non-metallic phthalocyanine | Exemplified compound [47] |
| Inventive Example 151 | Inventive photoreceptor 151 | X type non-metallic phthalocyanine | Exemplified compound [55] |
| Inventive Example 152 | Inventive photoreceptor 152 | X type non-metallic phthalocyanine | Exemplified compound [72] |
| Inventive Example 153 | Inventive photoreceptor 153 | X type non-metallic phthalocyanine | Exemplified compound [79] |
| Inventive Example 154 | Inventive photoreceptor 154 | X type non-metallic phthalocyanine | Exemplified compound [88] |
| Inventive Example 155 | Inventive photoreceptor 155 | X type non-metallic phthalocyanine | Exemplified compound [104] |
| Comparative Example 37 | Comparative photoreceptor 37 | X type non-metallic phthalocyanine | Comparative compound (3) |
| Comparative Example 38 | Comparative photoreceptor 38 | X type non-metallic phthalocyanine | Comparative compound (2) |

TABLE-48

| Example No. | Photoreceptor No. | CGM | CTM |
|---|---|---|---|
| Inventive Example 156 | Inventive photoreceptor 156 | Y type oxytitanium phthalocyanine | Exemplified compound [3] |
| Inventive Example 157 | Inventive photoreceptor 157 | Y type oxytitanium phthalocyanine | Exemplified compound [12] |
| Inventive Example 158 | Inventive photoreceptor 158 | Y type oxytitanium phthalocyanine | Exemplified compound [26] |
| Inventive Example 159 | Inventive photoreceptor 159 | Y type oxytitanium phthalocyanine | Exemplified compound [50] |
| Inventive Example 160 | Inventive photoreceptor 160 | Y type oxytitanium phthalocyanine | Exemplified compound [71] |
| Inventive Example 161 | Inventive photoreceptor 161 | Y type oxytitanium phthalocyanine | Exemplified compound [73] |
| Inventive Example 162 | Inventive photoreceptor 162 | Y type oxytitanium phthalocyanine | Exemplified compound [93] |
| Inventive Example 163 | Inventive photoreceptor 163 | Y type oxytitanium phthalocyanine | Exemplified compound [103] |
| Inventive Example 164 | Inventive photoreceptor 164 | Y type oxytitanium phthalocyanine | Exemplified compound [116] |
| Inventive Example 165 | Inventive photoreceptor 165 | Y type oxytitanium phthalocyanine | Exemplified compound [150] |
| Comparative Example 39 | Comparative photoreceptor 39 | Y type oxytitanium phthalocyanine | Comparative compound (3) |
| Comparative Example | Comparative photoreceptor 40 | Y type oxytitanium phthalocyanine | Comparative compound (2) |

TABLE-48-continued

| Example No. | Photoreceptor No. | CGM | CTM |
|---|---|---|---|
| 40 | | | |

TABLE-49

| Example No. | Photoreceptor No. | CGM | CTM |
|---|---|---|---|
| Inventive Example 166 | Inventive photoreceptor 166 | Compound $F_2$-6 | Exemplified compound [3] |
| Inventive Example 167 | Inventive photoreceptor 167 | Compound $F_2$-6 | Exemplified compound [12] |
| Inventive Example 168 | Inventive photoreceptor 168 | Compound $F_2$-6 | Exemplified compound [21] |
| Inventive Example 169 | Inventive photoreceptor 169 | Compound $F_2$-6 | Exemplified compound [30] |
| Inventive Example 170 | Inventive photoreceptor 170 | Compound $F_2$-6 | Exemplified compound [39] |
| Inventive Example 171 | Inventive photoreceptor 171 | Compound $F_2$-6 | Exemplified compound [48] |
| Inventive Example 172 | Inventive photoreceptor 172 | Compound $F_2$-6 | Exemplified compound [57] |
| Inventive Example 173 | Inventive photoreceptor 173 | Compound $F_2$-6 | Exemplified compound [60] |
| Inventive Example 174 | Inventive photoreceptor 174 | Compound $F_2$-6 | Exemplified compound [75] |
| Inventive Example 175 | Inventive photoreceptor 175 | Compound $F_2$-6 | Exemplified compound [84] |
| Comparative Example 41 | Comparative photoreceptor 41 | Compound $F_2$-6 | Comparative compound (3) |
| Comparative Example 42 | Comparative photoreceptor 42 | Compound $F_2$-6 | Comparative compound (2) |

TABLE-50

| Photoreceptor No. | Initial white paper potential, Vw (v) | Vr (v) after 20000th repetition at the following linear velocity: Repetition at 240 mm/sec. | Repetition at 330 mm/sec. | Repetition at 440 mm/sec. |
|---|---|---|---|---|
| Inventive photoreceptor 106 | 46 | 10 | 13 | 19 |
| Inventive photoreceptor 107 | 48 | 13 | 15 | 22 |
| Inventive photoreceptor 108 | 51 | 12 | 15 | 23 |
| Inventive photoreceptor 109 | 53 | 13 | 16 | 23 |
| Inventive photoreceptor 110 | 48 | 11 | 14 | 21 |
| Inventive photoreceptor 111 | 49 | 8 | 13 | 21 |
| Inventive photoreceptor 112 | 47 | 10 | 15 | 23 |
| Inventive photoreceptor 113 | 54 | 10 | 15 | 22 |

TABLE-50-continued

| Photoreceptor No. | Initial white paper potential, Vw (v) | Vr (v) after 20000th repetition at the following linear velocity: Repetition at 240 mm/sec. | Repetition at 330 mm/sec. | Repetition at 440 mm/sec. |
|---|---|---|---|---|
| Inventive photoreceptor 114 | 50 | 14 | 17 | 26 |
| Inventive photoreceptor 115 | 50 | 15 | 18 | 27 |
| Comparative photoreceptor 29 | 67 | 14 | 40 | 76 |
| Comparative photoreceptor 30 | 73 | 17 | 45 | 89 |

TABLE-51

| Photoreceptor No. | Initial white paper potential, Vw (v) | Vr (v) after 20000th repetition at the following linear velocity: Repetition at 240 mm/sec. | Repetition at 330 mm/sec. | Repetition at 440 mm/sec. |
|---|---|---|---|---|
| Inventive photoreceptor 116 | 102 | 11 | 15 | 25 |
| Inventive photoreceptor 117 | 100 | 12 | 15 | 23 |
| Inventive photoreceptor 118 | 97 | 15 | 18 | 26 |
| Inventive photoreceptor 119 | 103 | 11 | 14 | 22 |
| Inventive photoreceptor 120 | 97 | 12 | 16 | 23 |
| Inventive photoreceptor 121 | 96 | 9 | 13 | 21 |
| Inventive photoreceptor 122 | 107 | 13 | 18 | 27 |
| Inventive photoreceptor 123 | 95 | 10 | 13 | 21 |
| Inventive photoreceptor 124 | 101 | 9 | 12 | 22 |
| Inventive photoreceptor 125 | 104 | 10 | 14 | 24 |
| Comparative photoreceptor 31 | 118 | 13 | 40 | 78 |
| Comparative photoreceptor 32 | 121 | 15 | 39 | 79 |

TABLE-52

| Photoreceptor No. | Initial white paper potential, Vw (v) | Vr (v) after 20000th repetition at the following linear velocity: Repetition at 240 mm/sec. | Repetition at 330 mm/sec. | Repetition at 440 mm/sec. |
|---|---|---|---|---|
| Inventive photoreceptor 126 | 63 | 13 | 18 | 25 |
| Inventive photoreceptor 127 | 73 | 12 | 16 | 24 |
| Inventive photoreceptor 128 | 68 | 10 | 15 | 22 |

TABLE-52-continued

| Photoreceptor No. | Initial white paper potential, Vw (v) | Vr (v) after 20000th repetition at the following linear velocity: Repetition at 240 mm/sec. | Repetition at 330 mm/sec. | Repetition at 440 mm/sec. |
|---|---|---|---|---|
| Inventive photoreceptor 129 | 66 | 9 | 15 | 24 |
| Inventive photoreceptor 130 | 73 | 9 | 14 | 22 |
| Inventive photoreceptor 131 | 71 | 11 | 15 | 22 |
| Inventive photoreceptor 132 | 70 | 12 | 17 | 25 |
| Inventive photoreceptor 133 | 67 | 12 | 18 | 26 |
| Inventive photoreceptor 134 | 69 | 15 | 20 | 29 |
| Inventive photoreceptor 135 | 73 | 14 | 21 | 29 |
| Comparative photoreceptor 33 | 88 | 18 | 40 | 77 |
| Comparative photoreceptor 34 | 95 | 18 | 39 | 84 |

TABLE-53

| Photoreceptor No. | Numbers of white spot produced after 10000th repetition | Numbers of white spot produced after 50000th repetition | Numbers of white spot produced after 100000th repetition |
|---|---|---|---|
| Inventive photoreceptor 106 | 0 | 0 | 0 |
| Inventive photoreceptor 107 | 0 | 1 | 1 |
| Inventive photoreceptor 108 | 0 | 1 | 2 |
| Inventive photoreceptor 109 | 0 | 0 | 0 |
| Inventive photoreceptor 110 | 0 | 0 | 1 |
| Inventive photoreceptor 111 | 0 | 0 | 0 |
| Inventive photoreceptor 112 | 0 | 1 | 1 |
| Inventive photoreceptor 113 | 0 | 0 | 0 |
| Inventive photoreceptor 114 | 0 | 1 | 2 |
| Inventive photoreceptor 115 | 0 | 1 | 1 |
| Comparative photoreceptor 29 | 4 | 24 | 40 |
| Comparative photoreceptor 30 | 4 | 19 | 37 |

TABLE-54

| Photoreceptor No. | Numbers of white spot produced after 10000th repetition | Numbers of white spot produced after 50000th repetition | Numbers of white spot produced after 100000th repetition |
|---|---|---|---|
| Inventive photoreceptor 116 | 0 | 0 | 1 |
| Inventive photoreceptor 117 | 0 | 0 | 2 |
| Inventive photoreceptor 118 | 0 | 0 | 0 |

TABLE-54-continued

| Photoreceptor No. | Numbers of white spot produced after 10000th repetition | Numbers of white spot produced after 50000th repetition | Numbers of white spot produced after 100000th repetition |
|---|---|---|---|
| Inventive photoreceptor 119 | 0 | 0 | 0 |
| Inventive photoreceptor 120 | 0 | 0 | 1 |
| Inventive photoreceptor 121 | 0 | 0 | 0 |
| Inventive photoreceptor 122 | 0 | 0 | 1 |
| Inventive photoreceptor 123 | 0 | 1 | 2 |
| Inventive photoreceptor 124 | 0 | 0 | 0 |
| Inventive photoreceptor 125 | 0 | 1 | 3 |
| Comparative photoreceptor 31 | 7 | 22 | 50 |
| Comparative photoreceptor 32 | 4 | 25 | 47 |

TABLE-55

| Photoreceptor No. | Numbers of white spot produced after 10000th repetition | Numbers of white spot produced after 50000th repetition | Numbers of white spot produced after 100000th repetition |
|---|---|---|---|
| Inventive photoreceptor 126 | 0 | 1 | 2 |
| Inventive photoreceptor 127 | 0 | 1 | 2 |
| Inventive photoreceptor 128 | 0 | 0 | 0 |
| Inventive photoreceptor 129 | 0 | 1 | 1 |
| Inventive photoreceptor 130 | 0 | 0 | 1 |
| Inventive photoreceptor 131 | 0 | 1 | 1 |
| Inventive photoreceptor 132 | 0 | 1 | 2 |
| Inventive photoreceptor 133 | 0 | 0 | 0 |
| Inventive photoreceptor 134 | 0 | 0 | 3 |
| Inventive photoreceptor 135 | 0 | 1 | 2 |
| Comparative photoreceptor 33 | 5 | 22 | 44 |
| Comparative photoreceptor 34 | 2 | 18 | 38 |

TABLE-56

| Photoreceptor No. | Ordinary temperature (25° C.) VH (v) | VL (v) | Low temperature (10° C.) VH (v) | VL (v) |
|---|---|---|---|---|
| Inventive photoreceptor 135 | 710 | 101 | 711 | 101 |
| Inventive photoreceptor 137 | 705 | 102 | 709 | 103 |
| Inventive photoreceptor 138 | 697 | 99 | 699 | 102 |
| Inventive photoreceptor 139 | 698 | 104 | 700 | 104 |
| Inventive photoreceptor 140 | 693 | 105 | 697 | 107 |
| Inventive photoreceptor 141 | 701 | 110 | 705 | 113 |
| Inventive photoreceptor 142 | 705 | 113 | 706 | 114 |
| Inventive photoreceptor 143 | 699 | 100 | 703 | 102 |
| Inventive | 700 | 98 | 704 | 99 |

TABLE-56-continued

| Photoreceptor No. | Ordinary temperature (25° C.) VH (v) | Ordinary temperature (25° C.) VL (v) | Low temperature (10° C.) VH (v) | Low temperature (10° C.) VL (v) |
|---|---|---|---|---|
| photoreceptor 144 | | | | |
| Inventive photoreceptor 145 | 712 | 109 | 714 | 110 |
| Comparative photoreceptor 35 | 690 | 120 | 677 | 165 |
| Comparative photoreceptor 36 | 697 | 123 | 685 | 179 |

TABLE-57

| Photoreceptor No. | Ordinary temperature (25° C.) VH (v) | Ordinary temperature (25° C.) VL (v) | Low temperature (10° C.) VH (v) | Low temperature (10° C.) VL (v) |
|---|---|---|---|---|
| Inventive photoreceptor 145 | 721 | 95 | 719 | 98 |
| Inventive photoreceptor 147 | 710 | 94 | 706 | 97 |
| Inventive photoreceptor 148 | 725 | 105 | 721 | 107 |
| Inventive photoreceptor 149 | 701 | 103 | 700 | 105 |
| Inventive photoreceptor 150 | 705 | 92 | 700 | 95 |
| Inventive photoreceptor 151 | 708 | 90 | 704 | 94 |
| Inventive photoreceptor 152 | 718 | 105 | 710 | 109 |
| Inventive photoreceptor 153 | 710 | 108 | 708 | 109 |
| Inventive photoreceptor 154 | 724 | 107 | 720 | 110 |
| Inventive photoreceptor 155 | 715 | 102 | 713 | 104 |
| Comparative photoreceptor 37 | 712 | 125 | 678 | 174 |
| Comparative photoreceptor 38 | 717 | 122 | 682 | 175 |

TABLE-58

| Photoreceptor No. | Ordinary temperature (25° C.) VH (v) | Ordinary temperature (25° C.) VL (v) | Low temperature (10° C.) VH (v) | Low temperature (10° C.) VL (v) |
|---|---|---|---|---|
| Inventive photoreceptor 156 | 712 | 50 | 715 | 51 |
| Inventive photoreceptor 157 | 714 | 53 | 717 | 54 |
| Inventive photoreceptor 158 | 718 | 54 | 721 | 56 |
| Inventive photoreceptor 159 | 704 | 51 | 707 | 53 |
| Inventive photoreceptor 160 | 720 | 55 | 722 | 57 |
| Inventive photoreceptor 161 | 706 | 49 | 710 | 50 |
| Inventive photoreceptor 162 | 701 | 47 | 704 | 49 |
| Inventive photoreceptor 163 | 708 | 50 | 710 | 51 |
| Inventive photoreceptor 164 | 712 | 51 | 713 | 52 |
| Inventive photoreceptor 165 | 719 | 55 | 723 | 57 |
| Comparative photoreceptor 39 | 718 | 57 | 690 | 88 |
| Comparative photoreceptor 40 | 715 | 59 | 685 | 81 |

TABLE-59

| Photoreceptor No. | Ordinary temperature (25° C.) VH (v) | Ordinary temperature (25° C.) VL (v) | Low temperature (10° C.) VH (v) | Low temperature (10° C.) VL (v) |
|---|---|---|---|---|
| Inventive photoreceptor 166 | 718 | 108 | 717 | 110 |
| Inventive photoreceptor 167 | 701 | 104 | 702 | 108 |
| Inventive photoreceptor 168 | 708 | 110 | 709 | 112 |
| Inventive photoreceptor 169 | 710 | 100 | 710 | 104 |
| Inventive photoreceptor 170 | 711 | 98 | 710 | 100 |
| Inventive photoreceptor 171 | 716 | 101 | 715 | 105 |
| Inventive photoreceptor 172 | 702 | 105 | 702 | 107 |
| Inventive photoreceptor 173 | 707 | 97 | 706 | 100 |
| Inventive photoreceptor 174 | 710 | 95 | 711 | 99 |
| Inventive photoreceptor 175 | 715 | 103 | 714 | 106 |
| Comparative photoreceptor 41 | 701 | 118 | 671 | 150 |
| Comparative photoreceptor 42 | 708 | 126 | 683 | 148 |

TABLE-60

| Photoreceptor used | Black spot judgement made after 20000th copies | Black spot judgement made after 50000th copies | Black spot judgement made after 100000th copies |
|---|---|---|---|
| Inventive photoreceptor 136 | ◎ | ○ | ○ |
| Inventive photoreceptor 137 | ◎ | ◎ | ◎ |
| Inventive photoreceptor 138 | ◎ | ◎ | ◎ |
| Inventive photoreceptor 139 | ◎ | ◎ | ◎ |
| Inventive photoreceptor 140 | ◎ | ○ | ○ |
| Inventive photoreceptor 141 | ◎ | ○ | ○ |
| Inventive photoreceptor 142 | ◎ | ◎ | ◎ |
| Inventive photoreceptor 143 | ◎ | ◎ | ◎ |
| Inventive photoreceptor 144 | ◎ | ◎ | ◎ |
| Inventive photoreceptor 145 | ◎ | ◎ | ◎ |
| Comparative photoreceptor 35 | ○ | Δ | X |
| Comparative photoreceptor 36 | ○ | Δ | X |

TABLE-61

| Photoreceptor used | Black spot judgement made after 20000th copies | Black spot judgement made after 50000th copies | Black spot judgement made after 100000th copies |
|---|---|---|---|
| Inventive photoreceptor 146 | ◎ | ◎ | ◎ |
| Inventive photoreceptor 147 | ◎ | ◎ | ○ |
| Inventive photoreceptor 148 | ◎ | ◎ | ◎ |
| Inventive photoreceptor 149 | ◎ | ◎ | ○ |
| Inventive photoreceptor 150 | ◎ | ◎ | ◎ |
| Inventive | ◎ | ◎ | ◎ |

TABLE-61-continued

| Photoreceptor used | Black spot judgement made after 20000th copies | Black spot judgement made after 50000th copies | Black spot judgement made after 100000th copies |
|---|---|---|---|
| photoreceptor 151 | | | |
| Inventive photoreceptor 152 | ◎ | ◎ | ◎ |
| Inventive photoreceptor 153 | ◎ | ◎ | ◎ |
| Inventive photoreceptor 154 | ◎ | ◎ | ○ |
| Inventive photoreceptor 155 | ◎ | ◎ | ◎ |
| Comparative photoreceptor 37 | ○ | Δ | X |
| Comparative photoreceptor 38 | ○ | Δ | Δ |

TABLE-62

| Photoreceptor used | Black spot judgement made after 20000th copies | Black spot judgement made after 50000th copies | Black spot judgement made after 100000th copies |
|---|---|---|---|
| Inventive photoreceptor 156 | ◎ | ◎ | ◎ |
| Inventive photoreceptor 157 | ◎ | ◎ | ◎ |
| Inventive photoreceptor 158 | ◎ | ◎ | ◎ |
| Inventive photoreceptor 159 | ◎ | ◎ | ◎ |
| Inventive photoreceptor 160 | ◎ | ◎ | ○ |
| Inventive photoreceptor 161 | ◎ | ◎ | ◎ |
| Inventive photoreceptor 162 | ◎ | ◎ | ◎ |
| Inventive photoreceptor 163 | ◎ | ◎ | ◎ |
| Inventive photoreceptor 164 | ◎ | ◎ | ◎ |
| Inventive photoreceptor 165 | ◎ | ◎ | ○ |
| Comparative photoreceptor 39 | ○ | Δ | Δ |
| Comparative photoreceptor 40 | ○ | Δ | X |

TABLE-63

| Photoreceptor used | Black spot judgement made after 20000th copies | Black spot judgement made after 50000th copies | Black spot judgement made after 100000th copies |
|---|---|---|---|
| Inventive photoreceptor 166 | ◎ | ◎ | ◎ |
| Inventive photoreceptor 167 | ◎ | ◎ | ◎ |
| Inventive photoreceptor 168 | ◎ | ◎ | ◎ |
| Inventive photoreceptor 169 | ◎ | ◎ | ○ |
| Inventive photoreceptor 170 | ◎ | ◎ | ◎ |
| Inventive photoreceptor 171 | ◎ | ○ | ○ |
| Inventive photoreceptor 172 | ◎ | ◎ | ◎ |
| Inventive photoreceptor 173 | ◎ | ◎ | ◎ |
| Inventive photoreceptor 174 | ◎ | ◎ | ◎ |
| Inventive photoreceptor 175 | ◎ | ◎ | ◎ |
| Comparative photoreceptor 41 | ○ | Δ | X |
| Comparative photoreceptor 42 | ○ | Δ | X |

As described above, when any electrophotographic photoreceptor relating to the invention is incorporated into a copier or printer and is then used repeatedly, every highly photoreceptive and excellent image can be provided without producing any image defect or image failure such as white-dots, black-dots, fog and density lowering.

Even when any electrophotographic photoreceptor relating to the invention is incorporated into a copier or printer and then used repeatedly, every excellent image can be provided with a reduced residual potential and without producing any image defect and image failure.

EXAMPLE 176

Next, an example different from the above-given examples, in which the invention was applied to an electroluminescence (EL), will be detailed.

Over to a transparent electrode (that was a layer made of indium and tin oxide) formed on a glass-made substrate, Exemplified Compound No.6 was so vacuum-evaporated as to serve as the electric charge injecting layer so that the thickness thereof could be 500 Å. Next, an 8-quinolinol Al complex ($Alq_3$) was vacuum-evaporated so as to serve as the organic fluorescent layer so that the thickness thereof could be 600 Å. Further, a magnesium/silver alloy was vacuum-evaporated thereon so as to serve as the negative electrode thereof.

When checking up the light emitting characteristics of the resulting thin organic EL element, a light emission of 0.04 $mW/cm^2$ could be obtained at 4 $mA/cm^2$. The emitted light was in yellowish green.

EXAMPLE 177

A thin organic EL element was prepared in the same manner as in Example 176, except that the electric-charge injecting layer used in Example 176 was replaced by Exemplified Compound No. (14) having 500 Å so as to serve as the electric-charge injecting layer thereof, (provided, therein the negative electrode was made of a magnesium/aluminium alloy). When checking up the resulting light emitting characteristics thereof, the resulting light emission of 0.05 $mW/cm^2$ could be obtained at 5 $mA/cm^2$. The emitted light was in yellowish green.

EXAMPLE 178

A thin organic EL element was prepared in the same manner as in Example 176, except that the electric-charge injecting layer used in Example 176 was replaced by Exemplified Compound No. [21] having 500 Å so as to serve as the electric-charge injecting layer thereof, (provided, therein the negative electrode was made of a magnesium/aluminium alloy). When checking up the resulting light emitting characteristics thereof, the resulting light emission of 0.06 $mW/cm^2$ could be obtained at 6 $mA/cm^2$. The emitted light was in yellowish green.

Examples of Compounds having Formula [I]

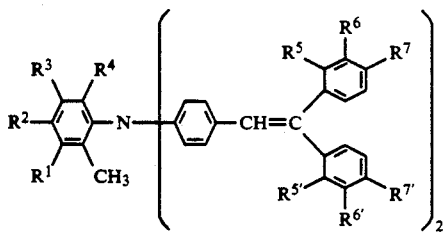

| No. | $R^1$ | $R^2$ | $R^3$ | $R^4$ | $R^5$ | $R^6$ | $R^7$ | $R^{5'}$ | $R^{6'}$ | $R^{7'}$ |
|---|---|---|---|---|---|---|---|---|---|---|
| 1 | $CH_3$ | H | H | H | $CH_3$ | H | H | H | H | H |
| 2 | $CH_3$ | H | H | H | H | $CH_3$ | H | H | H | H |
| 3 | $CH_3$ | H | H | H | H | H | $CH_3$ | H | H | H |
| 4 | H | $CH_3$ | H | H | $CH_3$ | H | H | H | H | H |
| 5 | H | $CH_3$ | H | H | H | $CH_3$ | H | H | H | H |
| 6 | H | $CH_3$ | H | H | H | H | $CH_3$ | H | H | H |
| 7 | H | H | $CH_3$ | H | $CH_3$ | H | H | H | H | H |
| 8 | H | H | $CH_3$ | H | H | $CH_3$ | H | H | H | H |
| 9 | H | H | $CH_3$ | H | H | H | $CH_3$ | H | H | H |
| 10 | H | H | H | $CH_3$ | $CH_3$ | H | H | H | H | H |
| 11 | H | H | H | $CH_3$ | H | $CH_3$ | H | H | H | H |
| 12 | H | H | H | $CH_3$ | H | H | $CH_3$ | H | H | H |

Examples of Compounds having Formula [I]

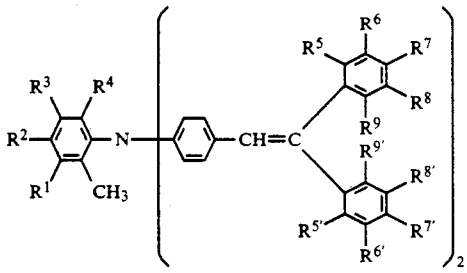

| No. | $R^1$-$R^4$ | $R^5$-$R^9$ | $R^{5'}$-$R^{9'}$ |
|---|---|---|---|
| 13 | 3-$CH_3$ | 2-$C_2H_5$ | H |
| 14 | 3-$CH_3$ | 3-$C_2H_5$ | H |
| 15 | 3-$CH_3$ | 4-$C_2H_5$ | H |
| 16 | 3-$CH_3$ | 4-$C_2H_5$ | 4-$C_2H_5$ |
| 17 | 3-$CH_3$ | 2-F | H |
| 18 | 3-$CH_3$ | 3-F | H |
| 19 | 3-$CH_3$ | 4-F | H |
| 20 | 3-$CH_3$ | 2-Cl | 2, 4-di-$CH_3$ |
| 21 | 3-$CH_3$ | 4-Cl | H |
| 22 | 3-$CH_3$ | 3-Br | H |
| 23 | 3-$CH_3$ | 4-I | H |
| 24 | 3-$CH_3$ | 4-$CF_3$ | H |
| 25 | 3-$CH_3$ | 4-CN | H |
| 26 | 3-$CH_3$ | 4-$CH_2COOCH_3$ | H |
| 27 | 3-$CH_3$ | 3-$OCOC_2H_5$ | H |
| 28 | 3-$CH_3$ | 3-$C_2H_5$ | 4-$C_2H_5$ |
| 29 | 3-$CH_3$ | 2-$CH_3$, 4-Cl | H |
| 30 | 3-$CH_3$ | 4-N($C_2H_5$)$_2$ | H |
| 31 | 3-$CH_3$ | 4-$OCH_3$ | H |
| 32 | 3-$CH_3$ | 4-$OCH_3$ | 4-$OCH_3$ |
| 33 | 3-$CH_3$ | 4-$OC_2H_5$ | H |

Examples of Compounds having Formula [I]

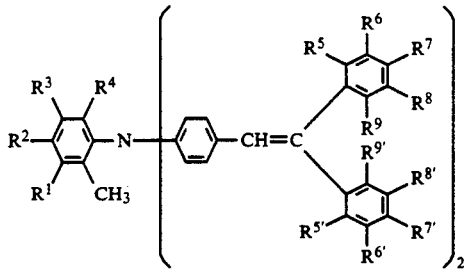

| No. | $R^1$-$R^4$ | $R^5$-$R^9$ | $R^{5'}$-$R^{9'}$ |
|---|---|---|---|
| 34 | 4-$CH_3$ | 4-$OCH_3$ | H |
| 35 | 4-$CH_3$ | 4-$OCH_3$ | 4-$OCH_3$ |
| 36 | 4-$CH_3$ | 4-$OCH_3$ | 4-$CH_3$ |
| 37 | 4-$CH_3$ | 4-Cl | H |
| 38 | 4-$CH_3$ | 3-Br | H |
| 39 | 4-$CH_3$ | 2-CN | H |
| 40 | 4-$CH_3$ | 3-$C_2H_4COOCH_3$ | H |
| 41 | 4-$CH_3$ | 3-$CF_3$ | H |
| 42 | 4-$CH_3$ | 4-N(C$_6$H$_5$)$_2$ | H |
| 43 | 4-$CH_3$ | 3-N(CH$_2$C$_6$H$_5$)$_2$ | H |
| 44 | 4-$CH_3$ | 4-C$_6$H$_5$ | H |
| 45 | 4-$CH_3$ | 4-Cl | 4-Cl |
| 46 | 4-$CH_3$ | 2,3,4,5,6-per-F | H |
| 47 | 4-$CH_3$ | 2,4-di-Cl | H |
| 48 | 4-$CH_3$ | 4-$C_2H_5$ | 4-$C_2H_5$ |
| 49 | 4-$CH_3$ | 3,4,5-tri-$OCH_3$ | H |
| 50 | 4-$CH_3$ | 4-OH | H |
| 51 | 4-$CH_3$ | 2,4-di-$OCH_3$ | H |
| 52 | 4-$CH_3$ | 4-Cl | 3-Br |
| 53 | 4-$CH_3$ | 4-$CH_3$ | 3-Cl |
| 54 | 4-$CH_3$ | 2,4-di-$CH_3$ | 4-$OCH_3$ |

Examples of Compounds having Formula [I]

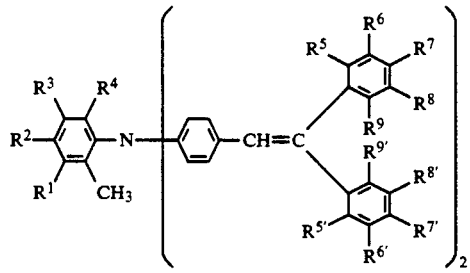

| No. | $R^1$-$R^4$ | $R^5$-$R^9$ | $R^{5'}$-$R^{9'}$ |
|---|---|---|---|
| 55 | 5-$CH_3$ | 4-$OCH_3$ | H |
| 56 | 5-$CH_3$ | 4-$OCH_3$ | 4-$OCH_3$ |
| 57 | 5-$CH_3$ | 4-Cl | H |
| 58 | 5-$CH_3$ | 3-Cl | H |
| 59 | 5-$CH_3$ | 2-Cl | H |
| 60 | 5-$CH_3$ | 4-Cl | 4-Cl |

-continued
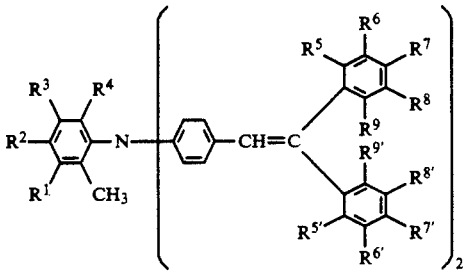
| No. | $R^1$-$R^4$ | $R^5$-$R^9$ | $R^{5'}$-$R^{9'}$ |
|---|---|---|---|
| 61 | 5-$CH_3$ | 4-N($C_2H_5$)($C_2H_5$) | H |
| 62 | 5-$CH_3$ | 4-$CF_3$ | H |
| 63 | 5-$CH_3$ | 4-CN | H |
| 64 | 5-$CH_3$ | 4-(phenyl) | H |
| 65 | 5-$CH_3$ | 2,4-di-Cl | H |
| 66 | 6-$CH_3$ | 4-$OCH_3$ | H |
| 67 | 6-$CH_3$ | 4-$OCH_3$ | 4-$OCH_3$ |
| 68 | 6-$CH_3$ | 4-Cl | H |
| 69 | 6-$CH_3$ | 3-Br | H |
| 70 | 6-$CH_3$ | 4-I | 4-$CH_3$ |
| 71 | 6-$CH_3$ | 2,4-di-F | H |
| 72 | 6-$CH_3$ | 2-$CH_3$ | 4-Cl |
| 73 | 6-$CH_3$ | 2-CN | 4-CN |
| 74 | 6-$CH_3$ | 4-N($CH_3$)($C_2H_5$) | H |
| 75 | 6-$CH_3$ | 4-$OCH_2$-(phenyl) | H |
Examples of Compounds having Formula [I]
No. 76
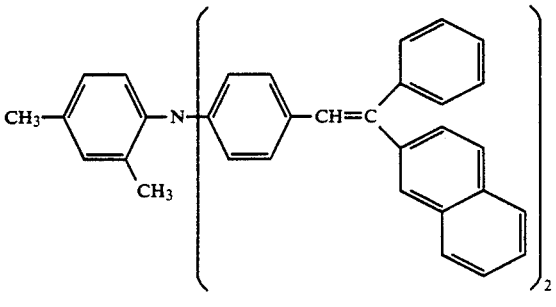
-continued
No. 77
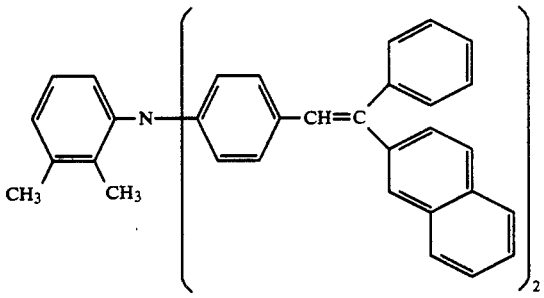
No. 78
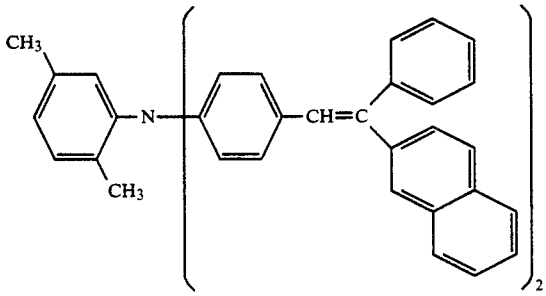
No. 79
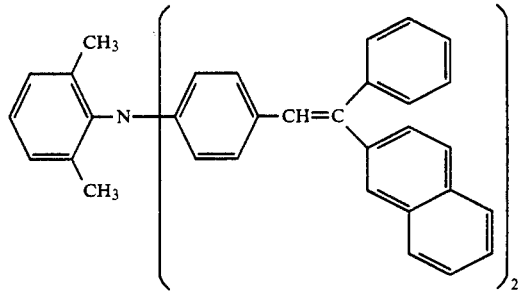
Examples of Compounds having Formula [I]
No. 80
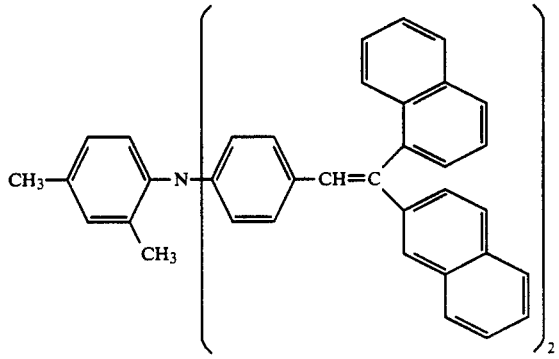

-continued
No. 81
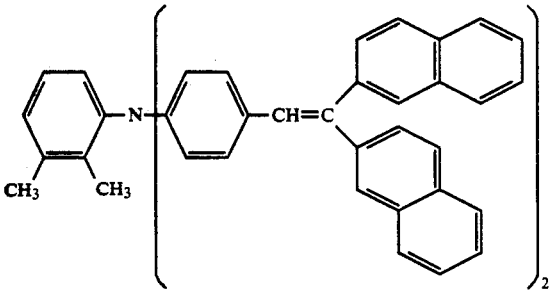
No. 82
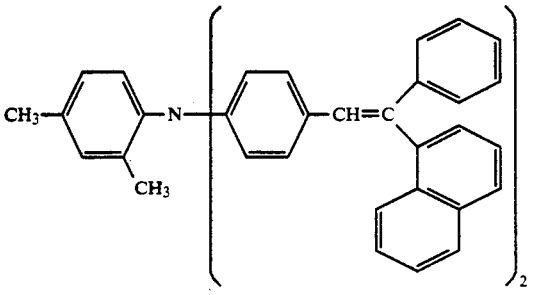
No. 83
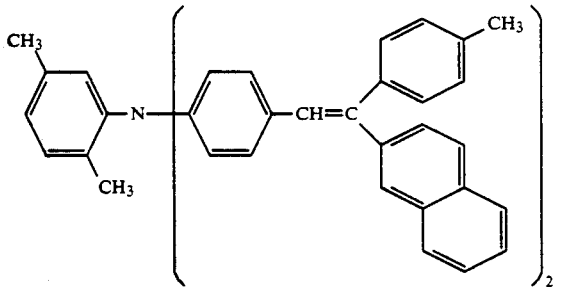
Examples of Compounds having Formula [I]
No. 84
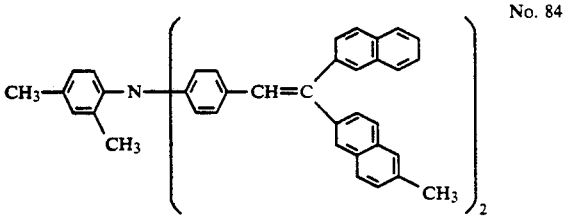
No. 85
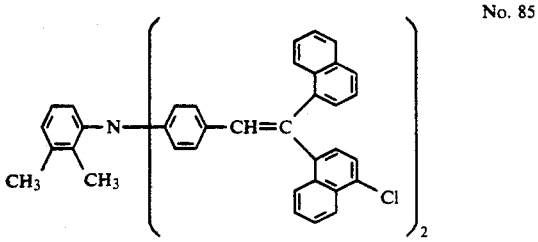
-continued
No. 86
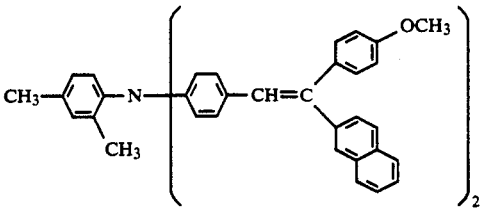
No. 87
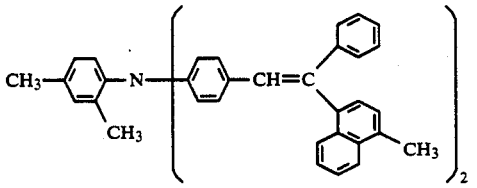
Synthesis Example: Synthesis of Exemplified Compound No. 6
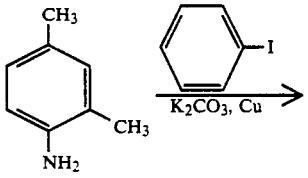
1
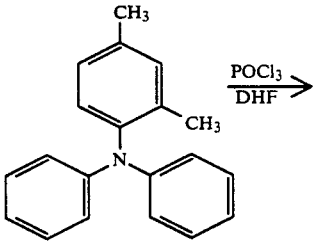
2
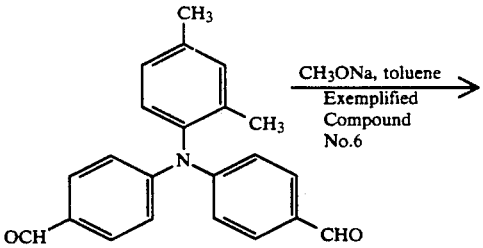
3
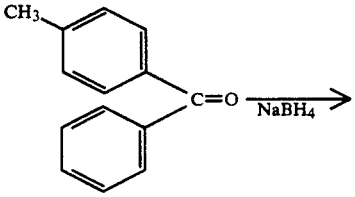
4

-continued

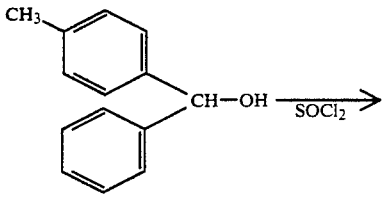

5

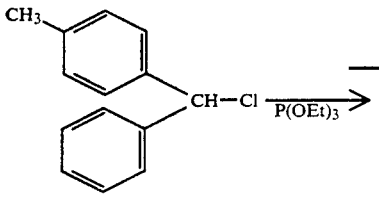

6

-continued

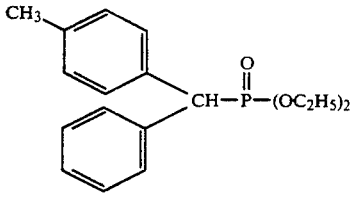

7

Examples of Compounds having Formula [II]

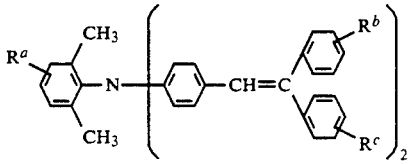

| Compound No. | $R^a$ | $R^b$ | $R^c$ |
|---|---|---|---|
| (1) | 3rd positioned $CH_3$, 4–5th positioned H | 1–6th positioned H | 1–6th positioned H |
| (2) | 3rd positioned $CH_3$, 4–5th positioned H | 1–6th positioned H | 2nd positioned $CH_3$, the other positioned Hs |
| (3) | 3rd positioned $CH_3$, 4–5th positioned H | 1–6th positioned H | 3rd positioned $CH_3$, the other positioned Hs |
| (4) | 3rd positioned $CH_3$, 4–5th positioned H | 1–6th positioned H | 4th positioned $CH_3$, the other positioned Hs |
| (5) | 3rd positioned $CH_3$, 4–5th positioned H | 2nd positioned $CH_3$, the other positioned Hs | 2nd positioned $CH_3$, the other positioned Hs |
| (6) | 3rd positioned $CH_3$, 4–5th positioned H | 2nd positioned $CH_3$, the other positioned Hs | 3rd positioned $CH_3$, the other positioned Hs |
| (7) | 3rd positioned $CH_3$, 4–5th positioned H | 2nd positioned $CH_3$, the other positioned Hs | 4th positioned $CH_3$, the other positioned Hs |
| (8) | 3rd positioned $CH_3$, 4–5th positioned H | 3rd positioned $CH_3$, the other positioned Hs | 3rd positioned $CH_3$, the other positioned Hs |
| (9) | 3rd positioned $CH_3$, 4–5th positioned H | 3rd positioned $CH_3$, the other positioned Hs | 4th positioned $CH_3$, the other positioned Hs |
| (10) | 3rd positioned $CH_3$, 4–5th positioned H | 4th positioned $CH_3$, the other positioned Hs | 4th positioned $CH_3$, the other positioned Hs |
| (11) | 4th positioned $CH_3$, 3–5th positioned H | 1–6th positioned H | 1–6th positioned H |
| (12) | 4th positioned $CH_3$, 3–5th positioned H | 1–6th positioned H | 2nd positioned $CH_3$, the other positioned Hs |
| (13) | 4th positioned $CH_3$, 3–5th positioned H | 1–6th positioned H | 3rd positioned $CH_3$, the other positioned Hs |
| (14) | 4th positioned $CH_3$, 3–5th positioned H | 1–6th positioned H | 4th positioned $CH_3$, the other positioned Hs |
| (15) | 4th positioned $CH_3$, 3–5th positioned H | 2nd positioned $CH_3$, the other positioned Hs | 2nd positioned $CH_3$, the other positioned Hs |
| (16) | 4th positioned $CH_3$, 3–5th positioned H | 2nd positioned $CH_3$, the other positioned Hs | 3rd positioned $CH_3$, the other positioned Hs |
| (17) | 4th positioned $CH_3$, 3–5th positioned H | 2nd positioned $CH_3$, the other positioned Hs | 4th positioned $CH_3$, the other positioned Hs |
| (18) | 4th positioned $CH_3$, 3–5th positioned H | 3rd positioned $CH_3$, the other positioned Hs | 3rd positioned $CH_3$, the other positioned Hs |
| (19) | 4th positioned $CH_3$, 3–5th positioned H | 3rd positioned $CH_3$, the other positioned Hs | 4th positioned $CH_3$, the other positioned Hs |
| (20) | 4th positioned $CH_3$, 3–5th positioned H | 4th positioned $CH_3$, the other positioned Hs | 4th positioned $CH_3$, the other positioned Hs |

Examples of Compounds having Formula [II]

(21)
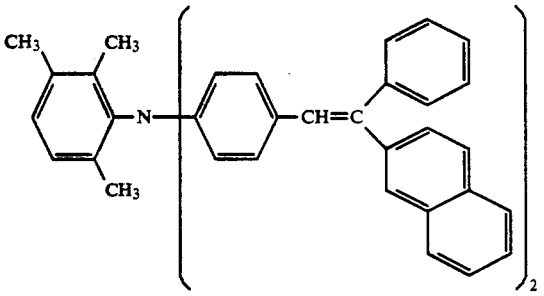
(22)
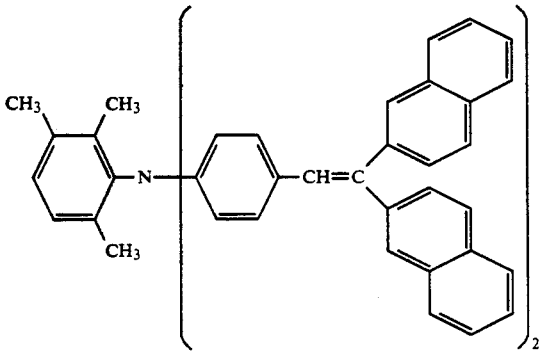
(23)
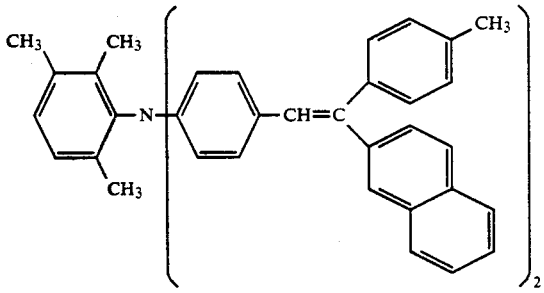
(24)
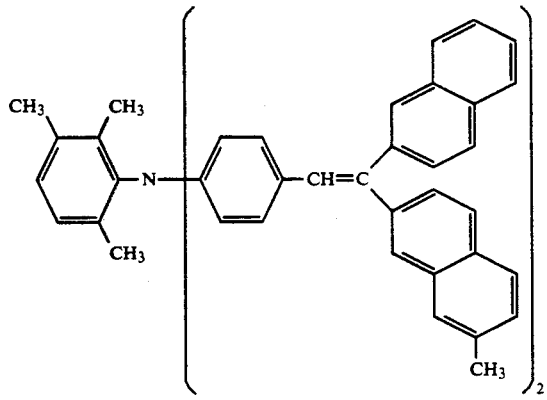
Examples of Compounds having Formula [II]
(25)
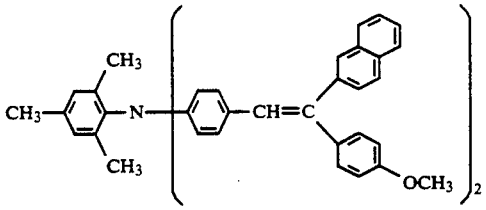
(26)
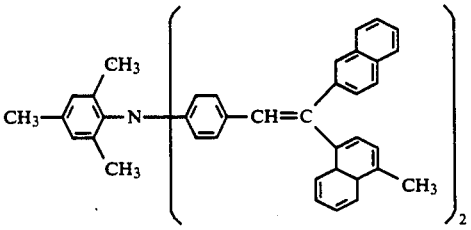
(27)
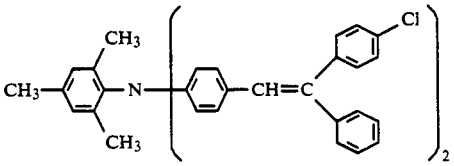
(28)
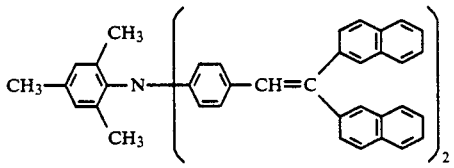
Examples of Compounds having Formula [II]
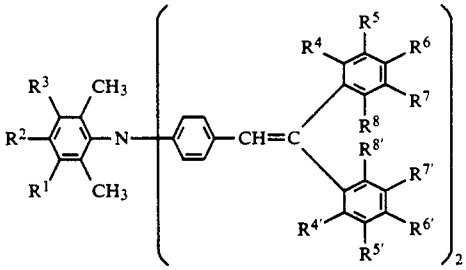
| No. | $R^1$-$R^3$ | $R^4$-$R^8$ | $R^{4'}$-$R^{8'}$ |
|---|---|---|---|
| (29) | 3-$CH_3$ | 4-$C_2H_5$ | H |
| (30) | 3-$CH_3$ | 5-$C_2H_5$ | H |
| (31) | 3-$CH_3$ | 6-$C_2H_5$ | H |
| (32) | 3-$CH_3$ | 6-$C_2H_5$ | 6'-$C_2H_5$ |
| (33) | 3-$CH_3$ | 4-F | H |
| (34) | 3-$CH_3$ | 5-F | H |
| (35) | 3-$CH_3$ | 6-F | H |
| (36) | 3-$CH_3$ | 4-Cl | 4',6'-di-$CH_3$ |
| (37) | 3-$CH_3$ | 6-Cl | H |
| (38) | 3-$CH_3$ | 5-Br | H |
| (39) | 3-$CH_3$ | 6-I | H |
| (40) | 3-$CH_3$ | 6-$CF_3$ | H |
| (41) | 3-$CH_3$ | 6-CN | H |
| (42) | 3-$CH_3$ | 6-$CH_2COOCH_3$ | H |
| (43) | 3-$CH_3$ | 5-$OCOC_2H_5$ | H |
| (44) | 3-$CH_3$ | 5,6-di-$CH_3$ | H |
| (45) | 3-$CH_3$ | 4-$CH_3$,6-Cl | H |

-continued

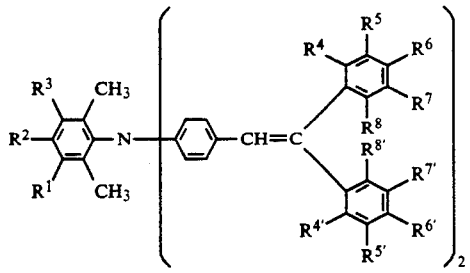

| No. | $R^1$-$R^3$ | $R^4$-$R^8$ | $R^{4'}$-$R^{8'}$ |
|---|---|---|---|
| (46) | 3-$CH_3$ | 6-N(C$_2$H$_5$)$_2$ | H |
| (47) | 3-$CH_3$ | 6-$OCH_3$ | H |
| (48) | 3-$CH_3$ | 6-$OCH_3$ | 6'-$OCH_3$ |
| (49) | 3-$CH_3$ | 6-$OC_2H_5$ | H |

Examples of Compounds having Formula [II]

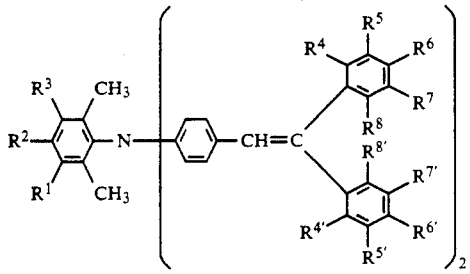

| No. | $R^1$-$R^3$ | $R^4$-$R^8$ | $R^{4'}$-$R^{8'}$ |
|---|---|---|---|
| (50) | 4-$CH_3$ | 6-$OCH_3$ | H |
| (51) | 4-$CH_3$ | 6-$OCH_3$ | 6'-$OCH_3$ |
| (52) | 4-$CH_3$ | 6-$OCH_3$ | 6'-$CH_3$ |
| (53) | 4-$CH_3$ | 6-Cl | H |
| (54) | 4-$CH_3$ | 5-Br | H |
| (55) | 4-$CH_3$ | 4-CN | H |
| (56) | 4-$CH_3$ | 5-$C_2H_4COOCH_3$ | H |
| (57) | 4-$CH_3$ | 5-$CF_3$ | H |
| (58) | 4-$CH_3$ | 6-N(C$_6$H$_5$)$_2$ | H |
| (59) | 4-$CH_3$ | 5-N(CH$_2$—C$_6$H$_5$)$_2$ | H |
| (60) | 4-$CH_3$ | 6—C$_6$H$_5$ | H |
| (61) | 4-$CH_3$ | 6-Cl | 6'-Cl |
| (62) | 4-$CH_3$ | 4,5,6,7,8-per-F | H |
| (63) | 4-$CH_3$ | 4,6-di-Cl | H |
| (64) | 4-$CH_3$ | 6-$C_2H_5$ | 6'-$C_2H_5$ |
| (65) | 4-$CH_3$ | 5,6,7-tri-$OCH_3$ | H |
| (66) | 4-$CH_3$ | 6-OH | H |
| (67) | 4-$CH_3$ | 4,6-di-$OCH_3$ | H |
| (68) | 4-$CH_3$ | 6-Cl | 5'-Br |
| (69) | 4-$CH_3$ | 6-$CH_3$ | 5'-Cl |

-continued

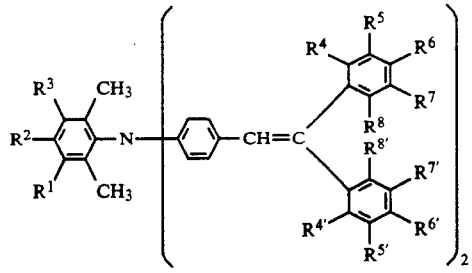

| No. | $R^1$-$R^3$ | $R^4$-$R^8$ | $R^{4'}$-$R^{8'}$ |
|---|---|---|---|
| (70) | 4-$CH_3$ | 4,6-di-$CH_3$ | 6'-$OCH_3$ |

Examples of Compounds having Formula [III]

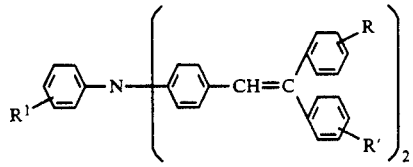

| Compound No. | $R^1$ | R | R' |
|---|---|---|---|
| [1] | O—$C_2H_5$ | o-$CH_3$ | H |
| [2] | O—$C_2H_5$ | m-$CH_3$ | H |
| [3] | O—$C_2H_5$ | p-$CH_3$ | H |
| [4] | O—$C_2H_5$ | o-$CH_3$ | o-$CH_3$ |
| [5] | O—$C_2H_5$ | m-$CH_3$ | m-$CH_3$ |
| [6] | O—$C_2H_5$ | p-$CH_3$ | p-$CH_3$ |
| [7] | O—$C_2H_5$ | o-$CH_3$ | m-$CH_3$ |
| [8] | O—$C_2H_5$ | o-$CH_3$ | p-$CH_3$ |
| [9] | O—$C_2H_5$ | m-$CH_3$ | p-$CH_3$ |
| [10] | m-$C_2H_5$ | o-$CH_3$ | H |
| [11] | m-$C_2H_5$ | m-$CH_3$ | H |
| [12] | m-$C_2H_5$ | p-$CH_3$ | H |
| [13] | m-$C_2H_5$ | o-$CH_3$ | o-$CH_3$ |
| [14] | m-$C_2H_5$ | m-$CH_3$ | m-$CH_3$ |
| [15] | m-$C_2H_5$ | p-$CH_3$ | p-$CH_3$ |
| [16] | m-$C_2H_5$ | o-$CH_3$ | m-$CH_3$ |
| [17] | m-$C_2H_5$ | o-$CH_3$ | p-$CH_3$ |
| [18] | m-$C_2H_5$ | m-$CH_3$ | p-$CH_3$ |

Examples of Compounds having Formula [III]

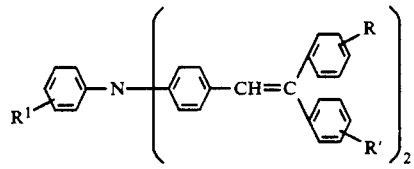

| Compound No. | $R^1$ | R | R' |
|---|---|---|---|
| [19] | P—$C_2H_5$ | o-$CH_3$ | H |
| [20] | P—$C_2H_5$ | m-$CH_3$ | H |
| [21] | P—$C_2H_5$ | p-$CH_3$ | H |
| [22] | P—$C_2H_5$ | o-$CH_3$ | o-$CH_3$ |
| [23] | P—$C_2H_5$ | m-$CH_3$ | m-$CH_3$ |
| [24] | P—$C_2H_5$ | p-$CH_3$ | p-$CH_3$ |
| [25] | P—$C_2H_5$ | o-$CH_3$ | m-$CH_3$ |
| [26] | P—$C_2H_5$ | o-$CH_3$ | p-$CH_3$ |
| [27] | P—$C_2H_5$ | m-$CH_3$ | p-$CH_3$ |
| [28] | o-n-$C_3H_7$ | o-$CH_3$ | H |
| [29] | o-n-$C_3H_7$ | m-$CH_3$ | H |
| [30] | o-n-$C_3H_7$ | p-$CH_3$ | H |
| [31] | o-n-$C_3H_7$ | o-$CH_3$ | o-$CH_3$ |

-continued

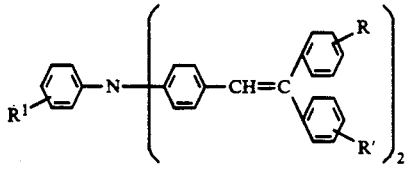

| Compound No. | $R^1$ | R | R' |
|---|---|---|---|
| [32] | o-n-$C_3H_7$ | m-$CH_3$ | m-$CH_3$ |
| [33] | o-n-$C_3H_7$ | p-$CH_3$ | p-$CH_3$ |
| [34] | o-n-$C_3H_7$ | o-$CH_3$ | m-$CH_3$ |
| [35] | o-n-$C_3H_7$ | o-$CH_3$ | p-$CH_3$ |
| [36] | o-n-$C_3H_7$ | m-$CH_3$ | p-$CH_3$ |

Examples of Compounds having Formula [III]

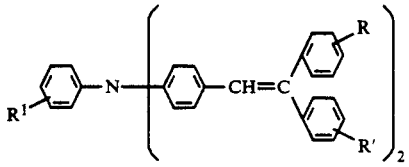

| Compound No. | $R^1$ | R | R' |
|---|---|---|---|
| [37] | m-$C_3H_7$ | o-$CH_3$ | H |
| [38] | m-$C_3H_7$ | m-$CH_3$ | H |
| [39] | m-$C_3H_7$ | p-$CH_3$ | H |
| [40] | m-$C_3H_7$ | o-$CH_3$ | o-$CH_3$ |
| [41] | m-$C_3H_7$ | m-$CH_3$ | m-$CH_3$ |
| [42] | m-$C_3H_7$ | p-$CH_3$ | p-$CH_3$ |
| [43] | m-$C_3H_7$ | o-$CH_3$ | m-$CH_3$ |
| [44] | m-$C_3H_7$ | o-$CH_3$ | p-$CH_3$ |
| [45] | m-$C_3H_7$ | m-$CH_3$ | p-$CH_3$ |
| [46] | p-$C_3H_7$ | o-$CH_3$ | H |
| [47] | p-$C_3H_7$ | m-$CH_3$ | H |
| [48] | p-$C_3H_7$ | p-$CH_3$ | H |
| [49] | p-$C_3H_7$ | o-$CH_3$ | o-$CH_3$ |
| [50] | p-$C_3H_7$ | m-$CH_3$ | m-$CH_3$ |
| [51] | p-$C_3H_7$ | p-$CH_3$ | p-$CH_3$ |
| [52] | p-$C_3H_7$ | o-$CH_3$ | m-$CH_3$ |
| [53] | p-$C_3H_7$ | o-$CH_3$ | p-$CH_3$ |
| [54] | p-$C_3H_7$ | m-$CH_3$ | p-$CH_3$ |

Examples of Compounds having Formula [III]

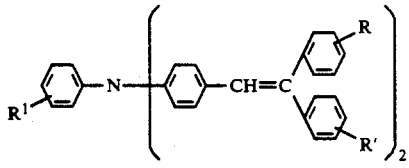

| Compound No. | $R^1$ | R | R' |
|---|---|---|---|
| [55] | o-iso$C_3H_7$ | o-$CH_3$ | H |
| [56] | o-iso$C_3H_7$ | m-$CH_3$ | H |
| [57] | o-iso$C_3H_7$ | p-$CH_3$ | H |
| [58] | o-iso$C_3H_7$ | o-$CH_3$ | o-$CH_3$ |
| [59] | o-iso$C_3H_7$ | m-$CH_3$ | m-$CH_3$ |
| [60] | o-iso$C_3H_7$ | p-$CH_3$ | p-$CH_3$ |
| [61] | o-iso$C_3H_7$ | o-$CH_3$ | m-$CH_3$ |
| [62] | o-iso$C_3H_7$ | o-$CH_3$ | p-$CH_3$ |
| [63] | o-iso$C_3H_7$ | m-$CH_3$ | p-$CH_3$ |
| [64] | m-iso$C_3H_7$ | o-$CH_3$ | H |
| [65] | m-iso$C_3H_7$ | m-$CH_3$ | H |
| [66] | m-iso$C_3H_7$ | p-$CH_3$ | H |
| [67] | m-iso$C_3H_7$ | o-$CH_3$ | o-$CH_3$ |

-continued

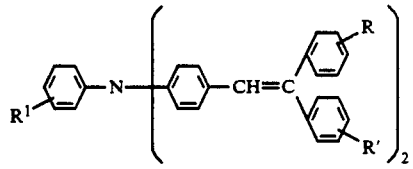

| Compound No. | $R^1$ | R | R' |
|---|---|---|---|
| [68] | m-iso$C_3H_7$ | m-$CH_3$ | m-$CH_3$ |
| [69] | m-iso$C_3H_7$ | p-$CH_3$ | p-$CH_3$ |
| [70] | m-iso$C_3H_7$ | o-$CH_3$ | m-$CH_3$ |
| [71] | m-iso$C_3H_7$ | o-$CH_3$ | p-$CH_3$ |
| [72] | m-iso$C_3H_7$ | m-$CH_3$ | p-$CH_3$ |

Examples of Compounds having Formula [III]

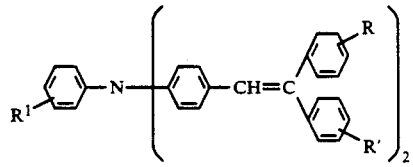

| Compound No. | $R^1$ | R | R' |
|---|---|---|---|
| [73] | p-iso$C_3H_7$ | o-$CH_3$ | H |
| [74] | p-iso$C_3H_7$ | m-$CH_3$ | H |
| [75] | p-iso$C_3H_7$ | p-$CH_3$ | H |
| [76] | p-iso$C_3H_7$ | o-$CH_3$ | o-$CH_3$ |
| [77] | p-iso$C_3H_7$ | m-$CH_3$ | m-$CH_3$ |
| [78] | p-iso$C_3H_7$ | p-$CH_3$ | p-$CH_3$ |
| [79] | p-iso$C_3H_7$ | o-$CH_3$ | m-$CH_3$ |
| [80] | p-iso$C_3H_7$ | o-$CH_3$ | p-$CH_3$ |
| [81] | p-iso$C_3H_7$ | m-$CH_3$ | p-$CH_3$ |
| [82] | o-n-$C_4H_9$ | o-$CH_3$ | H |
| [83] | o-n-$C_4H_9$ | m-$CH_3$ | H |
| [84] | o-n-$C_4H_9$ | p-$CH_3$ | H |
| [85] | o-n-$C_4H_9$ | o-$CH_3$ | o-$CH_3$ |
| [86] | o-n-$C_4H_9$ | m-$CH_3$ | m-$CH_3$ |
| [87] | o-n-$C_4H_9$ | p-$CH_3$ | p-$CH_3$ |
| [88] | o-n-$C_4H_9$ | o-$CH_3$ | m-$CH_3$ |
| [89] | o-n-$C_4H_9$ | o-$CH_3$ | p-$CH_3$ |
| [90] | o-n-$C_4H_9$ | m-$CH_3$ | p-$CH_3$ |

Examples of Compounds having Formula [III]

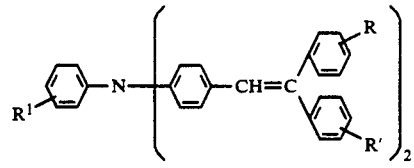

| Compound No. | $R^1$ | R | R' |
|---|---|---|---|
| [91] | m-n-$C_4H_9$ | o-$CH_3$ | H |
| [92] | m-n-$C_4H_9$ | m-$CH_3$ | H |
| [93] | m-n-$C_4H_9$ | p-$CH_3$ | H |
| [94] | m-n-$C_4H_9$ | o-$CH_3$ | o-$CH_3$ |
| [95] | m-n-$C_4H_9$ | m-$CH_3$ | m-$CH_3$ |
| [96] | m-n-$C_4H_9$ | p-$CH_3$ | p-$CH_3$ |
| [97] | m-n-$C_4H_9$ | o-$CH_3$ | m-$CH_3$ |
| [98] | m-n-$C_4H_9$ | o-$CH_3$ | p-$CH_3$ |
| [99] | m-n-$C_4H_9$ | m-$CH_3$ | p-$CH_3$ |
| [100] | p-n-$C_4H_9$ | o-$CH_3$ | H |
| [101] | p-n-$C_4H_9$ | m-$CH_3$ | H |
| [102] | p-n-$C_4H_9$ | p-$CH_3$ | H |
| [103] | p-n-$C_4H_9$ | o-$CH_3$ | o-$CH_3$ |

-continued

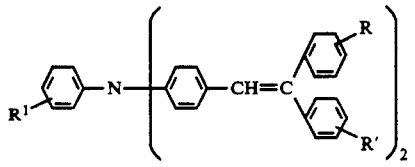

| Compound No. | $R^1$ | R | R' |
|---|---|---|---|
| [104] | p-n-$C_4H_9$ | m-$CH_3$ | m-$CH_3$ |
| [105] | p-n-$C_4H_9$ | p-$CH_3$ | p-$CH_3$ |
| [106] | p-n-$C_4H_9$ | o-$CH_3$ | m-$CH_3$ |
| [107] | p-n-$C_4H_9$ | o-$CH_3$ | p-$CH_3$ |
| [108] | p-n-$C_4H_9$ | m-$CH_3$ | p-$CH_3$ |

Examples of Compounds having Formula [III]

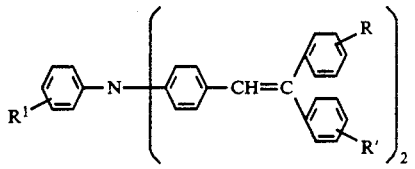

| Compound No. | $R^1$ | R | R' |
|---|---|---|---|
| [109] | o-ter$C_4H_9$ | o-$CH_3$ | H |
| [110] | o-ter$C_4H_9$ | m-$CH_3$ | H |
| [111] | o-ter$C_4H_9$ | p-$CH_3$ | H |
| [112] | o-ter$C_4H_9$ | o-$CH_3$ | o-$CH_3$ |
| [113] | o-ter$C_4H_9$ | m-$CH_3$ | m-$CH_3$ |
| [114] | o-ter$C_4H_9$ | p-$CH_3$ | p-$CH_3$ |
| [115] | o-ter$C_4H_9$ | o-$CH_3$ | m-$CH_3$ |
| [116] | o-ter$C_4H_9$ | o-$CH_3$ | p-$CH_3$ |
| [117] | o-ter$C_4H_9$ | m-$CH_3$ | p-$CH_3$ |
| [118] | m-ter$C_4H_9$ | o-$CH_3$ | H |
| [119] | m-ter$C_4H_9$ | m-$CH_3$ | H |
| [120] | m-ter$C_4H_9$ | p-$CH_3$ | H |
| [121] | m-ter$C_4H_9$ | o-$CH_3$ | o-$CH_3$ |
| [122] | m-ter$C_4H_9$ | m-$CH_3$ | m-$CH_3$ |
| [123] | m-ter$C_4H_9$ | p-$CH_3$ | p-$CH_3$ |
| [124] | m-ter$C_4H_9$ | o-$CH_3$ | m-$CH_3$ |
| [125] | m-ter$C_4H_9$ | o-$CH_3$ | p-$CH_3$ |
| [126] | m-ter$C_4H_9$ | m-$CH_3$ | p-$CH_3$ |

Examples of Compounds having Formula [III]

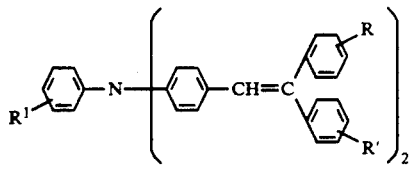

| Compound No. | $R^1$ | R | R' |
|---|---|---|---|
| [127] | p-ter$C_4H_9$ | o-$CH_3$ | H |
| [128] | p-ter$C_4H_9$ | m-$CH_3$ | H |
| [129] | p-ter$C_4H_9$ | p-$CH_3$ | H |
| [130] | p-ter$C_4H_9$ | o-$CH_3$ | o-$CH_3$ |
| [131] | p-ter$C_4H_9$ | m-$CH_3$ | m-$CH_3$ |
| [132] | p-ter$C_4H_9$ | p-$CH_3$ | p-$CH_3$ |
| [133] | p-ter$C_4H_9$ | o-$CH_3$ | m-$CH_3$ |
| [134] | p-ter$C_4H_9$ | o-$CH_3$ | p-$CH_3$ |
| [135] | p-ter$C_4H_9$ | m-$CH_3$ | p-$CH_3$ |

Examples of Compounds having Formula [III]

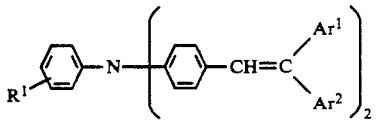

| Compound No. | $R^1$ | $Ar^1$ | $Ar^2$ |
|---|---|---|---|
| [136] | p-$C_2H_5$ | 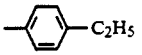 | 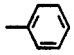 |
| [137] | p-$C_2H_5$ | 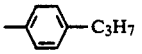 | 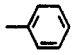 |
| [138] | p-$C_2H_5$ | 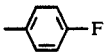 | 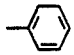 |
| [139] | p-$C_2H_5$ | 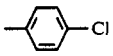 | 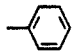 |
| [140] | p-$C_2H_5$ | 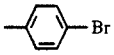 | 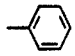 |
| [141] | p-$C_2H_5$ | 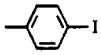 | 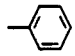 |
| [142] | p-$C_2H_5$ | 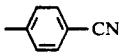 | 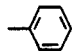 |
| [143] | p-$C_2H_5$ | 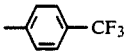 | 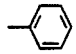 |
| [144] | p-$C_2H_5$ | 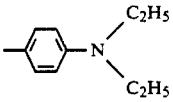 | 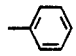 |
| [145] | p-$C_2H_5$ | 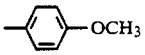 | 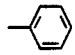 |

Examples of Compounds having Formula [III]

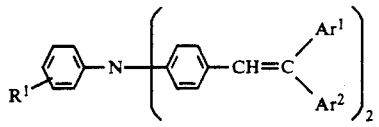

| Compound No. | $R^1$ | $Ar^1$ | $Ar^2$ |
|---|---|---|---|
| [146] | p-$C_2H_5$ | 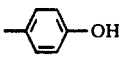 | 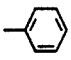 |
| [147] | p-$C_2H_5$ | 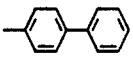 | 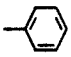 |
| [148] | p-$C_3H_7$ | 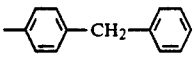 | 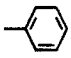 |
| [149] | p-$C_3H_7$ | 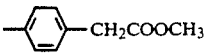 | 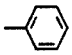 |

-continued

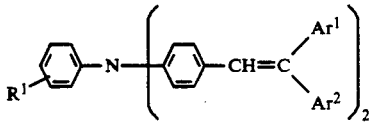

| Compound No. | $R^1$ | $Ar^1$ | $Ar^2$ |
|---|---|---|---|
| [150] | p-$C_2H_5$ | 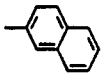 | 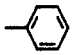 |
| [151] | p-$C_2H_5$ | 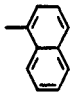 | 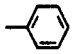 |
| [152] | p-$C_2H_5$ | 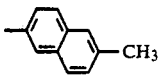 | 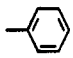 |
| [153] | p-$C_2H_5$ | 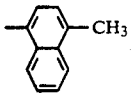 | 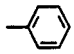 |
| [154] | p-$C_2H_5$ | 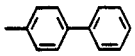 | 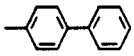 |
| [155] | p-$C_2H_5$ | 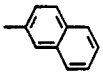 | 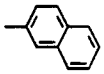 |

Examples of Compounds having Formula [III]

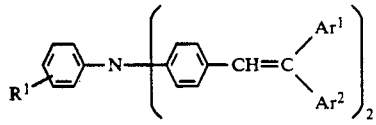

| Compound No. | $R^1$ | $Ar^1$ | $Ar^2$ |
|---|---|---|---|
| [156] | p-$C_2H_5$ | 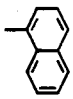 | 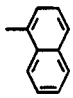 |
| [157] | p-$C_3H_7$ | 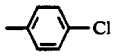 | 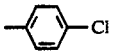 |
| [158] | p-isoC$_3$H$_7$ | 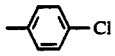 | 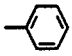 |
| [159] | p-terC$_4$H$_9$ | 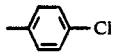 | 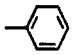 |
| [160] | o-$C_2H_5$ | 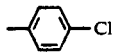 | 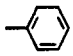 |

-continued

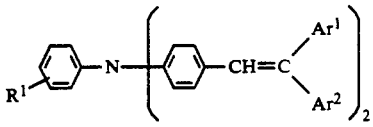

| Compound No. | $R^1$ | $Ar^1$ | $Ar^2$ |
|---|---|---|---|
| [161] | p-$C_3H_7$ | 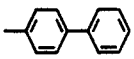 | 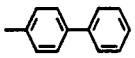 |
| [162] | o-$C_2H_5$ | 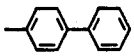 | 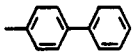 |
| [163] | o-isoC$_3$H$_7$ | 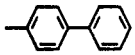 | 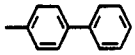 |
| [164] | p-$C_4H_9$ | 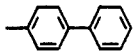 | 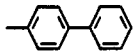 |
| [165] | p-$C_2H_5$ | 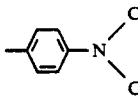 | 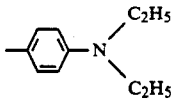 |

Formula [$F_1$]

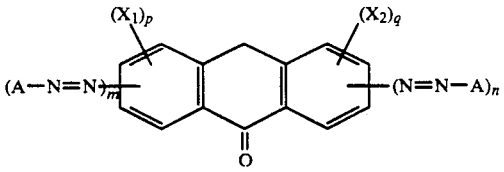

(wherein $X_1$ and $X_2$ represent each a halogen atom, an alkyl group, an alkoxy group, a nitro group, a cyano group, a hydroxy group or a substituted or non-substituted amino group; p and q are each an integer of 0, 1, or 2, provided, p and q are each an integer of 2, $X_1$ and $X_2$ may be the same with or the different from each other; and A represents a group represented by the following Formula [$F_1$-1];

Formula [$F_1$-1]

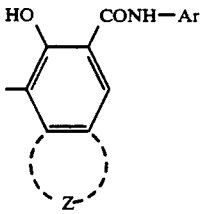

(wherein Ar represents a fluorohydrocarbon group, or an aromatic carbocyclic group or an aromatic heterocyclic group having a substituent; Z represents a group consisting of the non-metal atoms each necessary to form a substituted or non-substituted aromatic carbon ring or a substituted or non-substituted aromatic heterocyclic ring; and m and n are each an integer of 0, 1 or 2, provided m and n are each an integer of 0 at the same time.)

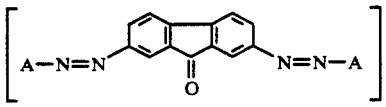

| Sample Nos. | A |
|---|---|
| $F_1$-1 | 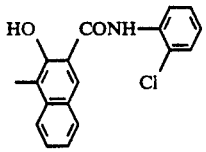 |
| $F_1$-2 | 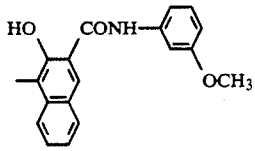 |
| $F_1$-3 | 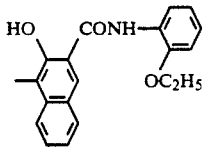 |
| $F_1$-4 | 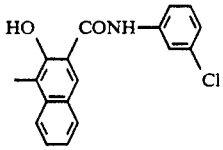 |
| $F_1$-5 | 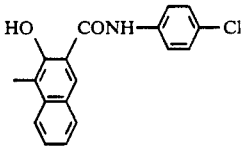 |

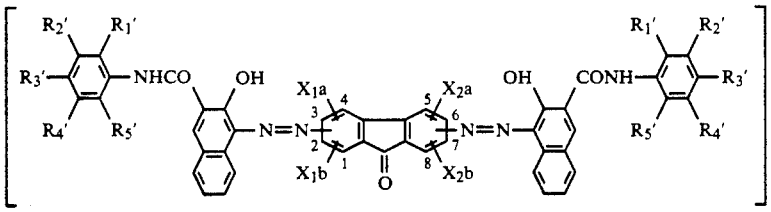

| No. | Azo group substituted position | $X_1a$ | $X_1b$ | $X_2a$ | $X_2b$ | $R_1'$ | $R_2'$ | $R_3'$ | $R_4'$ | $R_5'$ |
|---|---|---|---|---|---|---|---|---|---|---|
| $F_1$-6 | 2, 7 positions | 4-F | H | H | H | H | $CF_3$ | H | H | H |
| $F_1$-7 | 2, 7 positions | 4-F | H | H | H | $CF_3$ | H | H | $CF_3$ | H |
| $F_1$-8 | 2, 7 positions | 3-F | H | 5-F | H | $CF_3$ | H | H | H | H |
| $F_1$-9 | 2, 7 positions | 3-F | H | 6-OH | H | H | $CF_3$ | H | H | H |
| $F_1$-10 | 2, 7 positions | 4-Cl | H | H | H | H | $CF_3$ | Cl | H | H |
| $F_1$-11 | 2, 7 positions | 3-Cl | H | 6-Cl | H | H | $CF_3$ | H | H | H |
| $F_1$-12 | 2, 7 positions | 4-Br | H | H | H | H | $CF_3$ | H | H | H |
| $F_1$-13 | 2, 7 positions | 4-Br | H | 5-Br | H | H | H | $CF_3$ | H | H |
| $F_1$-14 | 2, 7 positions | 4-Br | 3-Br | 6-Br | H | H | $CF_3$ | H | H | H |
| $F_1$-15 | 2, 7 positions | 4-I | H | H | H | H | $CF_3$ | H | H | H |
| $F_1$-16 | 2, 7 positions | 4-I | H | H | H | $CF_3$ | H | H | $CF_3$ | H |
| $F_1$-17 | 2, 6 positions | 4-Cl | H | H | H | H | $CF_3$ | H | H | H |
| $F_1$-18 | 3, 6 positions | 2-Cl | H | 7-Cl | H | H | $CF_3$ | H | H | H |
| $F_1$-19 | 3, 6 positions | 4-Br | H | H | H | H | H | $CF_3$ | H | H |
| $F_1$-20 | 3, 6 positions | 4-I | H | H | H | Cl | H | H | $CF_3$ | H |
| $F_1$-21 | 2, 5 positions | 3-Br | H | H | H | H | $CF_3$ | H | H | H |
| $F_1$-22 | 1, 8 positions | 3-Cl | H | H | H | H | $CF_3$ | H | H | H |
| $F_1$-23 | 2, 7 positions | 4-Br | H | H | H | H | H | H | $CF_3$ | H |

-continued

| | | | | | | | | | | |
|---|---|---|---|---|---|---|---|---|---|---|
| $F_1$-24 | 2, 7 positions | 4-I | H | H | H | H | $CF_3$ | H | H | Cl |

Formula [$F_2$]

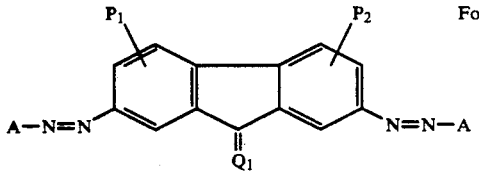

[wherein, A represents the following coupler;

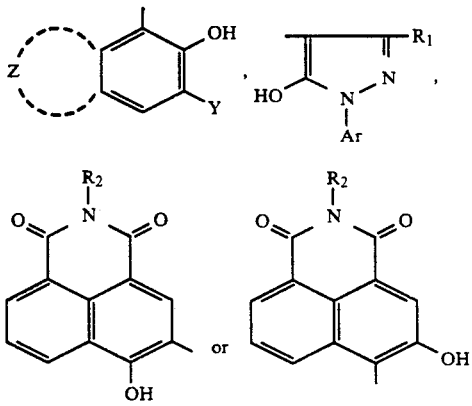

wherein Y represents a substituted or unsubstituted aromatic group;

$R_1$represents a hydrogen atom or one of the following 4 substituted or non-substituted groups; namely, an alkyl group, an amino group, a carbamoyl group, a carboxy group pr the ester groups thereof and a cyano group;

$R_2$ represents one of the following 3 groups; namely, an alkyl group, an aralkyl group and an aryl group;

$Q_1$ represents

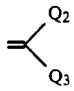

or an oxygen atom;

$Q_2$ and $Q_3$ represent each a hydrogen atom, a cyano group, an alkyl group, a substituted or unsubstituted aromatic group, a halogen atom, a vinyl group, an acyl group or an ester group, provided, $Q_2$ and $Q_3$ may be linked to other atomic group so that a ring may be formed;

$P_1$ and $P_2$ represent each a hydrogen atom, a halogen atom, a methyl group or a methoxy group.]

$F_2$-1

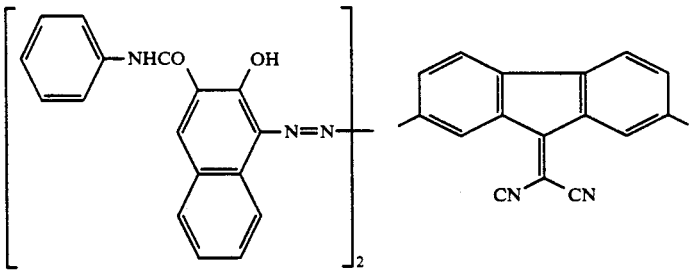

$F_2$-2

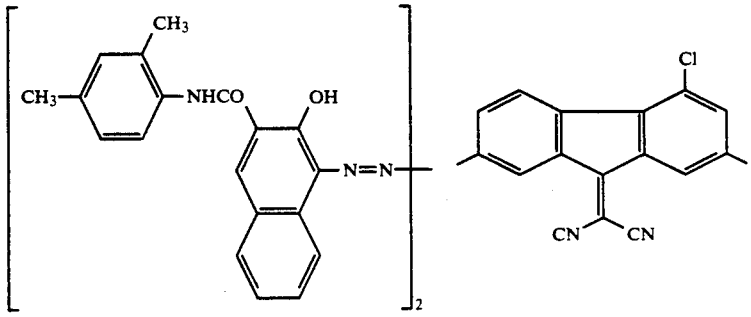

-continued
$F_2$-3
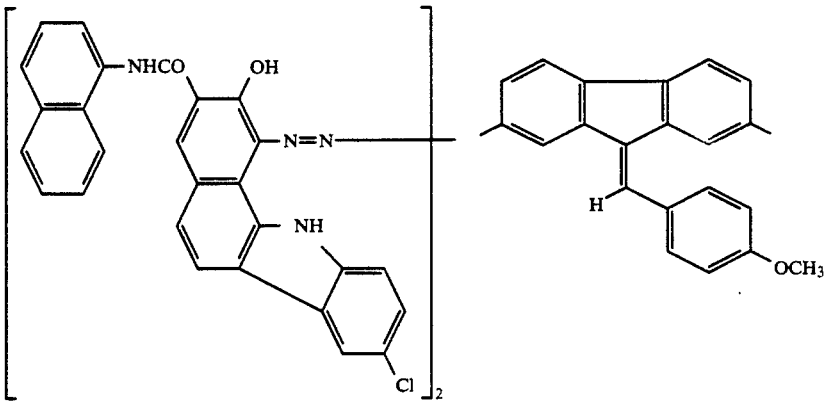
$F_2$-4
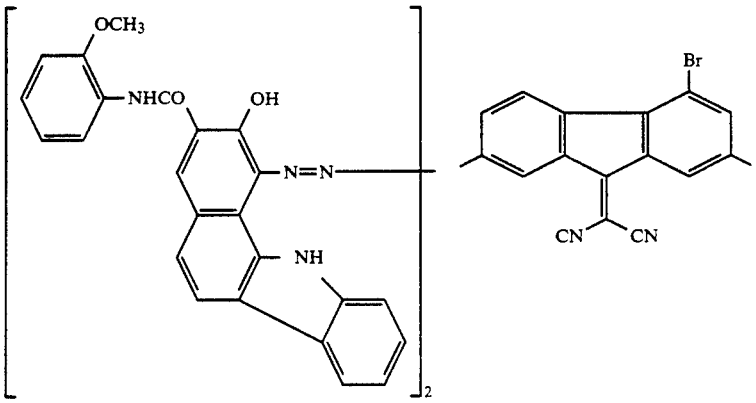
$F_2$-5
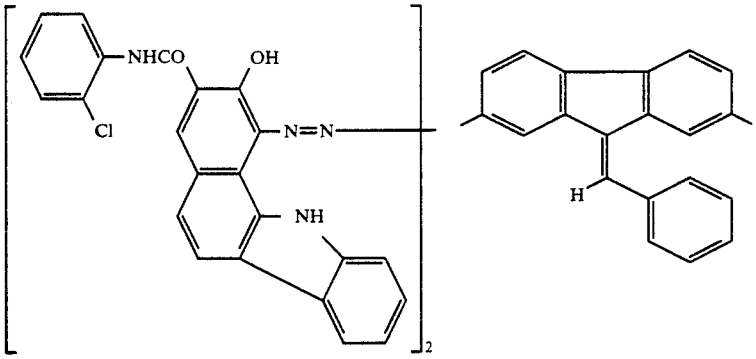
$F_2$-6
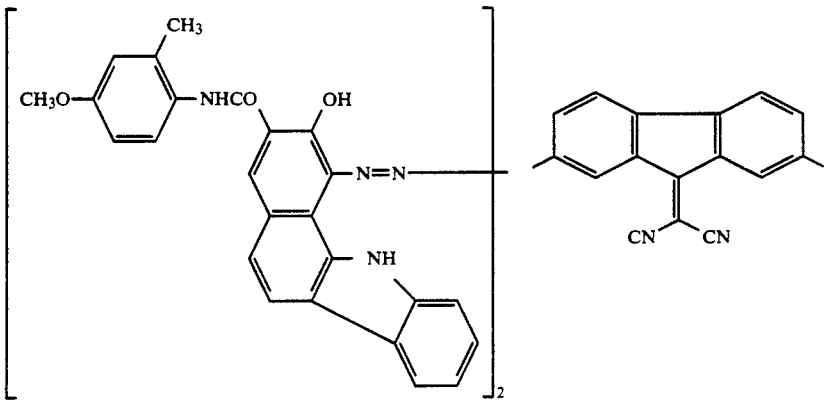

-continued
$F_2$-7
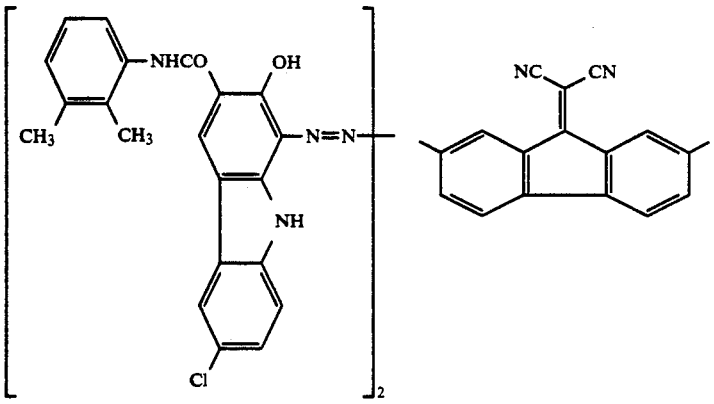
Formula [$Q_1$]
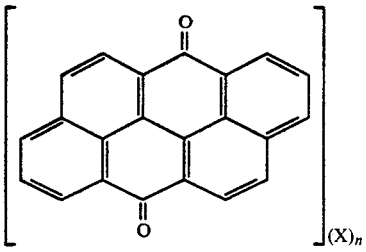
Formula [$Q_2$]
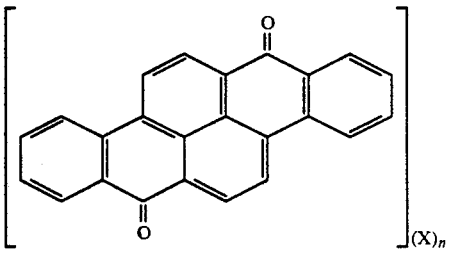
Formula [$Q_3$]
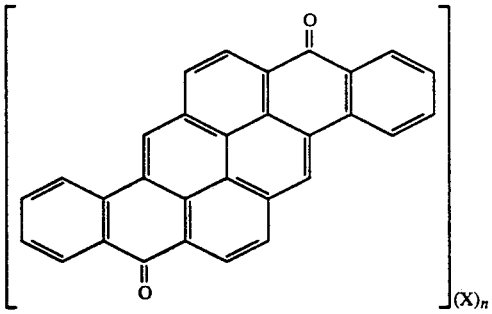
(wherein X represents a halogen atom, a nitro group, a cyano group, an acyl group or a carboxy group; n is an integer of 0 to 4; and m is an integer of 0 to 6.)
$Q_1$-1
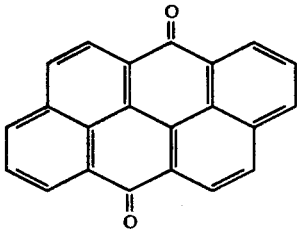
-continued
$Q_1$-2
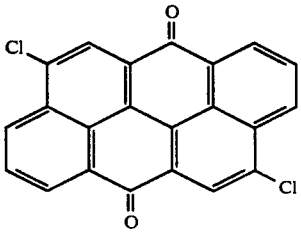

-continued
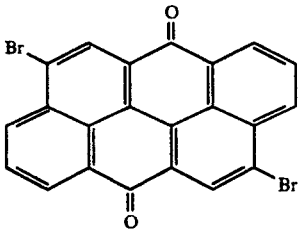
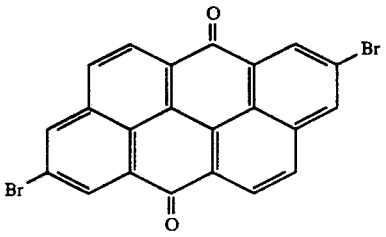
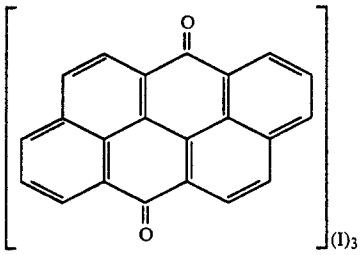
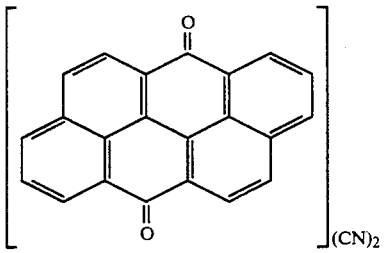
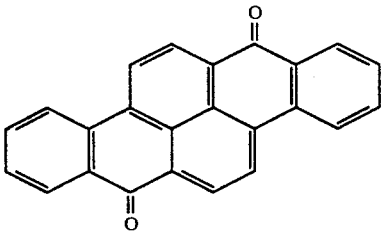
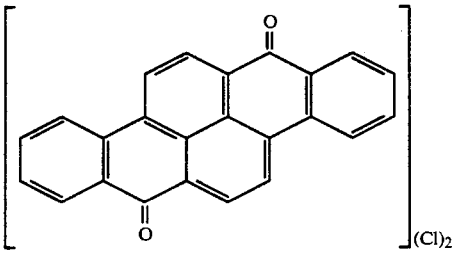
-continued
Q1-3
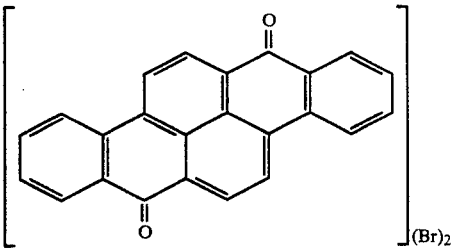
Q2-3
Q1-4
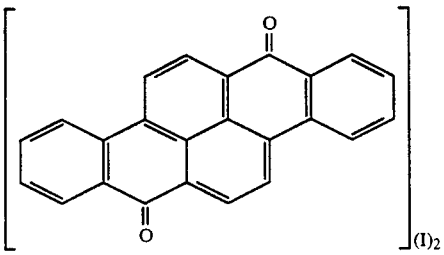
Q2-4
Q1-5
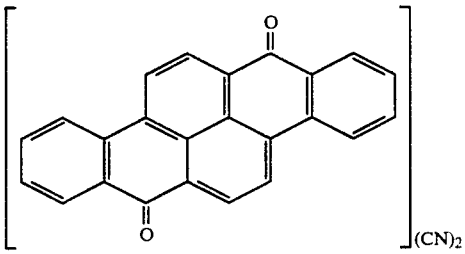
Q2-5
Q1-6
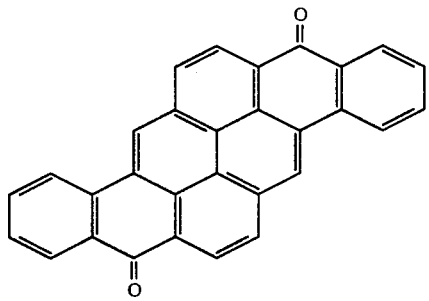
Q3-1
Q2-1
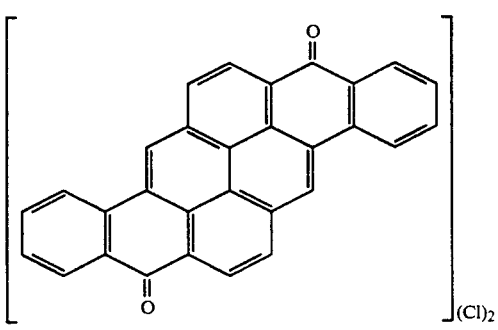
Q3-2
Q2-2

-continued

Q3-3

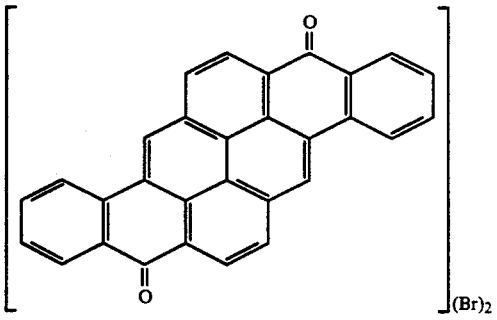

Q3-4

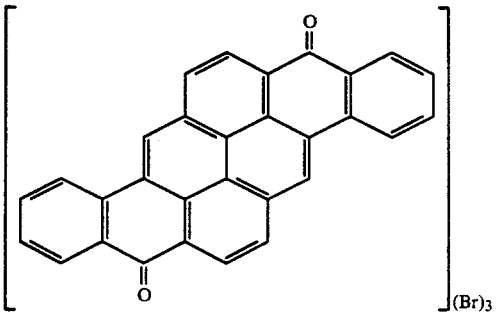

Formula [TP]

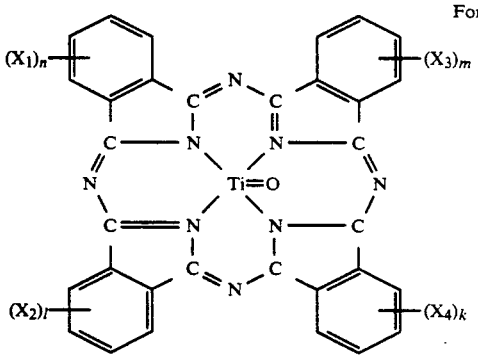

(wherein $X_1$, $X_2$, $X_3$ and $X_4$ represent independently H, Cl or Br; and n, m, l and k represent independently an integer of 0 to 4.)

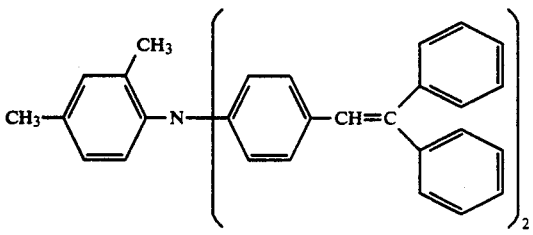

Comparative Compound (1)

-continued

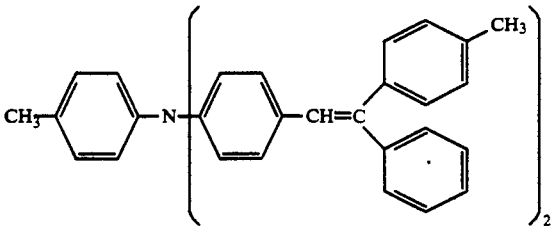

Comparative Compound (2)

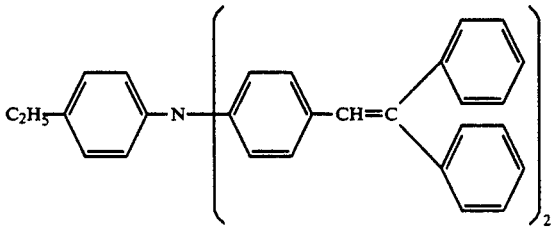

Comparative Compound (3)

What is claimed is:

1. An electrophotographic photoreceptor comprising: an electroconductive support provided thereon, a photosensitive layer containing a compound represented by formula I, formula I

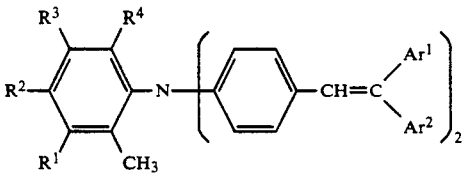

wherein, $R^1$, $R^2$, $R^3$ and $R^4$ represent each a hydrogen atom or an alkyl group having 1 to 4 carbon atoms, $Ar^1$ and $Ar^2$ represent each

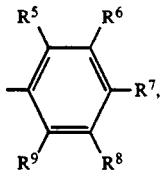

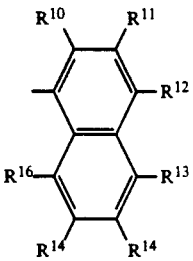

or

-continued

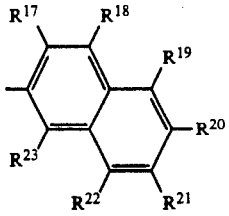

wherein $R^5$, $R^6$, $R^7$, $R^8$, $R^9$, $R^{10}$, $R^{11}$, $R^{12}$, $R^{13}$, $R^{14}$, $R^{15}$, $R^{16}$, $R^{17}$, $R^{18}$, $R^{19}$, $R^{20}$, $R^{21}$, $R^{22}$, and $R^{23}$ represent each a hydrogen atom, an alkyl group having 1 to 4 carbon atoms, a halogen atom,

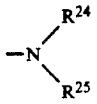

wherein $R^{24}$ and $R^{25}$ represent each an alkyl group, an aralkyl group or a phenyl group, —$OR^{28}$ wherein $R^{26}$ represents an alkyl group, an aralkyl group or a phenyl group, a hydroxyl group, an aralkyl group, a phenyl group, —$R^{27}COOR^{28}$ wherein $R^{27}$ represents an alkylene group and $R^{28}$ represents an alkyl group, —$COOR^{29}$ wherein $R^{29}$ represents an alkyl group, —$R^{30}COOR^{31}$ wherein $R^{30}$ represents an alkylene group and $R^{31}$ represents an alkyl group, or —O-$COR^{32}$ wherein $R^{32}$ represents an alkyl group;

when $Ar^1$ represents

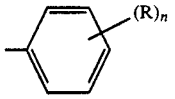

and $Ar^2$ represents

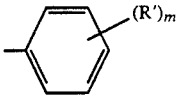

wherein R and R′ each represents an alkyl group having 1 to 4 carbon atoms, n is 1 and m is 0 or 1; $Ar^1$ and $Ar^2$ each is not phenyl group non-substituted, at the same time.

2. The electrophotographic photoreceptor of claim 1, wherein $Ar^1$ represents

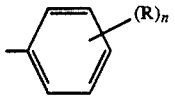

$Ar^2$ represents

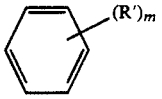

3. The electrophotographic photoreceptor of claim 2, wherein R represents a methyl group.

4. The electrophotographic photoreceptor of claim 2, wherein n is 1, and m is 0.

5. An electrophotographic photoreceptor comprising an electroconductive support provided thereon, a photosensitive layer having a binder and a compound selected from the group consisting of formulae I, II and III, formula I

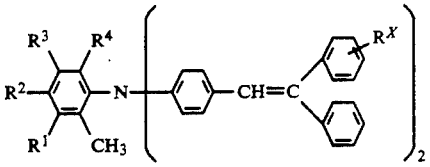

wherein $R_1$, $R_2$, $R_3$, $R_4$ and $R^x$ each represents an alkyl group having 1 to 4 carbon atoms, formula II

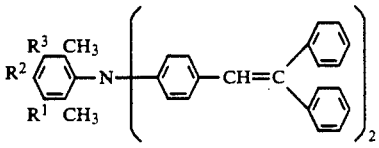

wherein $R^1$, $R^2$ and $R^3$ represent each a hydrogen atom or an alkyl group having 1 to 4 carbon atoms, formula III

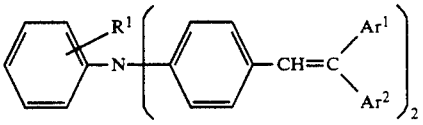

wherein $R^1$ represents an alkyl group having 2 to 4 carbon atoms, $Ar^1$ and $Ar^2$ represent each

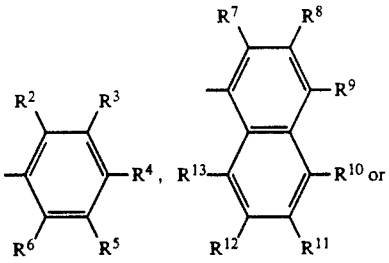

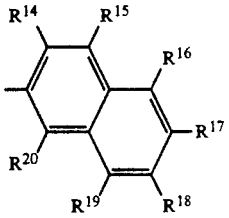

wherein $R^2$, $R^3$, $R^4$, $R^5$, $R^6$, $R^7$, $R^8$, $R^9$, $R^{10}$, $R^{11}$, $R^{12}$, $R^{13}$, $R^{14}$, $R^{15}$, $R^{16}$, $R^{17}$, $R^{18}$, $R^{19}$ and $R^{20}$ represent each a hydrogen atom, an alkyl group having 1 to 4 carbon atoms, a halogen atom,

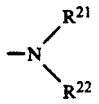

wherein $R^{21}$ and $R^{22}$ represent each an alkyl group, an aralkyl group or a phenyl group, —$OR^{23}$ wherein $R^{23}$ represents an alkyl group, an aralkyl group or a phenyl group, a hydroxyl group, an aralkyl group, a phenyl group, —$R^{24}COOR^{25}$ wherein $R^{24}$ represents an alkylene group and $R^{25}$ represents an alkyl group, —$COOR^{26}$ wherein $R^{26}$ represents an alkyl group, —$R^{27}OCOR^{28}$ wherein $R^{27}$ represents an alkylene group and $R^{28}$ represents an alkyl group, or —O-$COR^{29}$ wherein $R^{29}$ represents an alkyl group;

when $Ar^1$ represents

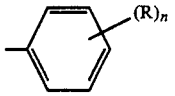

and $Ar^2$ represents

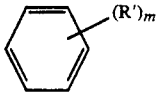

wherein R and R′ each represents an alkyl group having 1 to 4 carbon atoms, n is 1 and m is 1 or 0; $Ar^1$ and $Ar^2$ each is not phenyl group non-substituted, at the same time.

6. The electrophotographic photoreceptor of claim 5, wherein $Ar^1$ represents

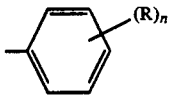

and $Ar^2$ represents

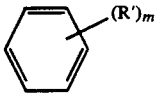

wherein R and R′ each represents an alkyl group having 1 to 4 carbon atoms, and n is 1 and m is 0.

7. The electrophotographic photoreceptor of claim 5, the compound is

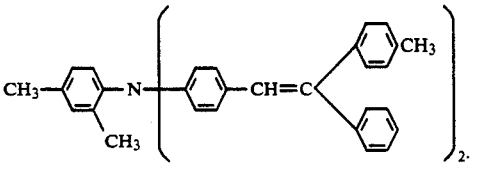

* * * * *